US011088464B2

(12) United States Patent
Sato et al.

(10) Patent No.: US 11,088,464 B2
(45) Date of Patent: Aug. 10, 2021

(54) SLOT ARRAY ANTENNA

(71) Applicants: Nidec Corporation, Kyoto (JP); WGR Co., Ltd., Kyoto (JP)

(72) Inventors: Yosuke Sato, Kyoto (JP); Hiroyuki Kamo, Kyoto (JP); Hideki Kirino, Kyoto (JP)

(73) Assignees: NIDEC CORPORATION, Kyoto (JP); WGR CO., LTD., Kyoto (JP)

( * ) Notice: Subject to any disclaimer, the term of this patent is extended or adjusted under 35 U.S.C. 154(b) by 236 days.

(21) Appl. No.: 16/438,699

(22) Filed: Jun. 12, 2019

(65) Prior Publication Data

US 2019/0386396 A1 Dec. 19, 2019

(30) Foreign Application Priority Data

Jun. 14, 2018 (JP) ..... JP2018-113890

(51) Int. Cl.
*H01Q 21/06* (2006.01)
*H01Q 21/00* (2006.01)
*H01Q 1/24* (2006.01)

(52) U.S. Cl.
CPC ..... *H01Q 21/005* (2013.01); *H01Q 1/247* (2013.01); *H01Q 21/064* (2013.01)

(58) Field of Classification Search
CPC ..... H01Q 21/0037; H01Q 21/0043; H01Q 21/005; H01Q 1/247
See application file for complete search history.

(56) References Cited

U.S. PATENT DOCUMENTS 4,513,291 A 4/1985 Drabowitch
6,191,704 B1 2/2001 Takenaga et al.
(Continued)

FOREIGN PATENT DOCUMENTS

CN 201134511 Y 10/2008
CN 107026304 A 8/2017
(Continued)

OTHER PUBLICATIONS

Kirino et al., "A 76 GHz Multi-Layered Phased Array Antenna Using a Non-Metal Contact Metamaterial Waveguide", IEEE Transactions on Antennas and Propagation, vol. 60, No. 2, Feb. 2012, pp. 840-853.
(Continued)

*Primary Examiner* — Daniel Munoz
(74) *Attorney, Agent, or Firm* — Keating & Bennett

(57) ABSTRACT

A slot array antenna includes: first and second conductive members; and a ridge-shaped waveguide member on the second conductive member and conductive rods surrounding it. The waveguide member has a waveguide face which is opposed to a conductive surface of the first conductive member and which extends along a first direction. The first conductive member includes first and second slot groups each arranged along the first direction. The second conductive member has a throughhole which splits the waveguide member into first and second ridges. Some slots in the first and second slot groups are connected to a waveguide within the throughhole via a waveguide extending between the waveguide face of the first ridge and the conductive surface, and the remaining slots are connected to the waveguide within the throughhole via a waveguide extending between the waveguide face of the second ridge and the conductive surface.

20 Claims, 44 Drawing Sheets

(56) References Cited

U.S. PATENT DOCUMENTS

| | | | | |
|---|---|---|---|---|
| 6,339,395 | B1 | 1/2002 | Hazumi et al. | |
| 6,403,942 | B1 | 6/2002 | Stam | |
| 6,611,610 | B1 | 8/2003 | Stam et al. | |
| 6,628,299 | B2 | 9/2003 | Kitayama | |
| 6,661,367 | B2 | 12/2003 | Sugiyama et al. | |
| 6,703,967 | B1 | 3/2004 | Kuroda et al. | |
| 6,903,677 | B2 | 6/2005 | Takashima et al. | |
| 6,943,726 | B2 | 9/2005 | Schneider | |
| 7,161,561 | B2 | 1/2007 | Kitayama | |
| 7,355,524 | B2 | 4/2008 | Schofield | |
| 7,358,889 | B2 | 4/2008 | Abe et al. | |
| 7,417,580 | B2 | 8/2008 | Abe et al. | |
| 7,420,159 | B2 | 9/2008 | Heslin et al. | |
| 7,425,983 | B2 | 9/2008 | Izumi et al. | |
| 7,570,198 | B2 | 8/2009 | Tokoro | |
| 7,978,122 | B2 | 7/2011 | Schmidlin | |
| 8,068,134 | B2 | 11/2011 | Yoshizawa | |
| 8,446,312 | B2 | 5/2013 | Kanamoto et al. | |
| 8,543,277 | B2 | 9/2013 | Higgins-Luthman | |
| 8,593,521 | B2 | 11/2013 | Schofield et al. | |
| 8,604,968 | B2 | 12/2013 | Alland et al. | |
| 8,610,620 | B2 | 12/2013 | Katoh | |
| 8,614,640 | B2 | 12/2013 | Lynam | |
| 8,636,393 | B2 | 1/2014 | Schofield | |
| 8,730,096 | B2 | 5/2014 | Kanamoto et al. | |
| 8,730,099 | B2 | 5/2014 | Kanamoto et al. | |
| 8,779,995 | B2 | 7/2014 | Kirino et al. | |
| 8,803,638 | B2 | 8/2014 | Kildal | |
| 8,861,842 | B2 | 10/2014 | Jung et al. | |
| 9,286,524 | B1 | 3/2016 | Mei et al. | |
| 9,786,995 | B2 | 10/2017 | Kirino et al. | |
| 10,027,032 | B2 | 7/2018 | Kirino et al. | |
| 10,042,045 | B2 | 8/2018 | Kirino et al. | |
| 10,090,600 | B2 | 10/2018 | Kirino et al. | |
| 10,158,158 | B2 | 12/2018 | Kirino et al. | |
| 2011/0187614 | A1* | 8/2011 | Kirino | H01Q 3/32 343/713 |
| 2012/0092224 | A1 | 4/2012 | Sauleau et al. | |
| 2013/0033404 | A1 | 2/2013 | Abe | |
| 2015/0229027 | A1* | 8/2015 | Sonozaki | H01Q 13/10 343/771 |
| 2015/0264230 | A1 | 9/2015 | Takeda | |
| 2016/0140424 | A1 | 5/2016 | Wang et al. | |
| 2016/0264065 | A1 | 9/2016 | Takeda | |
| 2017/0187124 | A1 | 6/2017 | Kirino et al. | |
| 2017/0317427 | A1 | 11/2017 | Kirino et al. | |
| 2018/0040963 | A1 | 2/2018 | Kirino et al. | |
| 2018/0301817 | A1 | 10/2018 | Ichinose et al. | |
| 2018/0351261 | A1 | 12/2018 | Kamp et al. | |
| 2018/0375219 | A1 | 12/2018 | Kirino et al. | |
| 2019/0006743 | A1 | 1/2019 | Kirino et al. | |
| 2019/0067780 | A1 | 2/2019 | Kirino et al. | |
| 2019/0074569 | A1 | 3/2019 | Kamo et al. | |
| 2019/0139914 | A1 | 5/2019 | Kirino et al. | |
| 2019/0140344 | A1 | 5/2019 | Kirino et al. | |

FOREIGN PATENT DOCUMENTS

| | | | |
|---|---|---|---|
| CN | 206602168 | U | 10/2017 |
| CN | 108417946 | A | 8/2018 |
| CN | 108736165 | A | 11/2018 |
| EP | 1 331 688 | A1 | 7/2003 |
| JP | 64-29004 | A | 1/1989 |
| JP | 09-64637 | A | 3/1997 |
| JP | 2001-267838 | A | 9/2001 |
| JP | 2004-257848 | A | 9/2004 |
| JP | 2005-167755 | A | 6/2005 |
| JP | 2007-259047 | A | 10/2007 |
| JP | 2010-021828 | A | 1/2010 |
| JP | 2012-004700 | A | 1/2012 |
| JP | 2012-523149 | A | 9/2012 |
| JP | 2013-032979 | A | 2/2013 |
| WO | 01/67540 | A1 | 9/2001 |
| WO | 2008/081807 | A1 | 7/2008 |
| WO | 2010/050122 | A1 | 5/2010 |
| WO | 2015/172948 | A2 | 11/2015 |
| WO | 2016/163932 | A1 | 10/2016 |
| WO | 2018/105513 | A1 | 6/2018 |
| WO | 2018/207796 | A1 | 11/2018 |
| WO | 2018/207838 | A1 | 11/2018 |
| WO | 2019/022651 | A1 | 1/2019 |
| WO | 2019/057965 | A1 | 3/2019 |

OTHER PUBLICATIONS

Zaman et al., "Ku Band Linear Slot-Array in Ridge Gapwaveguide Technolgy", 7th European Conference on Antennas and Propagation (EUCAP 2013)—Convened Sessions, 2013, pp. 2968-2971.

Kildal et al., "Local Metamaterial-Based Waveguides in Gaps Between Parallel Metal Plates", IEEE Antennas and Wireless Propagation Letters, vol. 8, 2009, pp. 84-87.

Pucci et al., "Design of a Dual-Mode Horn Element for Microstrip Gap Waveguide Fed Array", 7th European Conference on Antennas and Propagation (EUCAP 2013)—Convened Sessions, 2013, pp. 2976-2979.

Kildal, "Metasurfing Since 1987—A Personal Story Involving Soft and Hard Surfaces, EBG Surfaces, Cloaking, Gap Waveguides and Mass Production", 2014 IEEE Antennas and Propagation Society International Symposium, 2014, pp. 529-530.

Sehm et al., "A High-Gain 58-GHz Box-Horn Array Antenna with Suppressed Grating Lobes", IEEE Transactions on Antennas and Propagation, vol. 47, No. 7, Jul. 1999, pp. 1125-1130.

Zaman et al., "Slot Antenna in Ridge Gap Waveguide Technology", 6th European Conference on Antennas and Propagation, Mar. 2012, pp. 3243 & 3244.

Zarifi et al., "Design and Fabrication of a High-Gain 60-GHz Corrugated Slot Antenna Array With Ridge Gap Waveguide Distribution Layer", IEEE Transactions on Antennas and Propagation, vol. 64, No. 7, Jul. 2016, pp. 2905-2913.

Mustafa, "Hybrid Analog-Digital Beam-Steered Slot Antenna Array for mm-Wave Applications in Gap Waveguide Technology", Department of Electronics and Telecommunications Master of Science in Telecommunications Engineering Master's Thesis, Oct. 2015, 67 pages.

Kirino et al., "Simplified Wavelength Calculations for Fast and Slow Wave Metamaterial Ridged Waveguides and their Application to Array Antenna Design", Proceedings of the International Symposium on Antennas & Propagation, Oct. 25, 2013, 4 pages.

Ahmadi et al., "Direct Coupled Resonator Filters Realized by Gap Waveguide Technology", IEEE Transactions on Microwave Theory and Techniques, vol. 63, No. 10, Oct. 2015, pp. 3445-3452.

Bencivenni et al., "Towards Integrated Active Antennas for 5G mm-wave Applications at Gapwaves", 2018 IEEE Symposium on Antennas and Propogation & USNC/URSI National Radio Science Meeting, 2018, pp. 415 and 416.

* cited by examiner

SLOT ARRAY ANTENNA

CROSS REFERENCE TO RELATED APPLICATION

The present application claims priority under 35 U.S.C. § 119 to Japanese Application No. 2018-113890 filed on Jun. 14, 2018, the entire contents of which is incorporated herein by reference.

FIELD OF THE INVENTION

The present disclosure relates to a slot array antenna.

BACKGROUND

An array antenna (also referred to as an "antenna array") which includes a plurality of radiating elements (also referred to as "antenna elements") arrayed along a line or on a plane finds its use in various applications, e.g., radar and communication systems. In order to radiate electromagnetic waves from an array antenna, it is necessary to supply electromagnetic waves (e.g., radio-frequency signal waves) to each radiating element, from a circuit which generates electromagnetic waves. Such supply of signal waves is performed via a waveguide. A waveguide is also used to send electromagnetic waves that are received at the antenna elements to a reception circuit.

Conventionally, feed to an array antenna has often been achieved by using a microstrip line(s). However, in the case where the frequency of an electromagnetic wave to be transmitted or received by an array antenna is a high frequency above 30 gigahertz (GHz), as in the millimeter band, a microstrip line will incur a large dielectric loss, thus detracting from the efficiency of the antenna. Therefore, in such a radio frequency region, an alternative waveguide to replace a microstrip line is needed.

As alternative waveguide structures to the microstrip line and the hollow waveguide, the specification of U.S. Pat. No. 8,779,995, the specification of U.S. Pat. No. 8,803,638 and the specification of European Patent Application Publication No. 1331688, and Kirino et al., "A 76 GHz Multi-Layered Phased Array Antenna Using a Non-Metal Contact Metamaterial Waveguide", IEEE Transaction on Antennas and Propagation, Vol. 60, No. 2, February 2012, pp 840-853, Kildal et al., "Local Metamaterial-Based Waveguides in Gaps Between Parallel Metal Plates", IEEE Antennas and Wireless Propagation Letters, Vol. 8, 2009, pp. 84-87 and Syed Kamal Mustafa, Chalmers University of Technology, Master's Thesis "Hybrid Analog-Digital Beam-Steered Slot Antenna Array for mm-Wave Applications in Gap Waveguide Technology", October 2015 disclose structures which guide electromagnetic waves by utilizing an artificial magnetic conductor (AMC) extending on both sides of a ridge-type waveguide. the specification of U.S. Pat. No. 8,779,995 and Kirino et al., "A 76 GHz Multi-Layered Phased Array Antenna Using a Non-Metal Contact Metamaterial Waveguide", IEEE Transaction on Antennas and Propagation, Vol. 60, No. 2, February 2012, pp 840-853, Kildal et al., "Local Metamaterial-Based Waveguides in Gaps Between Parallel Metal Plates", IEEE Antennas and Wireless Propagation Letters, Vol. 8, 2009, pp. 84-87 and Syed Kamal Mustafa, Chalmers University of Technology, Master's Thesis "Hybrid Analog-Digital Beam-Steered Slot Antenna Array for mm-Wave Applications in Gap Waveguide Technology", October 2015, each disclose a slot array antenna utilizing such a waveguide structure.

On the other hand, Japanese Laid-Open Patent Publication No. 2005-167755 and the specification of U.S. Pat. No. 4,513,291 disclose a slot array antenna that includes a hollow waveguide having a plurality of slots.

The slot array antennas disclosed in Japanese Laid-Open Patent Publication No. 2005-167755 and the specification of U.S. Pat. No. 4,513,291 and Syed Kamal Mustafa, Chalmers University of Technology, Master's Thesis "Hybrid Analog-Digital Beam-Steered Slot Antenna Array for mm-Wave Applications in Gap Waveguide Technology", October 2015 are able to radiate polarized waves whose electric field oscillates along a direction which is perpendicular to the direction that the waveguide extends. These slot array antennas include a plurality of rectangular slots as antenna elements, the rectangular slots being arrayed along the waveguide. Each of the plurality of slots is disposed so that its longitudinal direction coincides with the direction that the waveguide extends. Among the plurality of slots, any odd-numbered slot as counted from an end is located on one side of a center line of the waveguide, while any even-numbered slot is located on the other side of the center line of the waveguide. The interval between two adjacent slots along a direction that follows along the waveguide is approximately ½ of the wavelength of an electromagnetic wave propagating in the waveguide. With such a structure, even when the interval between slots along the direction following along the waveguide is shorter than the wavelength in the waveguide, the respective slots can be excited in the same phase.

SUMMARY

Example embodiments of the present disclosure provides techniques for providing slot array antennas each having good radiation characteristics, with a relatively simple construction.

A slot array antenna according to an example embodiment of the present disclosure includes a first electrically conductive member including a first electrically conductive surface on a front side and a second electrically conductive surface on a rear side, a second electrically conductive member including a third electrically conductive surface which is opposed to the second electrically conductive surface, a ridge-shaped waveguide member on the third electrically conductive surface, the waveguide member including an electrically-conductive waveguide surface which is opposed to the second electrically conductive surface and which extends along a first direction, and a plurality of electrically conductive rods disposed on both sides of the waveguide member, each including a root which is connected to the third electrically conductive surface and a leading end which is opposed to the second electrically conductive surface. The first electrically conductive member includes a plurality of slots. The plurality of slots includes a first slot group arranged along the first direction, and a second slot group being adjacent to the first slot group and arranged along the first direction. When viewed from a direction perpendicular to the waveguide surface, a center of each slot in the first slot group is located on one side of a center line of the waveguide surface, a center of each slot in the second slot group is located on another side of the center line of the waveguide surface, and a distance between the center of each slot in the first slot group and the second slot group and the center line of the waveguide surface is shorter than a distance between the center line of the waveguide surface and a center of an electrically conductive rod that is the closest to the center line. Along the first direction, a center of at least one slot in the first slot group is located between two adjacent slots in the second slot group. Along the first direction, the center of at least one slot in the second slot group is located between two adjacent slots in the first slot group. At least a central portion of an opening of each slot included in the first slot group and each slot included in the second slot group extends along the first direction, or along a direction that is inclined by an angle which is smaller than about 45 degrees from the first direction. The second electrically conductive member has a throughhole. The waveguide member is split by the throughhole into a first ridge and a second ridge. When viewed from a direction perpendicular to the waveguide surface, a center of the throughhole is located between one slot included in the first slot group and one slot included in the second slot group. A number of slots in the first slot group and the second slot group is or are connected to a waveguide within the throughhole via a first waveguide extending between the waveguide surface of the first ridge and the second electrically conductive surface. A remaining slot or slots in the first slot group and the second slot group is or are connected to the waveguide in the throughhole via a second waveguide extending between the waveguide surface of the second ridge and the second electrically conductive surface.

According to example embodiments of the present disclosure, slot array antennas having good radiation characteristics are realized with a relatively simple construction.

The above and other elements, features, steps, characteristics and advantages of the present disclosure will become more apparent from the following detailed description of the example embodiments with reference to the attached drawings.

DETAILED DESCRIPTION

Figure 1:
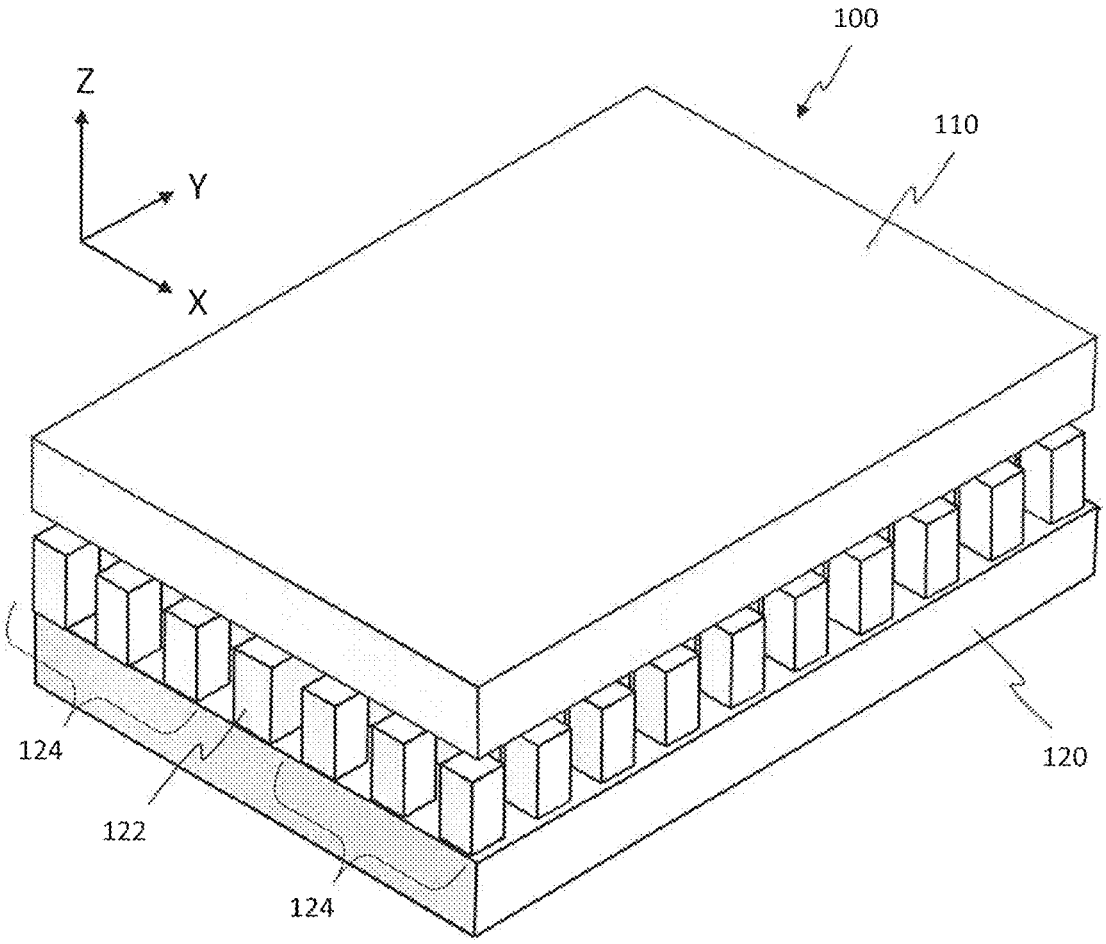
FIG. 1 is a perspective view schematically showing a non-limiting example of a fundamental construction of a waveguide device.

Prior to describing example embodiments of the present disclosure, findings that form the basis of the present disclosure will be described.

A ridge waveguide which is disclosed in the aforementioned specification of U.S. Pat. No. 8,779,995, the specification of U.S. Pat. No. 8,803,638 and the specification of European Patent Application Publication No. 1331688, and Kirino et al., "A 76 GHz Multi-Layered Phased Array Antenna Using a Non-Metal Contact Metamaterial Waveguide", IEEE Transaction on Antennas and Propagation, Vol. 60, No. 2, February 2012, pp 840-853, Kildal et al., "Local Metamaterial-Based Waveguides in Gaps Between Parallel Metal Plates", IEEE Antennas and Wireless Propagation Letters, Vol. 8, 2009, pp 84-87 and Syed Kamal Mustafa, Chalmers University of Technology, Master's Thesis "Hybrid Analog-Digital Beam-Steered Slot Antenna Array for mm-Wave Applications in Gap Waveguide Technology", October 2015 is provided in a waffle iron structure which is capable of functioning as an artificial magnetic conductor. A ridge waveguide in which such an artificial magnetic conductor is utilized based on the present disclosure is able to realize an antenna feeding network with low losses in the microwave or the millimeter wave band. Moreover, use of such a ridge waveguide allows antenna elements to be disposed with a high density. Such a ridge waveguide may be referred to as a waffle-iron ridge waveguide (WRG) in the present specification. Hereinafter, an exemplary fundamental construction and operation of a waffle-iron ridge waveguide will be described.

An artificial magnetic conductor is a structure which artificially realizes the properties of a perfect magnetic conductor (PMC), which does not exist in nature. One property of a perfect magnetic conductor is that "a magnetic field on its surface has zero tangential component". This property is the opposite of the property of a perfect electric conductor (PEC), i.e., "an electric field on its surface has zero tangential component". Although no perfect magnetic conductor exists in nature, it can be embodied by an artificial structure, e.g., an array of a plurality of electrically conductive rods. An artificial magnetic conductor functions as a perfect magnetic conductor in a specific frequency band which is defined by its structure. An artificial magnetic conductor restrains or prevents an electromagnetic wave of any frequency that is contained in the specific frequency band (propagation-restricted band) from propagating along the surface of the artificial magnetic conductor. For this reason, the surface of an artificial magnetic conductor may be referred to as a high impedance surface.

In the waveguide devices disclosed in the specification of U.S. Pat. No. 8,779,995, the specification of U.S. Pat. No. 8,803,638 and the specification of European Patent Application Publication No. 1331688 and Kirino et al., "A 76 GHz Multi-Layered Phased Array Antenna Using a Non-Metal Contact Metamaterial Waveguide", IEEE Transaction on Antennas and Propagation, Vol. 60, No. 2, February 2012, pp 840-853, Kildal et al., "Local Metamaterial-Based Waveguides in Gaps Between Parallel Metal Plates", IEEE Antennas and Wireless Propagation Letters, Vol. 8, 2009, pp 84-87 and Syed Kamal Mustafa, Chalmers University of Technology, Master's Thesis "Hybrid Analog-Digital Beam-Steered Slot Antenna Array for mm-Wave Applications in Gap Waveguide Technology", October 2015, an artificial magnetic conductor is realized by a plurality of electrically conductive rods which are arrayed along row and column directions. Such rods are projections which may also be referred to as posts or pins. Each of these waveguide devices includes, as a whole, a pair of opposing electrically conductive plates. One conductive plate has a ridge protruding toward the other conductive plate, and stretches of an artificial magnetic conductor extending on both sides of the ridge. An electrically-conductive upper face of the ridge is opposed to, via a gap, an electrically conductive surface of the other conductive plate. An electromagnetic wave (signal wave) of a wavelength which is contained in the propagation-restricted band of the artificial magnetic conductor propagates along the ridge, in the space (gap) between this conductive surface and the upper face of the ridge.

FIG. 1 shows XYZ coordinates along X, Y and Z directions which are orthogonal to one another. The waveguide device 100 shown in the figure includes a plate-like (plate-shaped) first electrically conductive member 110 and a plate-like (plate-shaped) second electrically conductive member 120, which are in opposing and parallel positions to each other. A plurality of electrically conductive rods 124 are arrayed on the second conductive member 120.

Note that any structure appearing in a figure of the present application is shown in an orientation that is selected for ease of explanation, which in no way should limit its orientation when an example embodiment of the present disclosure is actually practiced. Moreover, the shape and size of a whole or a part of any structure that is shown in a figure should not limit its actual shape and size.

Figure 2A:
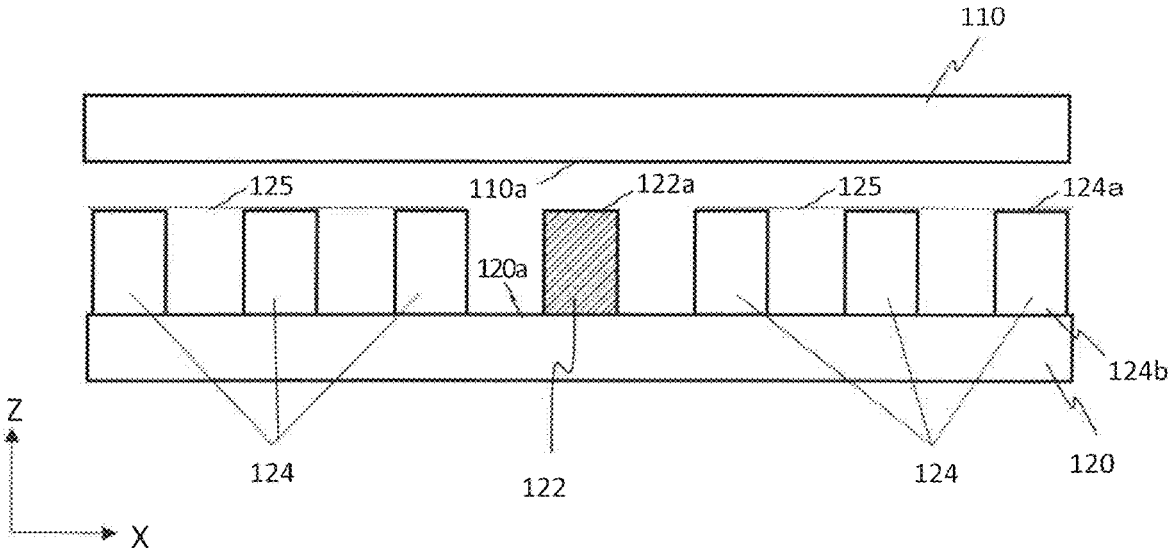
FIG. 2A is a diagram schematically showing an example cross-sectional construction of a waveguide device 100 taken parallel to the XZ plane.

As shown in FIG. 2A, the first conductive member 110 has an electrically conductive surface 110*a* on the side facing the second conductive member 120. The conductive surface 110*a* has a two-dimensional expanse along a plane which is orthogonal to the axial direction (i.e., the Z direction) of the conductive rods 124 (i.e., a plane which is parallel to the XY plane). Although the conductive surface 110*a* is shown to be a smooth plane in this example, the conductive surface 110*a* does not need to be a plane, as will be described later.

Figure 3:
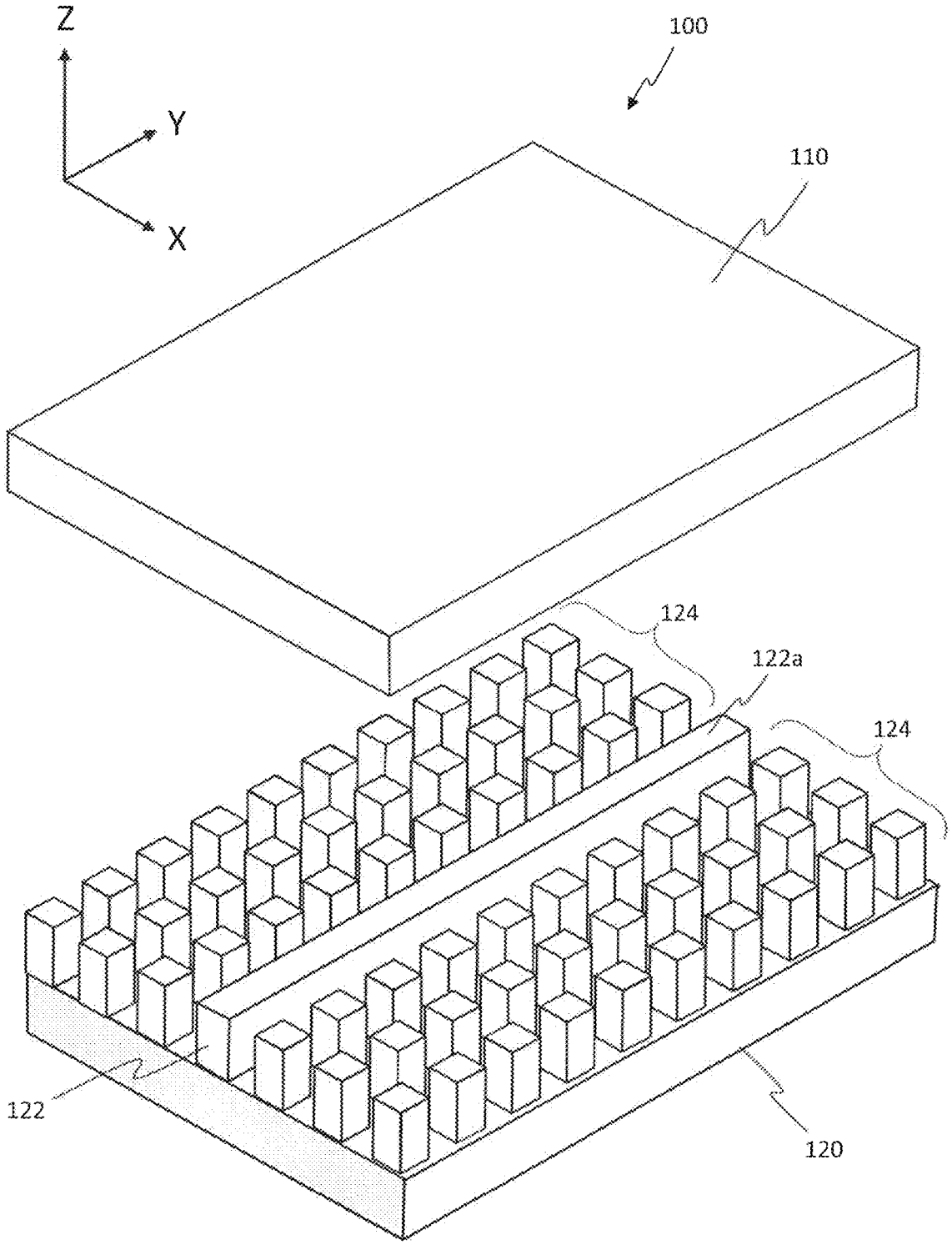
FIG. 3 is a perspective view schematically showing the waveguide device 100, illustrated so that the spacing between a conductive member 110 and a conductive member 120 is exaggerated.

FIG. 3 is a perspective view schematically showing the waveguide device 100, illustrated so that the spacing between the first conductive member 110 and the second conductive member 120 is exaggerated for ease of understanding. In an actual waveguide device 100, as shown in FIG. 1 and FIG. 2A, the spacing between the first conductive member 110 and the second conductive member 120 is narrow, with the first conductive member 110 covering over all of the conductive rods 124 on the second conductive member 120.

FIG. 1 to FIG. 3 only show portions of the waveguide device 100. The conductive members 110 and 120, the waveguide member 122, and the plurality of conductive rods 124 actually extend to outside of the portions illustrated in the figures. At an end of the waveguide member 122, as will be described later, a choke structure for preventing electromagnetic waves from leaking into the external space is provided. The choke structure may include a row of conductive rods that are adjacent to the end of the waveguide member 122, for example.

See FIG. 2A again. The plurality of conductive rods 124 arrayed on the second conductive member 120 each have a leading end 124*a* opposing the conductive surface 110*a*. In the example shown in the figure, the leading ends 124*a* of the plurality of conductive rods 124 are on the same plane. This plane defines the surface 125 of an artificial magnetic conductor. Each conductive rod 124 does not need to be entirely electrically conductive, so long as at least the surface (the upper face and the side faces) of the rod-like structure) is electrically conductive. Moreover, each second conductive member 120 does not need to be entirely electrically conductive, so long as it can support the plurality of conductive rods 124 to constitute an artificial magnetic conductor. Of the surfaces of the second conductive member 120, a face carrying the plurality of conductive rods 124 may be electrically conductive, such that the electrical conductor electrically interconnects the surfaces of adjacent ones of the plurality of conductive rods 124. In other words, the entire combination of the second conductive member 120 and the plurality of conductive rods 124 may at least include an electrically conductive surface with rises and falls opposing the conductive surface 110*a* of the first conductive member 110.

On the second conductive member 120, a ridge-like waveguide member 122 is provided among the plurality of conductive rods 124. More specifically, stretches of an artificial magnetic conductor are present on both sides of the waveguide member 122, such that the waveguide member 122 is sandwiched between the stretches of artificial magnetic conductor on both sides. As can be seen from FIG. 3, the waveguide member 122 in this example is supported on the second conductive member 120, and extends linearly along the Y direction. In the example shown in the figure, the waveguide member 122 has the same height and width as those of the conductive rods 124. As will be described later, however, the height and width of the waveguide member 122 may have respectively different values from those of the conductive rod 124. Unlike the conductive rods 124, the waveguide member 122 extends along a direction (which in this example is the Y direction) in which to guide electromagnetic waves along the conductive surface 110*a*. Similarly, the waveguide member 122 does not need to be entirely electrically conductive, but may at least include an electrically conductive waveguide face 122*a* opposing the conductive surface 110*a* of the first conductive member 110. The second conductive member 120, the plurality of conductive rods 124, and the waveguide member 122 may be portions of a continuous single-piece body. Furthermore, the first conductive member 110 may also be a portion of such a single-piece body.

On both sides of the waveguide member 122, the space between the surface 125 of each stretch of artificial magnetic conductor and the conductive surface 110*a* of the first conductive member 110 does not allow an electromagnetic wave of any frequency that is within a specific frequency band to propagate. This frequency band is called a "prohibited band". The artificial magnetic conductor is designed so that the frequency of a signal wave to propagate in the waveguide device 100 (which may hereinafter be referred to as the "operating frequency") is contained in the prohibited band. The prohibited band may be adjusted based on the following: the height of the conductive rods 124, i.e., the depth of each groove formed between adjacent conductive rods 124; the diameter of each conductive rod 124; the interval between conductive rods 124; and the size of the gap between the leading end 124*a* and the conductive surface 110*a* of each conductive rod 124.

Figure 4:
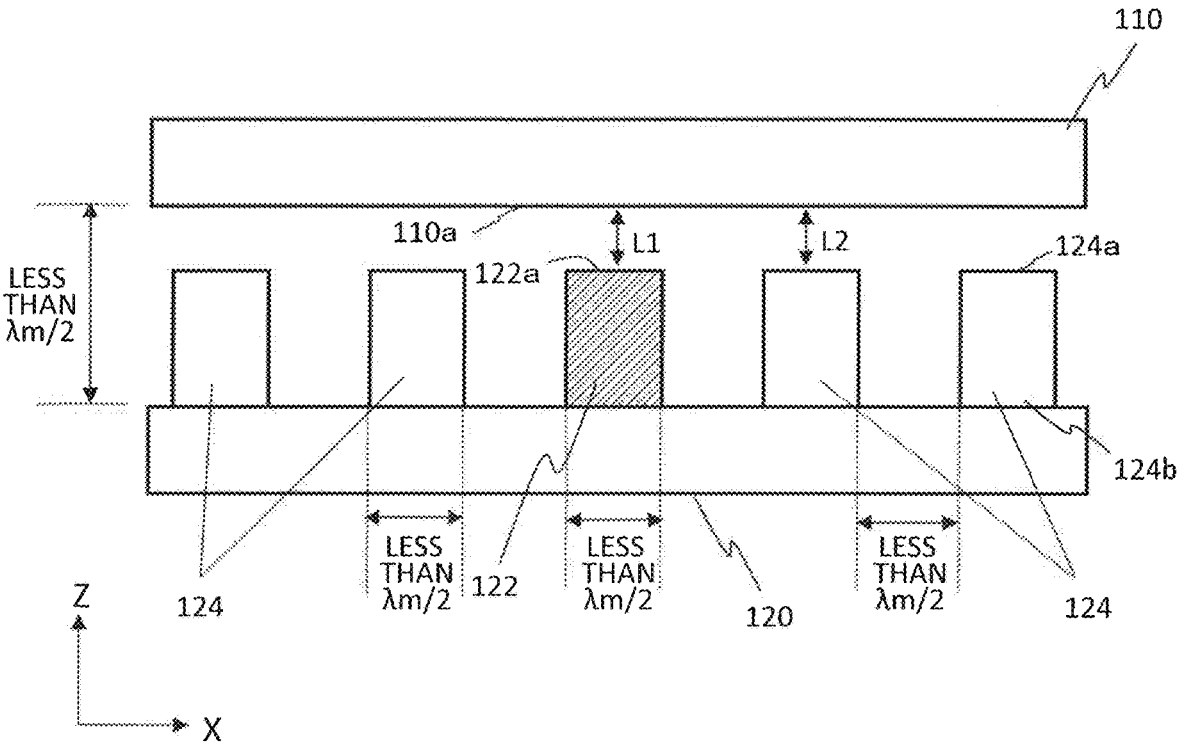
FIG. 4 is a diagram showing an exemplary range of dimension of each member in the structure shown in FIG. 2A.

Next, with reference to FIG. 4, the dimensions, shape, positioning, and the like of each member in the structure shown in FIG. 2A will be described. The waveguide device is used for at least one of transmission and reception of electromagnetic waves of a predetermined band (referred to as the "operating frequency band"). In the present specification, λo denotes a representative value of wavelengths in free space (e.g., a central wavelength corresponding to a center frequency in the operating frequency band) of an electromagnetic wave (signal wave) propagating in a waveguide extending between the conductive surface 110*a* of the first conductive member 110 and the waveguide face 122*a* of the waveguide member 122. Moreover, λm denotes a wavelength, in free space, of an electromagnetic wave of the highest frequency in the operating frequency band. The end of each conductive rod 124 that is in contact with the second conductive member 120 is referred to as the "root". As shown in FIG. 4, each conductive rod 124 has the leading end 124*a* and the root 124*b*. Examples of dimensions, shapes, positioning, and the like of the respective members are as follows.

(1) Width of the Conductive Rod

The width (i.e., the size along the X direction and the Y direction) of the conductive rod 124 may be set to less than λm/2. Within this range, resonance of the lowest order can be prevented from occurring along the X direction and the Y direction. Since resonance may possibly occur not only in the X and Y directions but also in any diagonal direction in an X-Y cross section, the diagonal length of an X-Y cross section of the conductive rod 124 is also preferably less than λm/2. The lower limit values for the rod width and diagonal length will conform to the minimum lengths that are producible under the given manufacturing method, but is not particularly limited.

(2) Distance from the Root of the Conductive Rod to the Conductive Surface of the First Conductive Member 110

The distance from the root 124*b* of each conductive rod 124 to the conductive surface 110*a* of the first conductive member 110 may be longer than the height of the conductive rods 124, while also being less than λm/2. When the distance is λm/2 or more, resonance may occur between the root 124*b* of each conductive rod 124 and the conductive surface 110*a*, thus reducing the effect of signal wave containment.

The distance from the root 124*b* of each conductive rod 124 to the conductive surface 110*a* of the first conductive member 110 corresponds to the spacing between the first conductive member 110 and the second conductive member 120. For example, when a signal wave of 76.5±0.5 GHz (which belongs to the millimeter band or the extremely high frequency band) propagates in the waveguide, the wavelength of the signal wave is in the range from 3.8934 mm to 3.9446 mm. Therefore, λm equals 3.8934 mm in this case, so that the spacing between the first conductive member 110 and the second conductive member 120 may be set to less than a half of 3.8934 mm. So long as the first conductive member 110 and the second conductive member 120 realize such a narrow spacing while being disposed opposite from each other, the first conductive member 110 and the second conductive member 120 do not need to be strictly parallel. Moreover, when the spacing between the first conductive member 110 and the second conductive member 120 is less than λm/2, a whole or a part of the first conductive member 110 and/or the second conductive member 120 may be shaped as a curved surface. On the other hand, the conductive members 110 and 120 each have a planar shape (i.e., the shape of their region as perpendicularly projected onto the XY plane) and a planar size (i.e., the size of their region as perpendicularly projected onto the XY plane) which may be arbitrarily designed depending on the purpose.

Figure 2B:
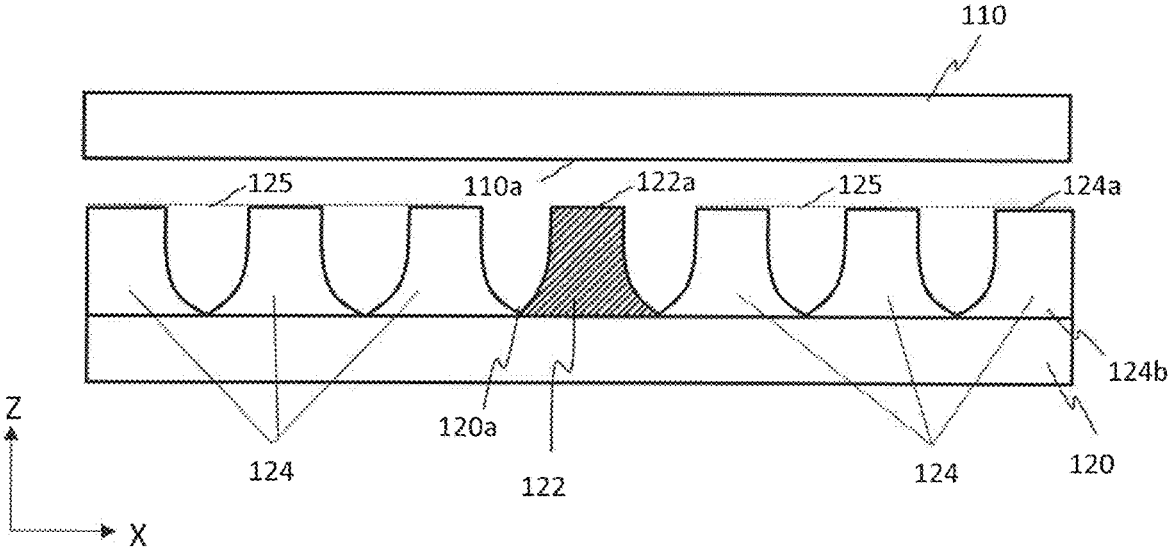
FIG. 2B is a diagram schematically showing another example cross-sectional construction of the waveguide device 100 as taken parallel to the XZ plane.

Although the conductive surface 120*a* is illustrated as a plane in the example shown in FIG. 2A, example embodiments of the present disclosure are not limited thereto. For example, as shown in FIG. 2B, the conductive surface 120*a* may be the bottom parts of faces each of which has a cross section similar to a U-shape or a V-shape. The conductive surface 120*a* will have such a structure when each conductive rod 124 or the waveguide member 122 is shaped with a width which increases toward the root. In this example, the waveguide member 122 and each the plurality of conductive rods 124 have slanted side faces at their root. The tilting angle of the waveguide member 122 and each conductive rod 124 at the top of their side faces is smaller than the tilting angle at their root. Even with such a structure, the device shown in FIG. 2B can function as the waveguide device according to an example embodiment of the present disclosure so long as the distance between the conductive surface 110*a* and the conductive surface 120*a* is less than a half of the wavelength λm.

(3) Distance L2 from the Leading End of the Conductive Rod to the Conductive Surface The distance L2 from the leading end 124*a* of each conductive rod 124 to the conductive surface 110*a* is set to less than λm/2. When the distance is λm/2 or more, a propagation mode where electromagnetic waves reciprocate between the leading end 124*a* of each conductive rod 124 and the conductive surface 110*a* may occur, thus no longer being able to contain an electromagnetic wave. Note that, among the plurality of conductive rods 124, at least those which are adjacent to the waveguide member 122 do not have their leading ends in electrical contact with the conductive surface 110*a*. As used herein, the leading end of a conductive rod not being in electrical contact with the conductive surface means either of the following states: there being an air gap between the leading end and the conductive surface; or the leading end of the conductive rod and the conductive surface adjoining each other via an insulating layer which may exist in the leading end of the conductive rod or in the conductive surface.

(4) Arrangement and Shape of Conductive Rods

The interspace between two adjacent conductive rods 124 among the plurality of conductive rods 124 has a width of less than λm/2, for example. The width of the interspace between any two adjacent conductive rods 124 is defined by the shortest distance from the surface (side face) of one of the two conductive rods 124 to the surface (side face) of the other. This width of the interspace between rods is to be determined so that resonance of the lowest order will not occur in the regions between rods. The conditions under which resonance will occur are determined based by a combination of: the height of the conductive rods 124; the distance between any two adjacent conductive rods; and the capacitance of the air gap between the leading end 124*a* of each conductive rod 124 and the conductive surface 110*a*. Therefore, the width of the interspace between rods may be appropriately determined depending on other design parameters. Although there is no clear lower limit to the width of the interspace between rods, for manufacturing ease, it may be e.g. λm/16 or more when an electromagnetic wave in the extremely high frequency range is to be propagated. Note that the interspace does not need to have a constant width. So long as it remains less than λm/2, the interspace between conductive rods 124 may vary.

The arrangement of the plurality of conductive rods 124 is not limited to the illustrated example, so long as it exhibits a function of an artificial magnetic conductor. The plurality of conductive rods 124 do not need to be arranged in orthogonal rows and columns; the rows and columns may be intersecting at angles other than 90 degrees. The plurality of conductive rods 124 do not need to form a linear array along rows or columns, but may be in a dispersed arrangement which does not present any straight-forward regularity. The conductive rods 124 may also vary in shape and size depending on the position on the second conductive member 120.

The surface 125 of the artificial magnetic conductor that are constituted by the leading ends 124*a* of the plurality of conductive rods 124 does not need to be a strict plane, but may be a plane with minute rises and falls, or even a curved surface. In other words, the conductive rods 124 do not need to be of uniform height, but rather the conductive rods 124 may be diverse so long as the array of conductive rods 124 is able to function as an artificial magnetic conductor.

Each conductive rod 124 does not need to have a prismatic shape as shown in the figure, but may have a cylindrical shape, for example. Furthermore, each conductive rod 124 does not need to have a simple columnar shape. The artificial magnetic conductor may also be realized by any structure other than an array of conductive rods 124, and various artificial magnetic conductors are applicable to the waveguide device of the present disclosure. Note that, when the leading end 124*a* of each conductive rod 124 has a prismatic shape, its diagonal length is preferably less than λm/2. When the leading end 124*a* of each conductive rod 124 is shaped as an ellipse, the length of its major axis is preferably less than λm/2. Even when the leading end 124*a* has any other shape, the dimension across it is preferably less than λm/2 even at the longest position.

The height of each conductive rod 124 (in particular, those conductive rods 124 which are adjacent to the waveguide member 122), i.e., the length from the root 124*b* to the leading end 124*a*, may be set to a value which is shorter than the distance (i.e., less than λm/2) between the conductive surface 110*a* and the conductive surface 120*a*, e.g., λo/4.

(5) Width of the Waveguide Face

The width of the waveguide face 122*a* of the waveguide member 122, i.e., the size of the waveguide face 122*a* along a direction which is orthogonal to the direction that the waveguide member 122 extends, may be set to less than λm/2 (e.g. λo/8). If the width of the waveguide face 122*a* is λm/2 or more, resonance will occur along the width direction, which will prevent any WRG from operating as a simple transmission line.

(6) Height of the Waveguide Member

The height (i.e., the size along the Z direction in the example shown in the figure) of the waveguide member 122 is set to less than λm/2. The reason is that, if the distance is λm/2 or more, the distance between the root 124*b* of each conductive rod 124 and the conductive surface 110*a* will be λm/2 or more. Similarly, the height of each conductive rod 124 (in particular, those conductive rods 124 which are adjacent to the waveguide member 122) is also set to less than λm/2.

(7) Distance L1 Between the Waveguide Face and the Conductive Surface

The distance L1 between the waveguide face 122*a* of the waveguide member 122 and the conductive surface 110*a* is set to less than λm/2. If the distance is λm/2 or more, resonance will occur between the waveguide face 122*a* and the conductive surface 110*a*, which will prevent functionality as a waveguide. In one example, the distance is λm/4 or less. In order to ensure manufacturing ease, when an electromagnetic wave in the extremely high frequency range is to propagate, the distance is preferably λm/16 or more, for example.

The lower limit of the distance L1 between the conductive surface 110*a* and the waveguide face 122*a* and the lower limit of the distance L2 between the conductive surface 110*a* and the leading end 124*a* of each conductive rod 124 depends on the machining precision, and also on the precision when assembling the two up-per/lower conductive members 110 and 120 so as to be apart by a constant distance. When a pressing technique or an injection technique is used, the practical lower limit of the aforementioned distance is about 50 micrometers (μm). In the case of using an MEMS (Micro-Electro-Mechanical System) to make a product in e.g. the terahertz range, the lower limit of the aforementioned distance is about 2 to about 3 μm.

Next, variants of waveguide structures including the waveguide member 122, the conductive members 110 and 120, and the plurality of conductive rods 124 will be described. The following variants are applicable to the WRG structure in any place in each example embodiment described below.

Figure 5A:
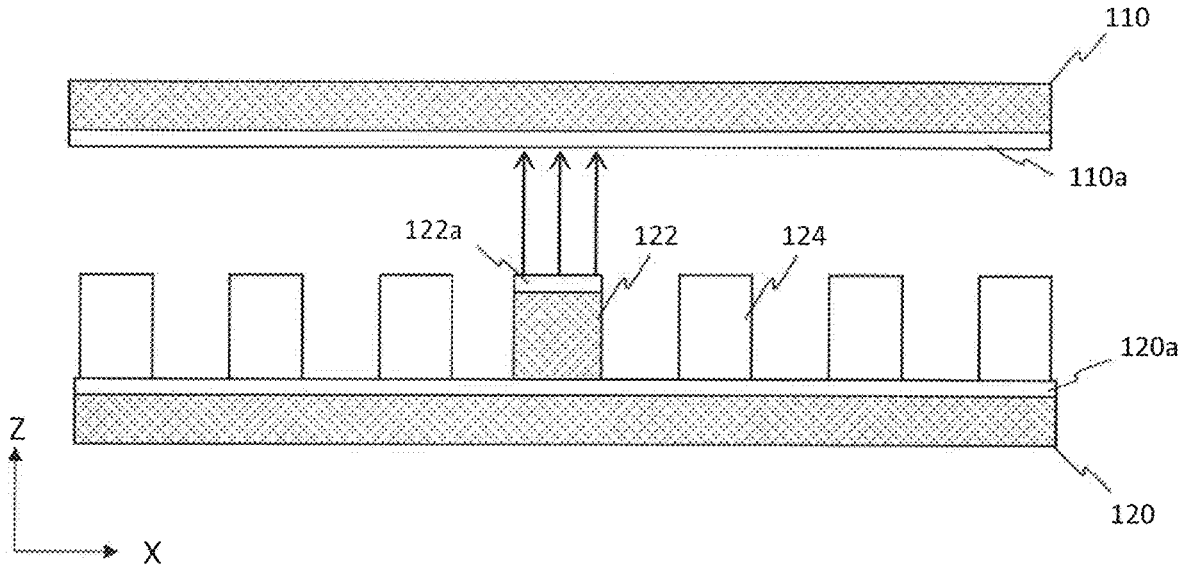
FIG. 5A is a cross-sectional view showing an example structure in which only a waveguide surface 122*a*, defining an upper surface of the waveguide member 122, is electrically conductive, while any portion of the waveguide member 122 other than the waveguide surface 122*a* is not electrically conductive.

FIG. 5A is a cross-sectional view showing an exemplary structure in which only the waveguide face 122*a*, defining an upper face of the waveguide member 122, is electrically conductive, while any portion of the waveguide member 122 other than the waveguide face 122*a* is not electrically conductive. Both of the conductive member 110 and the conductive member 120 alike are only electrically conductive at their surface that has the waveguide member 122 provided thereon (i.e., the conductive surface 110*a*, 120*a*), while not being electrically conductive in any other portions. Thus, each of the waveguide member 122, the conductive member 110, and the conductive member 120 does not need to be electrically conductive.

Figure 5B:
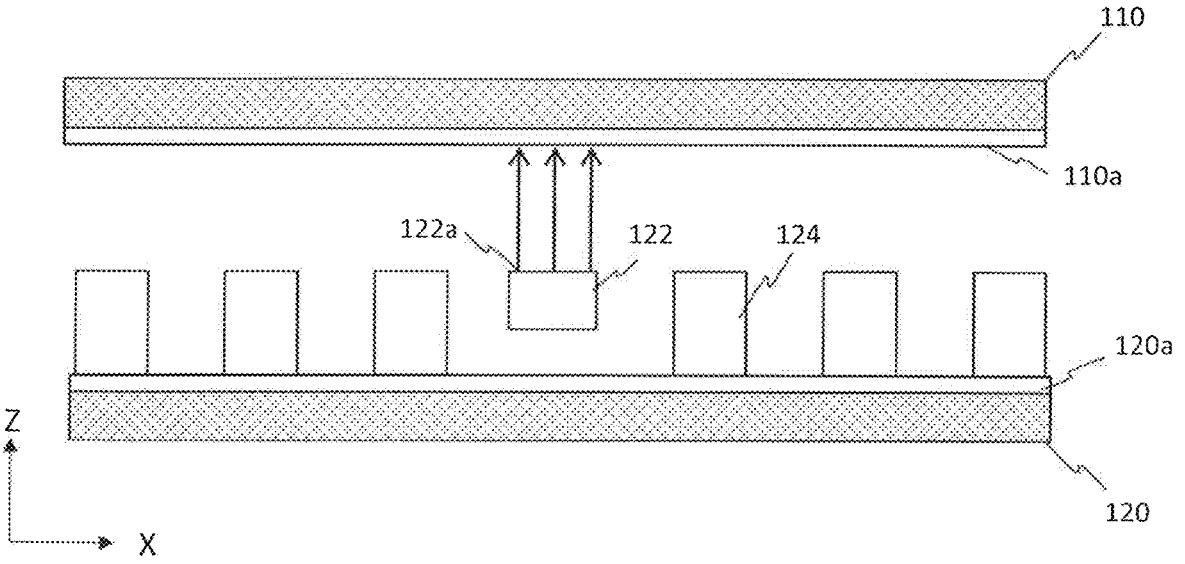
FIG. 5B is a diagram showing a variant in which the waveguide member 122 is not formed on the conductive member 120.

FIG. 5B is a diagram showing a variant in which the waveguide member 122 is not formed on the conductive member 120. In this example, the waveguide member 122 is fixed to a supporting member (e.g., the inner wall of the housing) that supports the conductive members 110 and 120. A gap exists between the waveguide member 122 and the conductive member 120. Thus, the waveguide member 122 does not need to be connected to the conductive member 120.

Figure 5C:
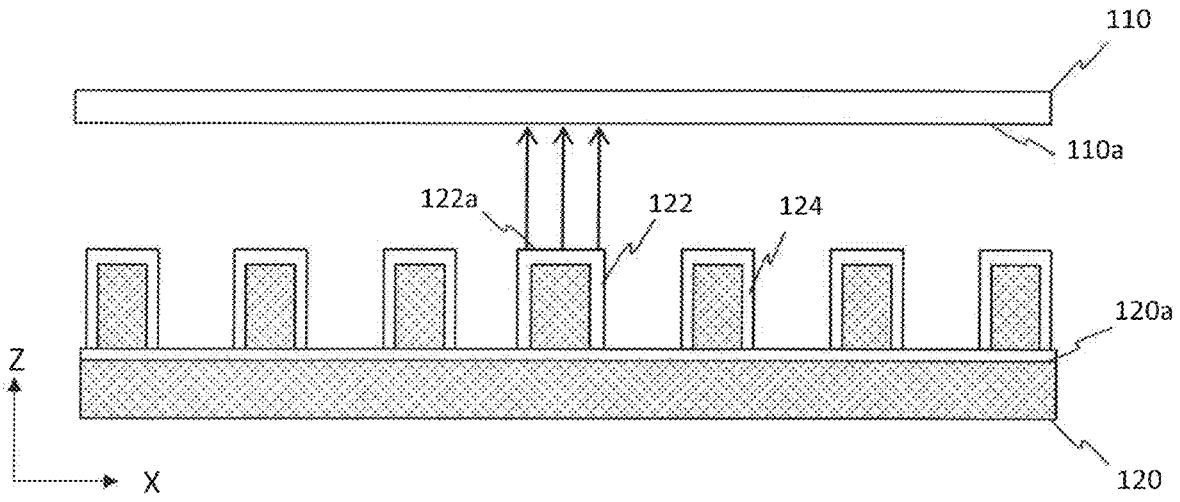
FIG. 5C is a diagram showing an exemplary structure where the conductive member 120, the waveguide member 122, and each of the plurality of conductive rods 124 are composed of a dielectric surface that is coated with an electrically conductive material such as a metal.

FIG. 5C is a diagram showing an exemplary structure where the conductive member 120, the waveguide member 122, and each of the plurality of conductive rods 124 are composed of a dielectric surface that is coated with an electrically conductive material such as a metal. The conductive member 120, the waveguide member 122, and the plurality of conductive rods 124 are connected to one another via the electrical conductor. On the other hand, the conductive member 110 is made of an electrically conductive material such as a metal.

Figure 5D:
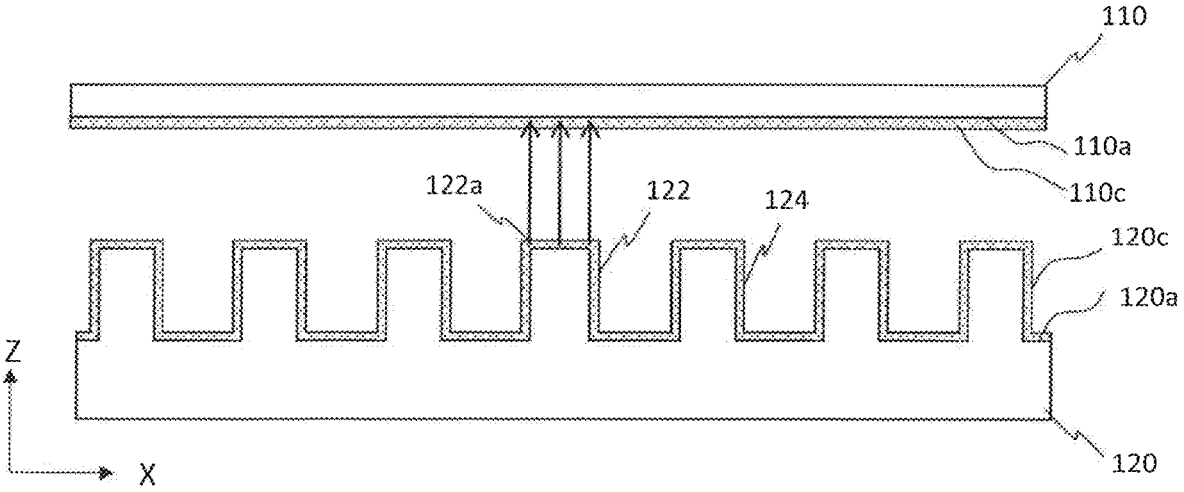
FIG. 5D is a diagram showing an example structure in which dielectric layers 110*c* and 120*c* are respectively provided on the outermost surfaces of the conductive members 110 and 120, the waveguide member 122, and the conductive rods 124.
Figure 5E:
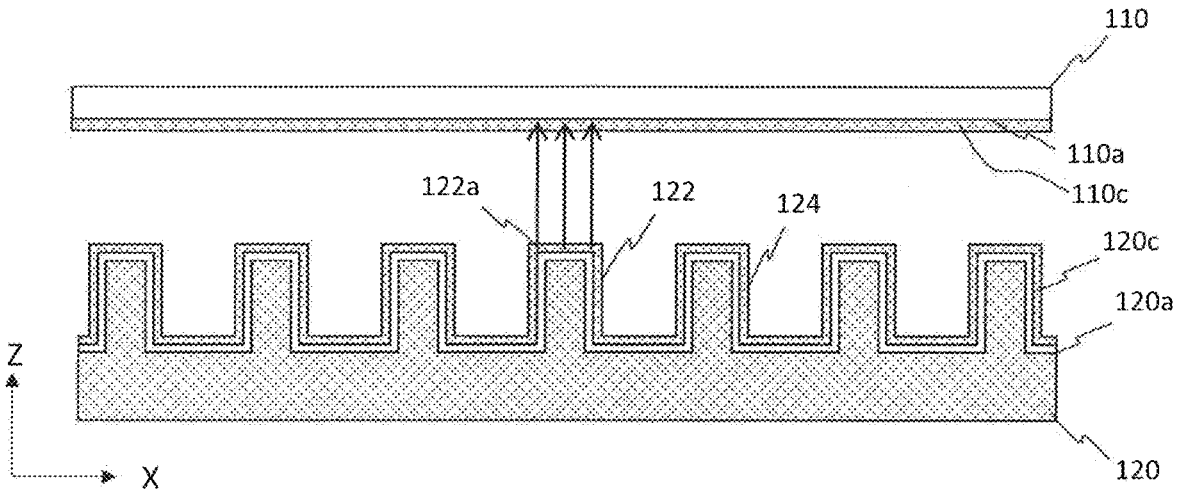
FIG. 5E is a diagram showing another exemplary structure in which dielectric layers 110*c* and 120*c* are respectively provided on the outermost surfaces of the conductive members 110 and 120, the waveguide member 122, and the conductive rods 124.

FIG. 5D and FIG. 5E are diagrams each showing an exemplary structure in which dielectric layers 110*c* and 120*c* are respectively provided on the outermost surfaces of conductive members 110 and 120, a waveguide member 122, and conductive rods 124. FIG. 5D shows an exemplary structure in which the surface of metal conductive members, which are electrical conductors, are covered with a dielectric layer. FIG. 5E shows an example where the conductive member 120 is structured so that the surface of members which are composed of a dielectric, e.g., resin, is covered with an electrical conductor such as a metal, this metal layer being further coated with a dielectric layer. The dielectric layer that covers the metal surface may be a coating of resin or the like, or an oxide film of passivation coating or the like which is generated as the metal becomes oxidized.

The dielectric layer on the outermost surface will allow losses to be increased in the electromagnetic wave propagating through the WRG waveguide, but is able to protect the conductive surfaces 110*a* and 120*a* (which are electrically conductive) from corrosion. It also prevents influences of a DC voltage, or an AC voltage of such a low frequency that it is not capable of propagation on certain WRG waveguides.

Figure 5F:
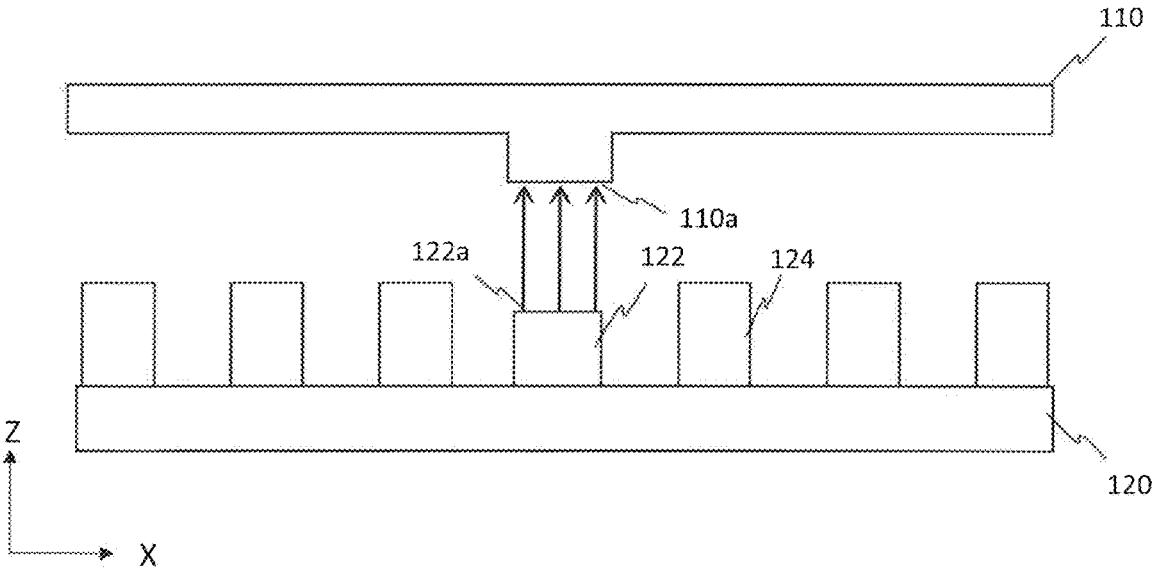
FIG. 5F is a diagram showing an example where the height of the waveguide member 122 is lower than the height of the conductive rods 124, and a portion of a conductive surface 110*a* of the conductive member 110 that is opposed to the waveguide surface 122*a* protrudes toward the waveguide member 122.

FIG. 5F is a diagram showing an example where the height of the waveguide member 122 is lower than the height of the conductive rods 124, and the portion of the conductive surface 110*a* of the conductive member 110 that is opposed to the waveguide face 122*a* protrudes toward the waveguide member 122. Even such a structure will operate in a similar manner to the above-described construction, so long as the ranges of dimensions depicted in FIG. 4 are satisfied.

Figure 5G:
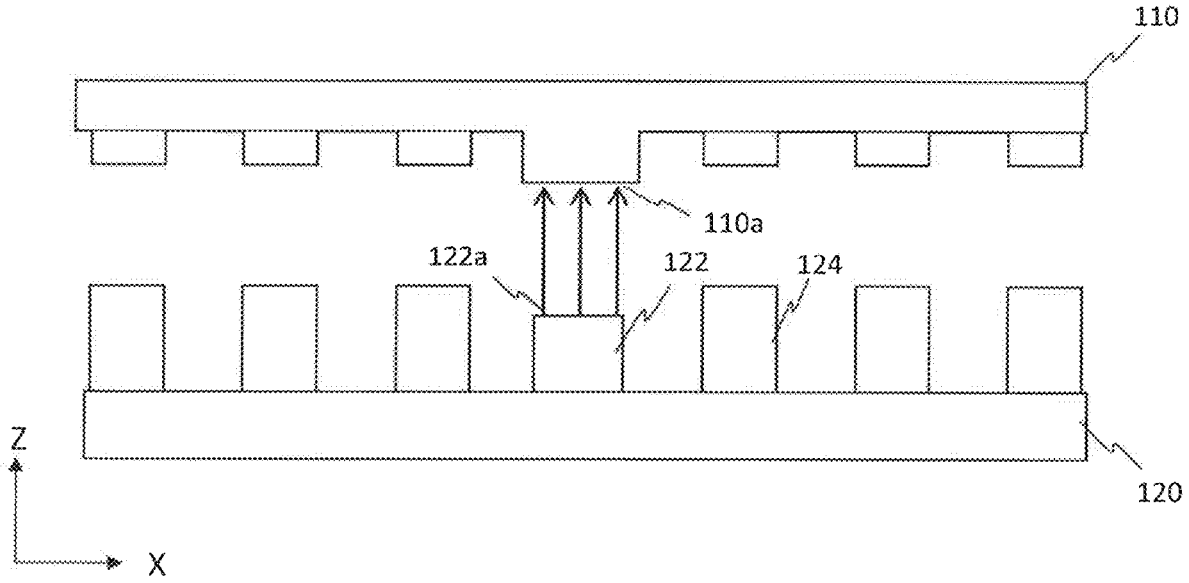
FIG. 5G is a diagram showing an example where, further in the structure of FIG. 5F, portions of the conductive surface 110*a* that oppose the conductive rods 124 protrude toward the conductive rods 124.

FIG. 5G is a diagram showing an example where, further in the structure of FIG. 5F, portions of the conductive surface 110*a* that oppose the conductive rods 124 protrude toward the conductive rods 124. Even such a structure will operate in a similar manner to the above-described example, so long as the ranges of dimensions depicted in FIG. 4 are satisfied. Instead of a structure in which the conductive surface 110*a* partially protrudes, a structure in which the conductive surface 110*a* is partially dented may be adopted.

Figure 6A:
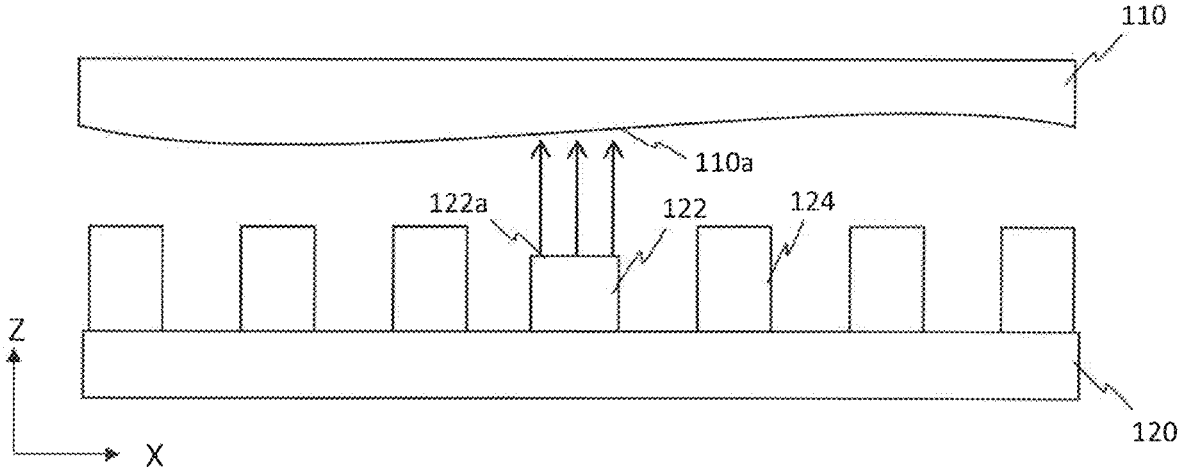
FIG. 6A is a diagram showing an example where a conductive surface 110*a* of the conductive member 110 is shaped as a curved surface.
Figure 6B:
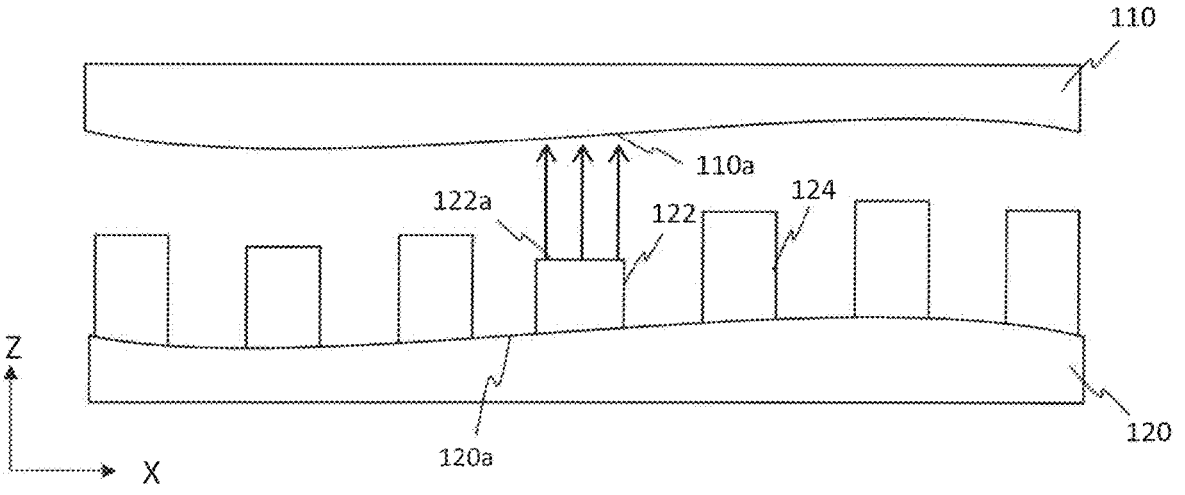
FIG. 6B is a diagram showing an example where also a conductive surface 120*a* of the conductive member 120 is shaped as a curved surface.

FIG. 6A is a diagram showing an example where a conductive surface 110*a* of the conductive member 110 is shaped as a curved surface. FIG. 6B is a diagram showing an example where also a conductive surface 120*a* of the conductive member 120 is shaped as a curved surface. As demonstrated by these examples, the conductive surfaces 110*a* and 120*a* may not be shaped as planes, but may be shaped as curved surfaces. A conductive member having a conductive surface which is a curved surface is also qualifies as a conductive member having a "plate shape".

In the waveguide device 100 of the above-described construction, a signal wave of the operating frequency is unable to propagate in the space between the surface 125 of the artificial magnetic conductor and the conductive surface 110*a* of the conductive member 110, but propagates in the space between the waveguide face 122*a* of the waveguide member 122 and the conductive surface 110*a* of the conductive member 110. Unlike in a hollow waveguide, the width of the waveguide member 122 in such a waveguide structure does not need to be equal to or greater than a half of the wavelength of the electromagnetic wave to propagate. Moreover, the conductive member 110 and the conductive member 120 do not need to be electrically interconnected by a metal wall that extends along the thickness direction (i.e., in parallel to the YZ plane).

Figure 7A:
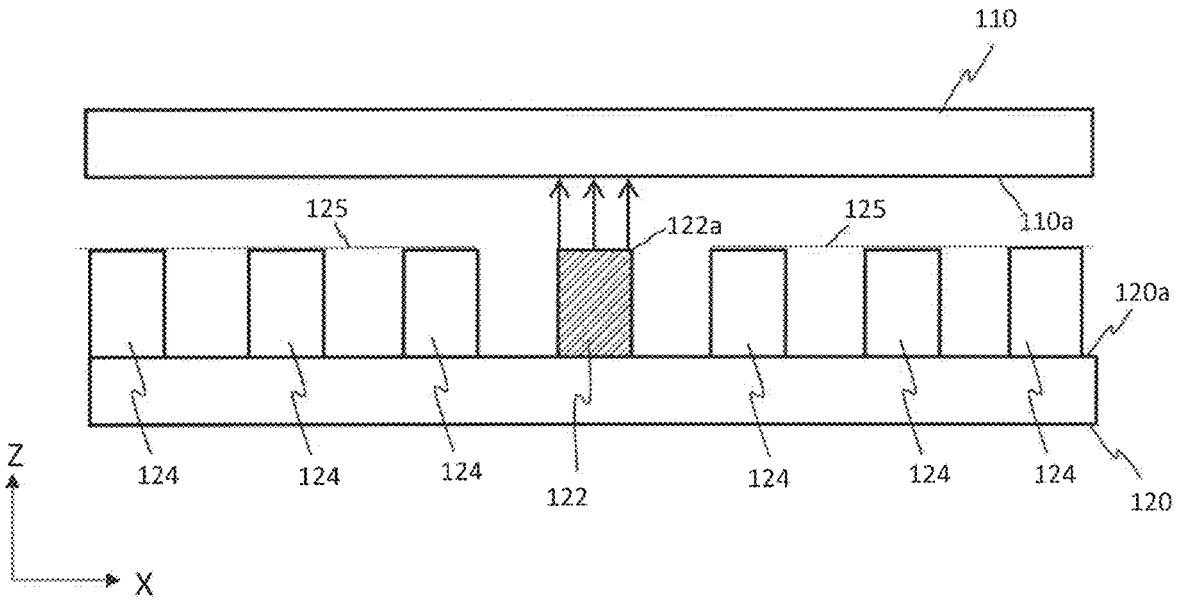
FIG. 7A is a diagram schematically showing an electromagnetic wave that propagates in a narrow space, i.e., a gap between the waveguide surface 122*a* of the waveguide member 122 and the conductive surface 110*a* of the conductive member 110.

FIG. 7A schematically shows an electromagnetic wave that propagates in a narrow space, i.e., a gap between the waveguide face 122*a* of the waveguide member 122 and the conductive surface 110*a* of the conductive member 110. Three arrows in FIG. 7A schematically indicate the orientation of an electric field of the propagating electromagnetic wave. The electric field of the propagating electromagnetic wave is perpendicular to the conductive surface 110*a* of the conductive member 110 and to the waveguide face 122*a*.

On both sides of the waveguide member 122, stretches of artificial magnetic conductor that are created by the plurality of conductive rods 124 are present. An electromagnetic wave propagates in the gap between the waveguide face 122*a* of the waveguide member 122 and the conductive surface 110*a* of the conductive member 110. FIG. 7A is schematic, and does not accurately represent the magnitude of an electromagnetic field to be actually created by the electromagnetic wave. A part of the electromagnetic wave (electromagnetic field) propagating in the space over the waveguide face 122*a* may have a lateral expanse, to the outside (i.e., toward where the artificial magnetic conductor exists) of the space that is delineated by the width of the waveguide face 122*a*. In this example, the electromagnetic wave propagates in a direction (i.e., the Y direction) which is perpendicular to the plane of FIG. 7A. As such, the waveguide member 122 does not need to extend linearly along the Y direction, but may include a bend(s) and/or a branching portion(s) not shown. Since the electromagnetic wave propagates along the waveguide face 122*a* of the waveguide member 122, the direction of propagation would change at a bend, whereas the direction of propagation would ramify into plural directions at a branching portion.

In the waveguide structure of FIG. 7A, no metal wall (electric wall), which would be indispensable to a hollow waveguide, exists on both sides of the propagating electromagnetic wave. Therefore, in the waveguide structure of this example, "a constraint due to a metal wall (electric wall)" is not included in the boundary conditions for the electromagnetic field mode to be created by the propagating electromagnetic wave, and the width (size along the X direction) of the waveguide face 122*a* is less than a half of the wavelength of the electromagnetic wave.

Figure 7B:
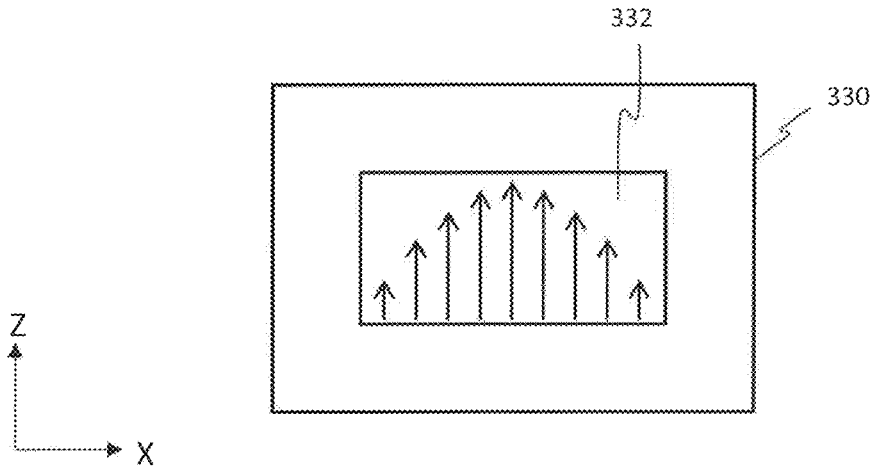
FIG. 7B is a diagram schematically showing a cross section of a hollow waveguide 330.

For reference, FIG. 7B schematically shows a cross section of a hollow waveguide 330. With arrows, FIG. 7B schematically shows the orientation of an electric field of an electromagnetic field mode ($TE_{10}$) that is created in the internal space 332 of the hollow waveguide 330. The lengths of the arrows correspond to electric field intensities. The width of the internal space 332 of the hollow waveguide 330 needs to be set to be broader than a half of the wavelength. In other words, the width of the internal space 332 of the hollow waveguide 330 cannot be set to be smaller than a half of the wavelength of the propagating electromagnetic wave.

Figure 7C:
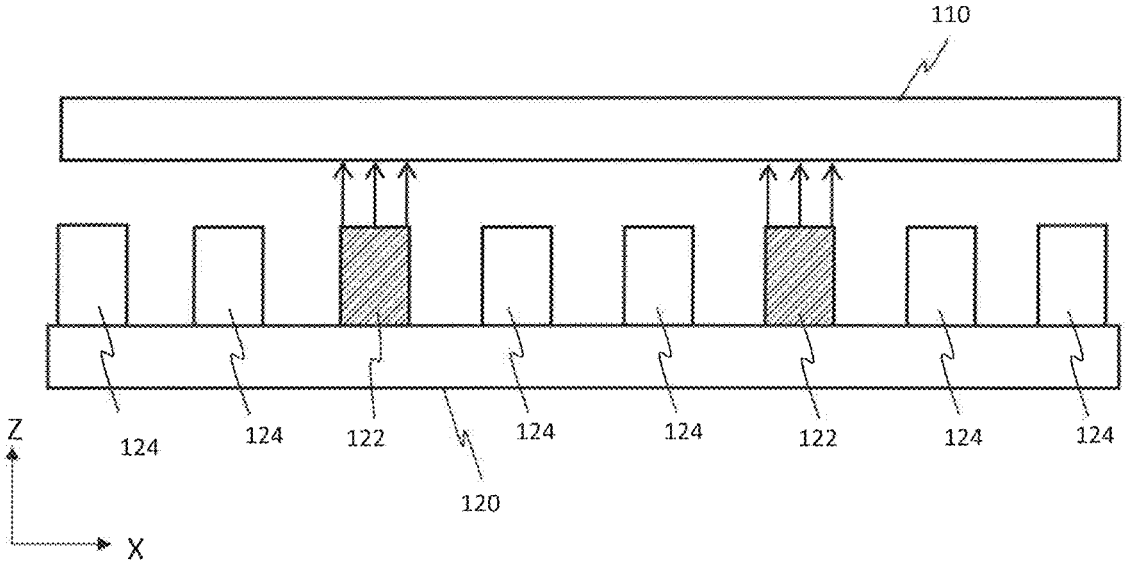
FIG. 7C is a cross-sectional view showing an implementation where two waveguide members 122 are provided on the conductive member 120.

FIG. 7C is a cross-sectional view showing an implementation where two waveguide members 122 are provided on the conductive member 120. Thus, an artificial magnetic conductor that is created by the plurality of conductive rods 124 exists between the two adjacent waveguide members 122. More accurately, stretches of artificial magnetic conductor created by the plurality of conductive rods 124 are present on both sides of each waveguide member 122, such that each waveguide member 122 is able to independently propagate an electromagnetic wave.

Figure 7D:
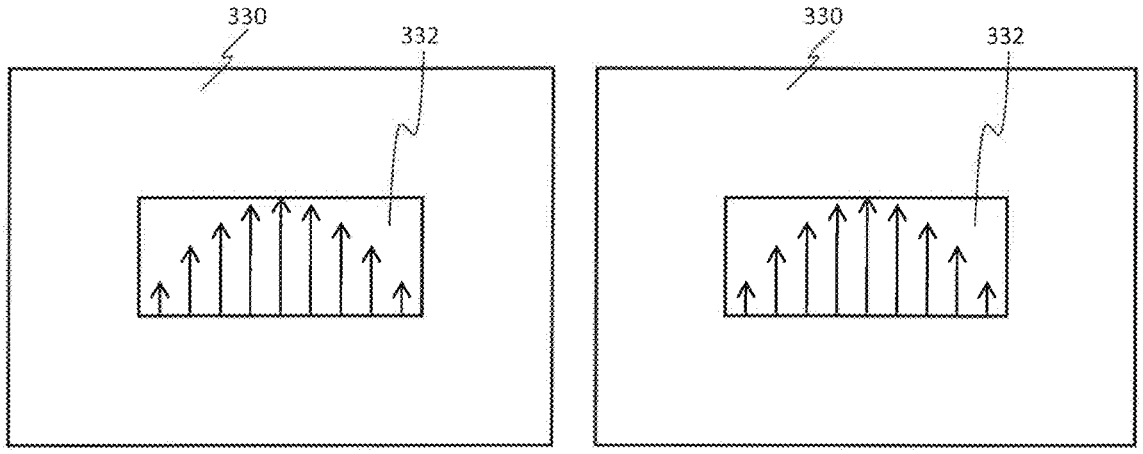
FIG. 7D is a diagram schematically showing a cross section of a waveguide device in which two hollow waveguides 330 are placed side-by-side.

For reference's sake, FIG. 7D schematically shows a cross section of a waveguide device in which two hollow waveguides 330 are placed side-by-side. The two hollow waveguides 330 are electrically insulated from each other. Each space in which an electromagnetic wave is to propagate needs to be surrounded by a metal wall that defines the respective hollow waveguide 330. Therefore, the interval between the internal spaces 332 in which electromagnetic waves are to propagate cannot be made smaller than a total of the thicknesses of two metal walls. Usually, a total of the thicknesses of two metal walls is longer than a half of the wavelength of a propagating electromagnetic wave. Therefore, it is difficult for the interval between the hollow waveguides 330 (i.e., interval between their centers) to be shorter than the wavelength of a propagating electromagnetic wave. Particularly for electromagnetic waves of wavelengths in the extremely high frequency range (i.e., electromagnetic wave wavelength: 10 mm or less) or even shorter wavelengths, a metal wall which is sufficiently thin relative to the wavelength is difficult to be formed. This presents a cost problem in commercially practical implementation.

On the other hand, a waveguide device 100 including an artificial magnetic conductor can easily realize a structure in which waveguide members 122 are placed close to one another. Thus, such a waveguide device 100 can be suitably used in an array antenna that includes plural antenna elements in a close arrangement.

Next, an exemplary construction for a slot antenna utilizing the aforementioned waveguide structure will be described. A "slot antenna" means an antenna device having one or plural slots (also referred to as "throughholes") as antenna elements. In particular, a slot antenna having a plurality of slots as antenna elements will be referred to as a "slot array antenna" or a "slot antenna array".

Figure 8A:
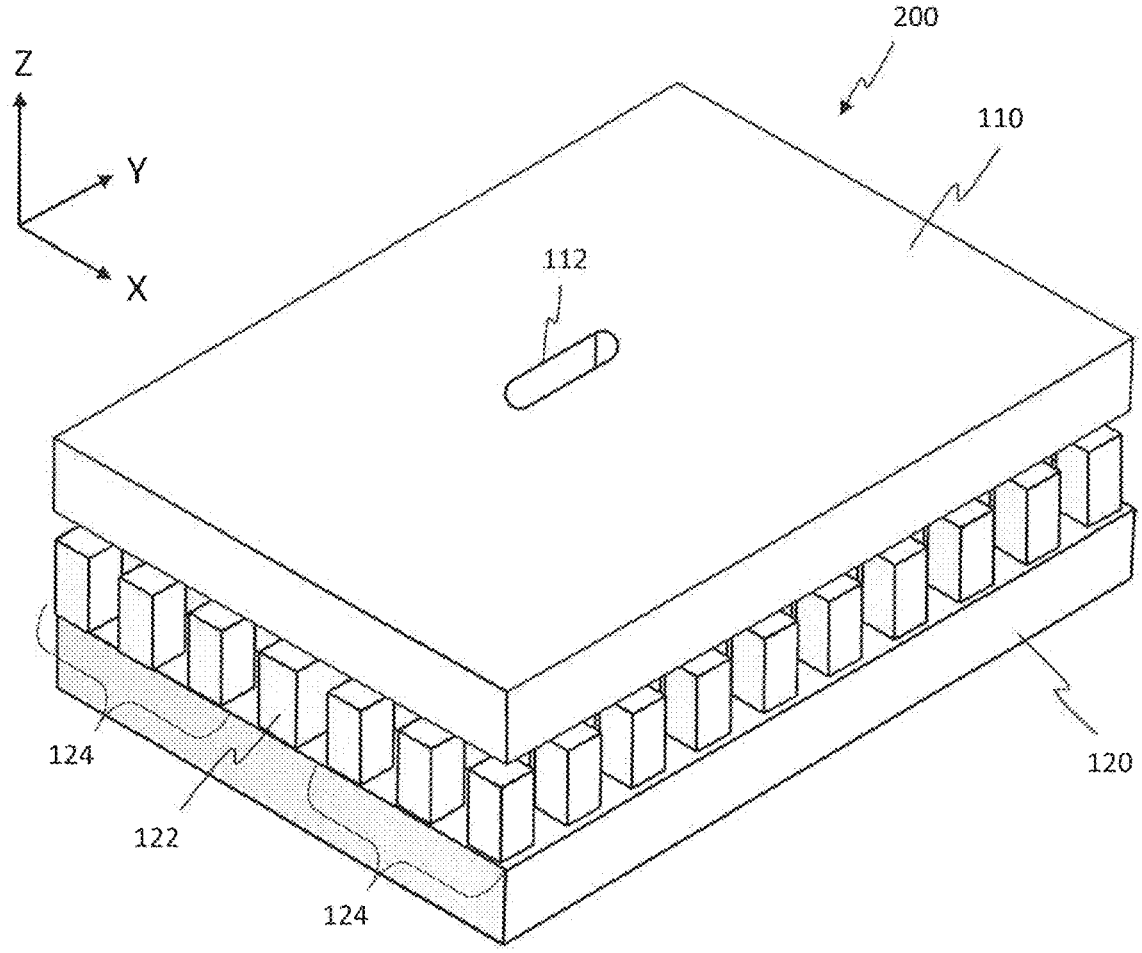
FIG. 8A is a perspective view schematically showing the construction of a slot antenna 200.
Figure 8B:
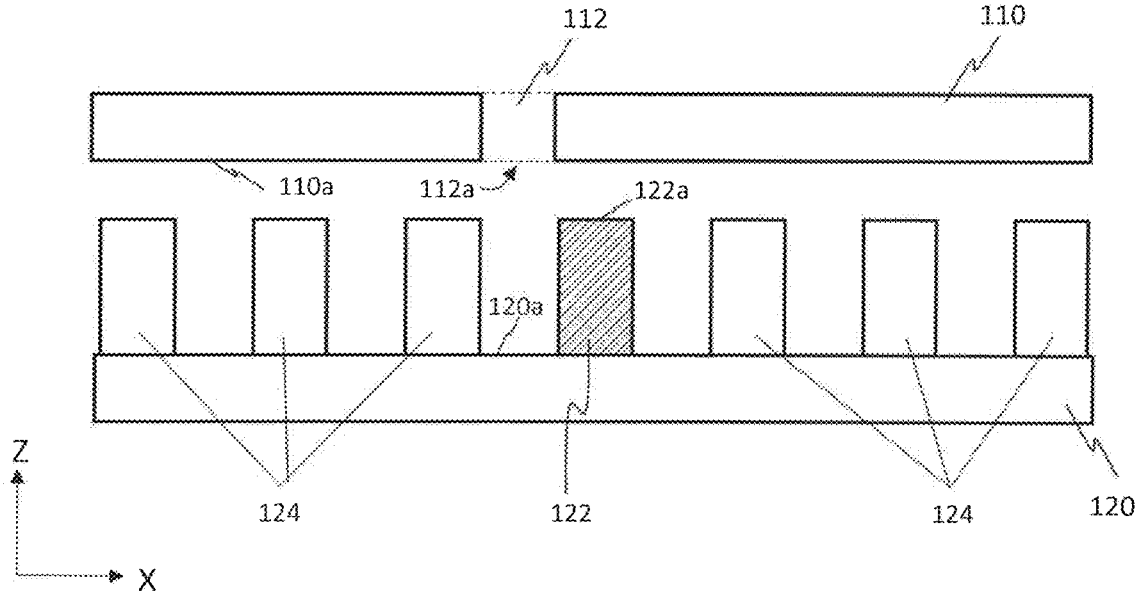
FIG. 8B is a diagram schematically showing a partial cross section which passes through the center of a slot 112 of the slot antenna 200 shown in FIG. 8A, the cross section being taken parallel to the XZ plane.

FIG. 8A is a perspective view showing an exemplary slot antenna 200 which is capable of radiating an example of a polarized wave whose electric field oscillates along the X direction. FIG. 8B is a diagram schematically showing a partial cross section which passes through the center of a slot 112 of the slot antenna 200 shown in FIG. 8A, the cross section being taken parallel to the XZ plane. The slot 112 of the slot antenna 200 is shaped so that its length direction coincides with the Y direction, and the position of its center along the X direction differs from the position of the center of the waveguide member 122 along the X direction. For simplicity, a construction in the case where the first conductive member 110 has one slot 112 will be described. As will be described later, a slot array antenna can be realized by providing two or more slots 112.

The slot antenna 200 includes a first conductive member 110, a second conductive member 120, a waveguide member 122, and an artificial magnetic conductor (which in this example includes a plurality of conductive rods 124). The first conductive member 110 has a first conductive surface 110*a* which is shaped as a plane or a curved surface. The first conductive member 110 has the slot 112. The second conductive member 120 has a second conductive surface 120*a* opposing the first conductive surface 110*a*. The waveguide member 122 has a stripe-shaped electrically-conductive waveguide face 122*a* opposing the first conductive surface 110*a* of the first conductive member 110. In the present specification, a "stripe shape" means a shape which is defined by a single stripe, rather than a shape constituted by stripes. Not only shapes that extend linearly in one direction, but also any shape that bends or branches along the way is also encompassed by a "stripe shape". A "stripe shape" may also be referred to as a "strip shape".

Between the first conductive member 110 and the second conductive member 120, the artificial magnetic conductor is at least disposed on both sides of the waveguide member 122. Adjacent to the waveguide member 122, plural conductive rods 124 functioning as the artificial magnetic conductor are disposed on both side of the waveguide member 122.

The slot antenna 200 is used for at least one of transmission and reception of electromagnetic waves of a predetermined band. Assuming that, among the electromagnetic waves of the predetermined band, an electromagnetic wave of the highest frequency has a wavelength λm in free space, the width of the waveguide member 122, the width of each conductive rod 124, the width of a space between two adjacent conductive rods 124, the distance between the first conductive surface 110*a* and the second conductive surface 120*a*, and the width of a space between any conductive rod 124 that is adjacent to the waveguide member 122 and the waveguide member 122 are all less than λm/2.

The slot 112, which is a throughhole made in the first conductive member 110, is a region that is surrounded by an electrically-conductive inner wall surface of the first conductive member 110. As shown in FIG. 8B, the slot 112 has an opening 112*a* that extends through the first conductive member 110 and is open on the first conductive surface 110*a*. The opening 112*a* refers to a portion of the slot 112 that can be regarded as coplanar with the first conductive surface 110*a*. The opening 112*a* of the slot 112 has: a length that is defined by a straight line (line segment) or a curve (including a combination of line segments); and a width, i.e., a dimension along a perpendicular direction to the length direction. Note that a straight line or curve that defines the length of the opening 112*a* is an imaginary straight line or curve connecting between central points on the width of the opening from one end to the other end of the opening, rather than any line or curve that constitutes a part of an edge of the opening 112*a*. In the case of an I-shaped slot 112 that extends like a line as illustrated in the figure, the length of the opening is equal to the length of that line. As will be described later, the slot 112 may also have a shape other than an I shape.

In the example of FIG. 8A, the length of the slot 112 along the Y direction is set to a value which is greater than a half of the central wavelength λo of the signal wave in free space. When this condition is met, an electromagnetic wave of the wavelength λo is able to pass through the slot 112. Having such a slot 112, the slot antenna 200 is able to transmit or receive an electromagnetic wave whose electric field oscillates along a direction (the X direction) which is perpendicular to the direction that the waveguide member 122 extends (the Y direction).

Figure 8C:
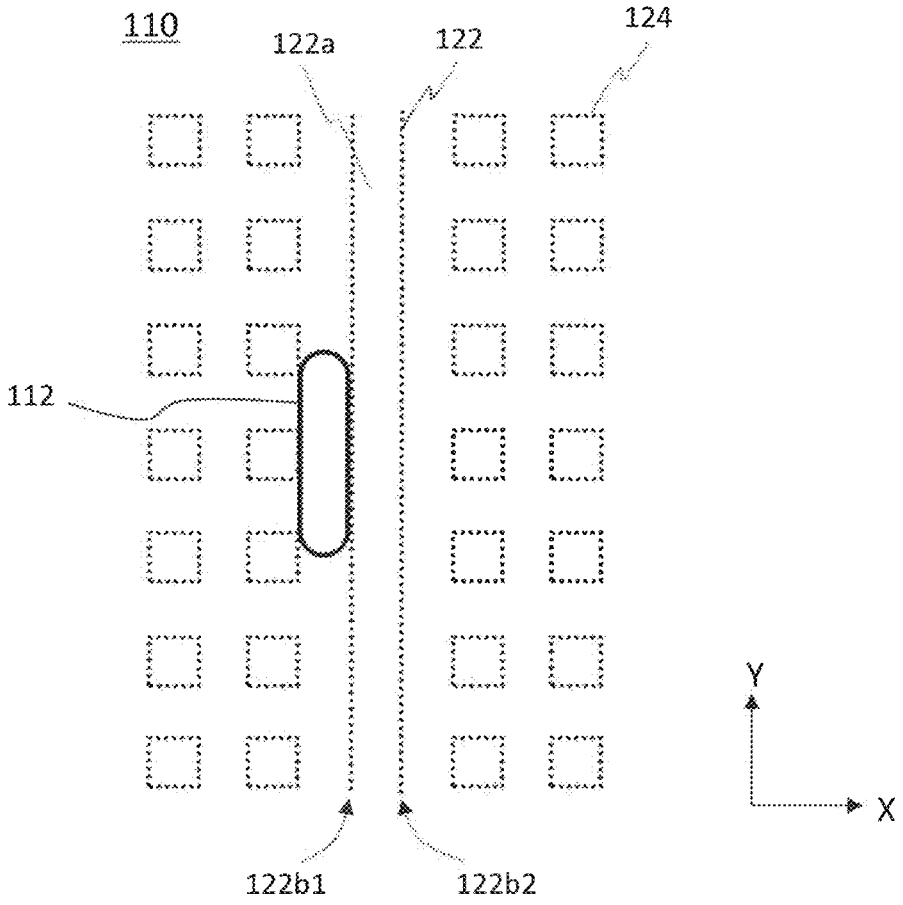
FIG. 8C is an upper plan view showing a relative positioning between the slot 112, the waveguide member 122, and the plurality of conductive rods 124.

FIG. 8C is an upper plan view showing a relative positioning between the slot 112, the waveguide member 122, and the plurality of conductive rods 124. FIG. 8C illustrates the slot 112 as viewed from the normal direction of the conductive surface 110*a* of the first conductive member 110. In FIG. 8C, the waveguide member 122 and the plurality of conductive rods 124 that are on the rear side (i.e., the −Z direction side) of the first conductive member 110 are depicted by dotted lines. The waveguide face 122*a* of the waveguide member 122 has two edges 122*b*1 and 122*b*2 defining the width of the waveguide face 122*a*. In this example, when viewed from the normal direction of the first conductive surface 110*a*, the width direction of the opening of the slot 112 coincides with the width direction of the waveguide face 122*a* (i.e., both being the X direction). On the outside of one edge 122*b*1 of the waveguide face 122*a* (which corresponds to the left-hand side in FIG. 8C), the entire opening of the slot 112 is opposed to the second conductive surface 120*a* of the second conductive member 120. When viewed from the normal direction of the first conductive surface 110*a*, the opening of the slot 112 just lies close to the one edge 122*b*1, without intersecting either of the two edges 122*b*1 and 122*b*2 of the waveguide face 122*a*.

The slot antenna 200 is connected to an electronic circuit not shown (e.g., a millimeter wave integrated circuit). During transmission, an electromagnetic wave (signal wave) is supplied from this electronic circuit to the waveguide extending between the waveguide face 122*a* of the waveguide member 122 and the conductive surface 110*a* of the first conductive member 110.

Figure 8D:
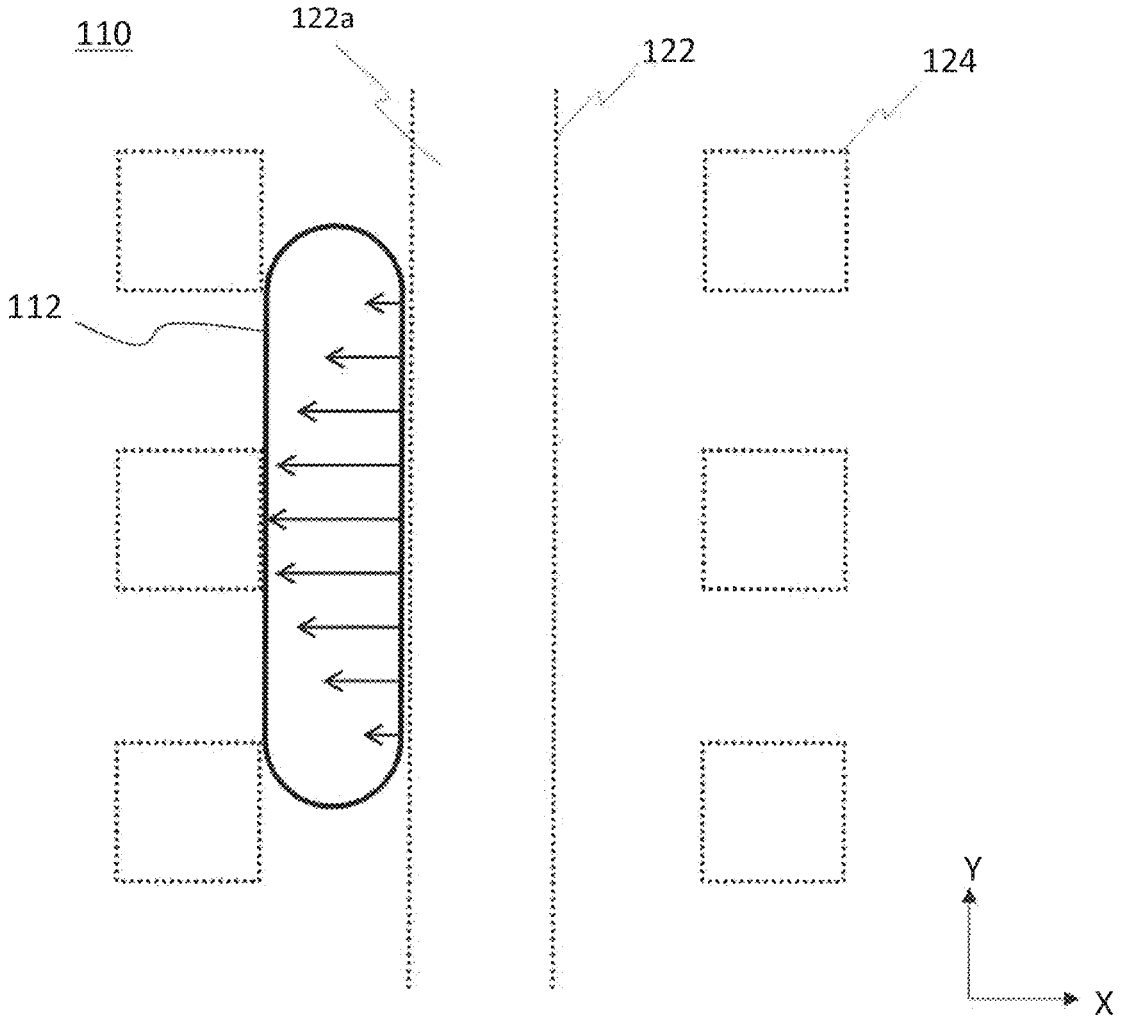
FIG. 8D is a diagram schematically showing an example of an electric field which may be created inside the slot 112.

FIG. 8D is a diagram schematically showing an example of an electric field which may be created inside the slot 112 at a moment during transmission or during reception. Arrows in the figure illustrate the orientation of the electric field, while the length of each arrow corresponds to the intensity of the electric field. The slot 112 has an I shape which is longer along the Y direction than along the X direction, such that the position of the center of the slot 112 along the X direction is located in the −X direction from the position of the center of the waveguide face 122*a*. The oscillation direction of the electric field that is created inside the slot 112 is perpendicular to the inner wall surface of the slot 112, and has an increasing amplitude toward the center. Therefore, near the center of the slot 112, an electric field exists that oscillates along the width direction (the X direction) of the waveguide face 122*a*. In other words, an electromagnetic wave having a strong field component along the X direction can be transmitted or received. Assuming that the X direction is the horizontal direction and that the Y direction is the vertical direction, a polarized wave in the horizontal direction can be transmitted or received.

In this example, the entire opening of the slot 112 is opposed to the second conductive surface 120*a*. Without being limited to such construction, only a portion of the opening of the slot 112 may be opposed to the second conductive surface 120*a*.

Figure 9A:
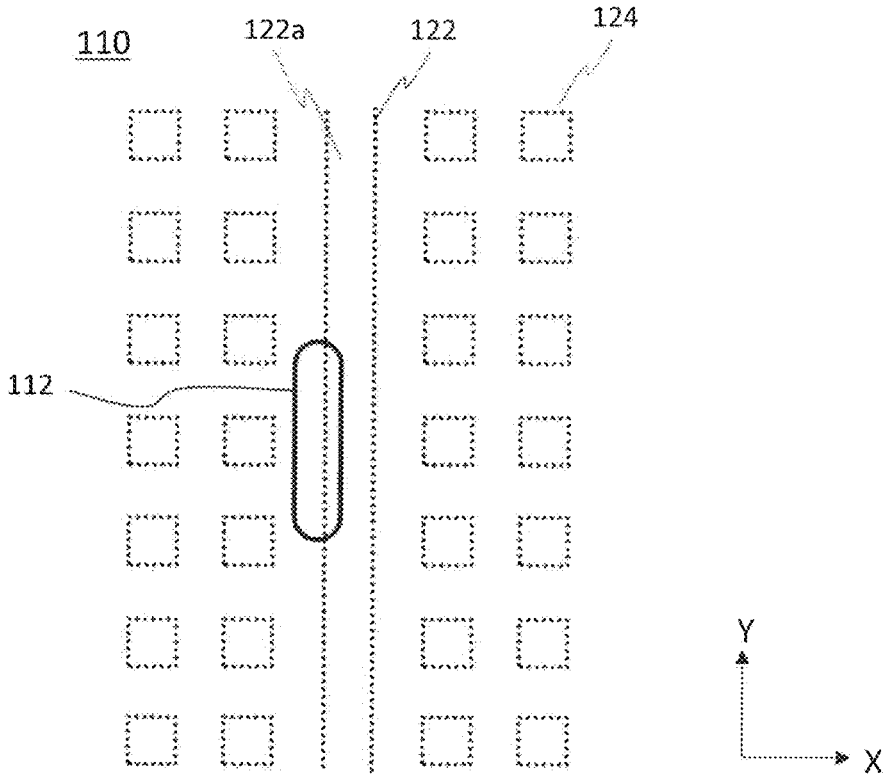
FIG. 9A is an upper plan view showing an example where only a portion of the slot 112 is opposed to the second conductive surface 120*a*.

FIG. 9A is an upper plan view showing an example where only a portion of the slot 112 is opposed to the second conductive surface 120*a*. In this construction, the slot 112 is located more in the +X direction than in FIG. 8C. As a result, a portion of the slot 112 is opposed to the second conductive surface 120*a*, while another portion of the slot 112 is opposed to the waveguide face 122*a*. With such an arrangement of the slot 112, too, an electromagnetic wave whose electric field oscillates along the X direction can be transmitted or received.

Figure 9B:
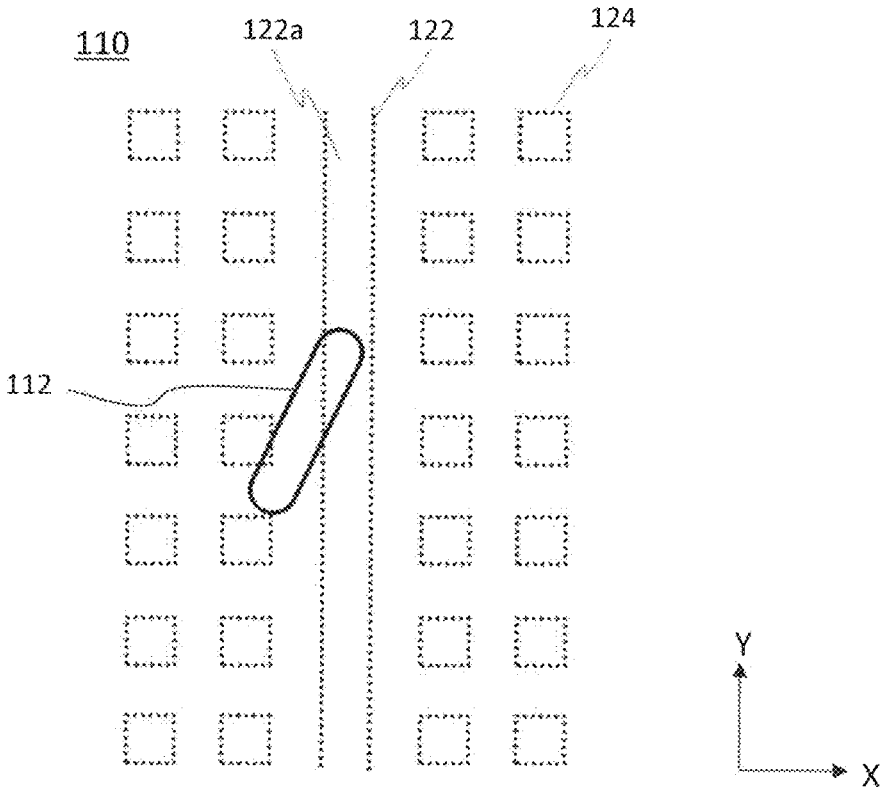
FIG. 9B is an upper plan view showing another example where only a portion of the slot 112 is opposed to the second conductive surface 120*a*.

FIG. 9B is an upper plan view showing another example where only a portion of the slot 112 is opposed to the second conductive surface 120*a*. In this example, in plan view, the length direction of the slot 112 intersects the direction that the waveguide face 122*a* extends (i.e., the Y direction). The angle that is created between the length direction of the slot 112 and the direction that the waveguide face 122*a* extends is smaller than 45 degrees. When viewed from the normal direction of the conductive surface 110*a*, 120*a*, the slot 112 has a portion overlapping the second conductive surface 120*a*, a portion overlapping the waveguide face 122*a*, and a portion overlapping the conductive rod 124. The main direction of an electric field of an electromagnetic wave to be transmitted or received is not the X direction itself but a direction that intersects the width direction (the X direction) of the waveguide face 122*a* at an angle which is smaller than 45 degrees. However, even in this case, it is possible to transmit or receive an electromagnetic wave having a stronger field component along the width direction of the waveguide face 122*a* (the X direction) than along the direction that the waveguide face 122*a* extends (the Y direction).

Thus, when viewed from the normal direction of the first conductive surface 110*a*, the length direction of the slot 112 intersects the direction that the waveguide face 122*a* extends at an angle which is smaller than 45 degrees, and the center of the opening of the slot 112 is located in the X direction of the center line of the waveguide face 122*a*. Such construction enables at least one of transmission and reception of an electromagnetic wave having a greater field component along the X direction than along the Y direction.

Although the above example illustrates that the slot 112 is I-shaped, the slot 112 may have any other shape. According to example embodiments of the present disclosure, the shape and arrangement of the slot may be arbitrary so long as the following requirements (1) to (3) are satisfied.

(1) When viewed from the normal direction of the first conductive surface 110*a*, at least in the central portion of the length direction of the opening, the opening of the slot 112 includes a portion in which the angle made between the width direction of the opening and the width direction of the waveguide face 122*a* is smaller than 45 degrees (referred to as a "small-angle portion").

(2) When viewed from the normal direction of the first conductive surface 110*a*, at least a portion of the small-angle portion overlaps the second conductive surface 120*a* on the outside of one (122*b*1) of the two edges of the waveguide face 122*a*.

(3) When viewed from the normal direction of the first conductive surface 110*a*, the small-angle portion intersects the one 122*b*1 of the two edges of the waveguide face 122*a* but does not intersect the other 122*b*2 of the two edges, or is located, at a shorter distance than the width of the waveguide face 122*a*, from the one 122*b*1 of the two edges.

FIGS. 10A through 10E show some example shapes for the opening of the slot 112 that may be used in the slot antenna 200. In each of these figures, a double-headed arrow represents the length direction of the opening of the slot 112. The length of the double-headed arrow indicates the length of the opening of the slot 112. The opening of the slot 112 in each example has: a length that is defined by a straight line (line segment) or a curve (including a combination of line segments); and a width, i.e., a dimension along a perpendicular direction to the length direction. In the following description, the opening of the slot 112 may simply be referred to as the slot 112. In any of these examples, the length of the slot 112 is set to a value such that higher-order resonance will not occur and that the slot impedance will not be too small. Typically, the length of the slot 112 is set to a value which is greater than $\lambda o/2$ and less than $\lambda o$, where $\lambda o$ is a wavelength in free space of an electromagnetic wave at the center frequency of the operating frequency band of the slot antenna 200.

Figure 10A:
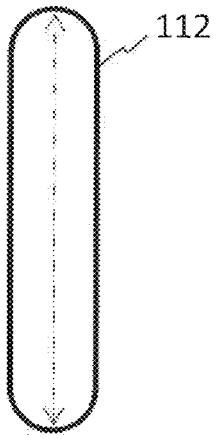
FIG. 10A shows an example of an I-shaped slot 112.

FIG. 10A shows an exemplary of an I-shaped slot 112 that has been described above. In the I-shaped slot 112, a length is defined by a line segment interconnecting both ends of the slot 112. The width direction remains the same wherever along the length direction. Both ends of the slot 112 may be rounded or flat. An I-shaped slot of a shape similar to an ellipse, or a rectangular shape, may also be used. In the case of adopting an I-shaped slot 112, it is to be disposed so that the entire opening of the slot 112 corresponds to the "small-angle portion". That is, the I-shaped slot 112 is disposed so that the angle between the width direction and the width direction of the waveguide face 122*a* is smaller than 45 degrees across the entire opening.

Figure 10B:
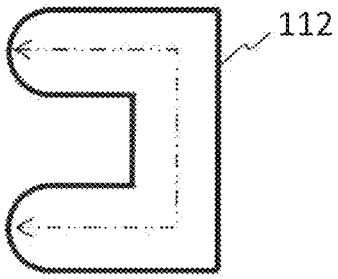
FIG. 10B shows an example of a U-shaped slot 112.

FIG. 10B shows an exemplary slot 112 whose length is defined along a U-shaped curve (which in this example is a combination of three line segments). The slot 112 of this example includes a pair of parallel linear portions and another linear portion connecting the ends thereof. A shape that results by rotating the slot 112 shown in FIG. 10B clockwise by 90 degrees would resemble the alphabetical letter "U". Therefore, such a slot 112 may be referred to as a "U-shaped slot" in the present specification. In the case of adopting a U-shaped slot, it is to be disposed so that a bottom corresponding to the central portion (i.e., the right linear portion in FIG. 10B) corresponds to the "small-angle portion".

Figure 10C:
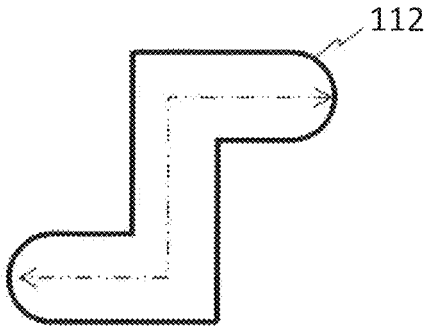
FIG. 10C shows an example of a Z-shaped slot 112.

FIG. 10C shows an exemplary slot 112 whose length is defined along an inverted Z-shaped curve (which in this example is a combination of three line segments). A slot that results by inverting the slot shown in FIG. 10C from right to left, whose length is defined along a Z-shaped curve, may be used. Such a slot 112 may be referred to as a "Z-shaped slot" in the present specification. A Z-shaped slot also includes a pair of parallel linear portions and another linear portion connecting the ends thereof. In the case of adopting a Z-shaped slot, it is to be disposed so that its middle linear portion corresponds to the "small-angle portion".

Figure 10D:
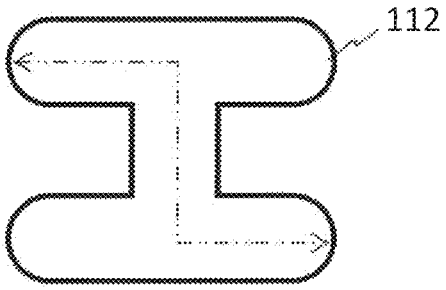
FIG. 10D shows an example of an H-shaped slot 112.

FIG. 10D shows an exemplary slot 112 having a shape resembling the alphabetical letter "H". Such a slot 112 includes a pair of parallel linear portions and another linear portion interconnecting the central portions of the pair of linear portions. Such a slot 112 may be referred to as an "H-shaped slot". The length of an H-shaped slot 112 is defined as a sum of: a half of a sum of the lengths of the pair of parallel linear portions; and the distance between the centers of the pair of linear portions. In the case of adopting an H-shaped slot, it is to be disposed so that its middle linear portion corresponds to the "small-angle portion".

Figure 10E:
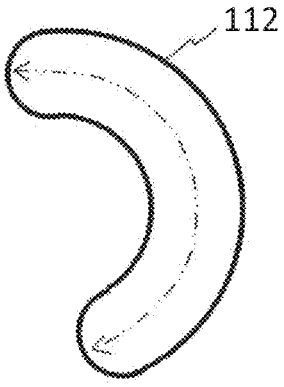
FIG. 10E shows an example of a curve-shaped slot 112.

FIG. 10E shows an exemplary slot 112 whose length is defined by an arc-shaped curve. Alternatively, a slot whose length is defined by any curve other than an arc shape may also be used. Such a slot 112 may be referred to as a "curve-shaped slot". In any curve-shaped slot that does not include a linear portion, its width direction will continuously change from position to position along the length direction. In the case of adopting a curve-shaped slot 112, too, it is to be disposed so that the angle made between the width direction in its central portion and the width direction of the waveguide face 122*a* is smaller than 45 degrees.

Next, with reference to FIGS. 11A through 11E, several examples of relative positioning between the slot 112 and the waveguide face 122*a* will be described. In FIGS. 11A through 11E, the small-angle portion of the opening of the slot 112 is shown hatched. All of FIGS. 11A through 11E are diagrams viewed from the normal direction of the first conductive surface 110*a*. For ease of viewing, elements other than the slot 112 and the waveguide face 122*a* are omitted from illustration.

Figure 11A:
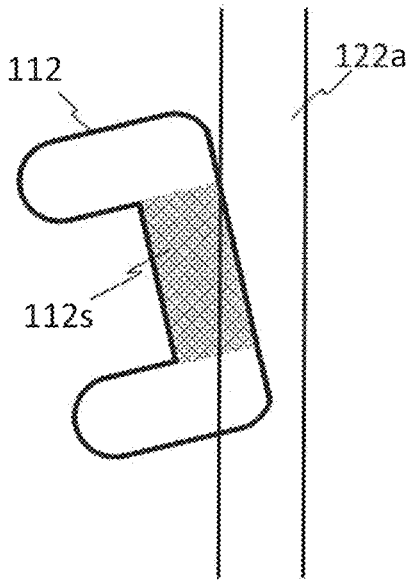
FIG. 11A is a diagram showing an example where the slot 112 is U-shaped and a portion of the opening of the slot 112 is opposed to the waveguide surface 122*a*.

FIG. 11A shows an example where the slot 112 is U-shaped and a portion of the opening of the slot 112 is opposed to the waveguide face 122*a*. When viewed from the normal direction of the first conductive surface 110*a* (which is identical to the normal direction of the waveguide face 122*a*), the small-angle portion 112*s* in the slot 112 of this example intersects one of the two edges of the waveguide face 122*a* but does not intersect the other edge. A portion of the small-angle portion 112*s* is opposed to the waveguide face 122*a*, while another portion is opposed to the second conductive surface 120*a*. In this example, a polarized wave whose electric field oscillates along a direction that is inclined by an angle from the width direction of the waveguide face 122*a*, the angle being smaller than 45 degrees, is transmitted or received.

Figure 11B:
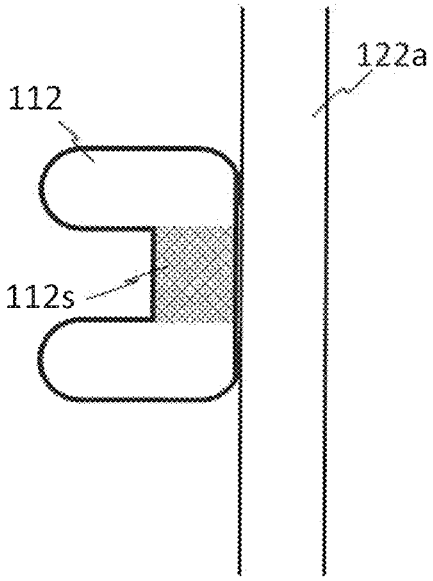
FIG. 11B is a diagram showing an example where the slot 112 is U-shaped and the entire opening of the slot 112 is not opposed to the waveguide surface 122*a*.

FIG. 11B shows an example where the slot 112 is U-shaped and the entire opening of the slot 112 is not opposed to the waveguide face 122*a*. When viewed from the normal direction of the first conductive surface 110*a*, the small-angle portion 112*s* in the slot 112 of this example intersects neither of the two edges of the waveguide face 122*a*, but abuts with one of the two edges. The entire small-angle portion 112*s* is opposed to the second conductive surface 120*a*. Since the width direction of the small-angle portion 112*s* coincides with the width direction of the waveguide face 122*a*, a polarized wave whose electric field oscillates along this direction is transmitted or received.

Figure 11C:
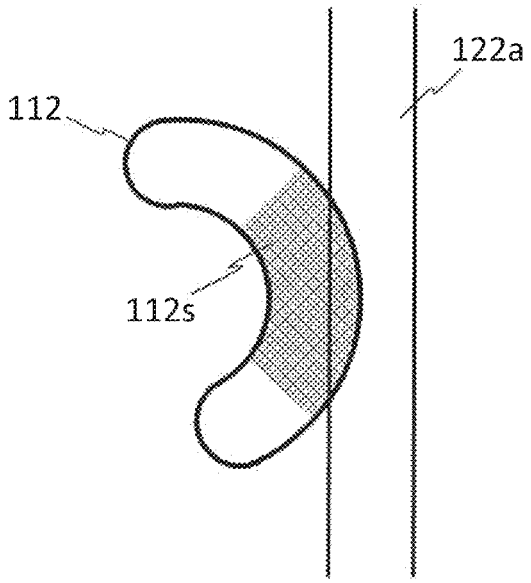
FIG. 11C is a diagram showing an example where the slot 112 is curve-shaped, such that a portion of the opening of the slot 112 is opposed to the waveguide surface 122*a*.

FIG. 11C shows an example where the slot 112 is a curve-shaped (or crescent-shaped) slot, such that a portion of the opening of the slot 112 is opposed to the waveguide face 122*a*. When viewed from the normal direction of the first conductive surface 110*a*, the small-angle portion 112*s* of the slot 112 of this example intersects one of the two edges of the waveguide face 122*a* but does not intersect the other. A portion of the small-angle portion 112*s* is opposed to the waveguide face 122*a*, while another portion is opposed to the second conductive surface 120*a*. In this example, near the central portion of the slot 112, an electromagnetic wave whose electric field oscillates along a direction which approximates the width direction of the waveguide face 122*a* is transmitted or received.

Figure 11D:
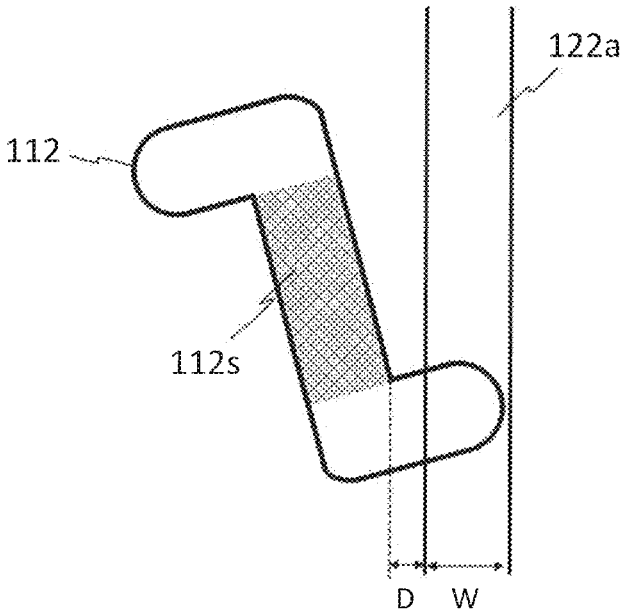
FIG. 11D is a diagram showing an example where the slot 112 is Z-shaped slot and only an end of the opening of the slot 112 is opposed to the waveguide surface 122*a*.

FIG. 11D shows an example where the slot 112 is Z-shaped slot and only an end of the opening of the slot 112 is opposed to the waveguide face 122*a*. When viewed from the normal direction of the first conductive surface 110*a*, the small-angle portion 112*s* overlaps the second conductive surface 120*a* on the outside of one of the two edges of the waveguide face 122*a*. The small-angle portion 112*s* is located, at a shorter distance D than the width W of the waveguide face 122*a*, from the one of the two edges. Thus, in plan view, the small-angle portion 112*s* may be distant from the waveguide face 122*a*. If it is too distant, however, an electromagnetic field of sufficient intensity will not be created in the slot 112. Therefore, in the example of FIG. 11D, the distance D between the small-angle portion 112*s* and the closer edge of the waveguide face 122*a* in plan view is made shorter than the width W of the waveguide face 122*a*. This condition being satisfied can prevent the intensity of the electromagnetic field within the slot 112 from becoming too small. In the present specification, the distance D between the small-angle portion 112*s* and one of the edges of the waveguide face 122*a* is meant to be a distance from that edge to a place within the region of the small-angle portion 112*s* that is shortest in distance to that edge. In the case of adopting the slot 112 of FIG. 11D, near the central portion of the small-angle portion 112*s*, a polarized wave whose electric field oscillates along a direction that intersects the width direction of the waveguide face 122*a* at an angle which is smaller than 45 degrees is transmitted or received.

Figure 11E:
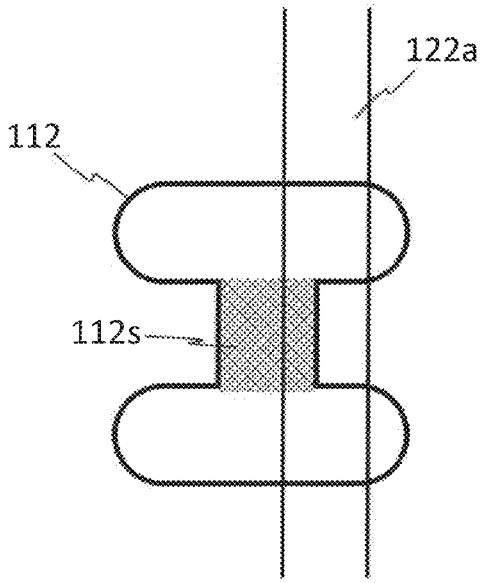
FIG. 11E is a diagram showing an example where the slot 112 is an H-shaped slot, such that the opening of the slot 112 is disposed astride two edges of the waveguide surface 122*a*.

FIG. 11E shows an example where the slot 112 is an H-shaped slot, such that the opening of the slot 112 is disposed astride two edges of the waveguide face 122*a*. When viewed from the normal direction of the first conductive surface 110*a*, the small-angle portion 112*s* intersects one of the two edges of the waveguide face 122*a* but does not intersect the other. However, portions of the opening of the slot 112 except for the small-angle portion 112*s* (two ends) each intersect both of the two edges of the waveguide face 122*a*. With such construction, too, at the central portion of the slot 112, a polarized wave whose electric field oscillates along the width direction of the waveguide face 122*a* can be transmitted or received.

As described above, the shape and arrangement of the slot 112 to be adopted in example embodiments of the present disclosure may be various. Satisfying the above requirements (1) to (3) enables at least one of transmission and reception of a polarized wave whose electric field oscillates along the width direction of the waveguide face 122*a* or a direction that intersects this direction at an angle which is smaller than 45 degrees.

Next, an exemplary construction of a slot antenna (slot array antenna) having a plurality of slots will be described.

Figure 12:
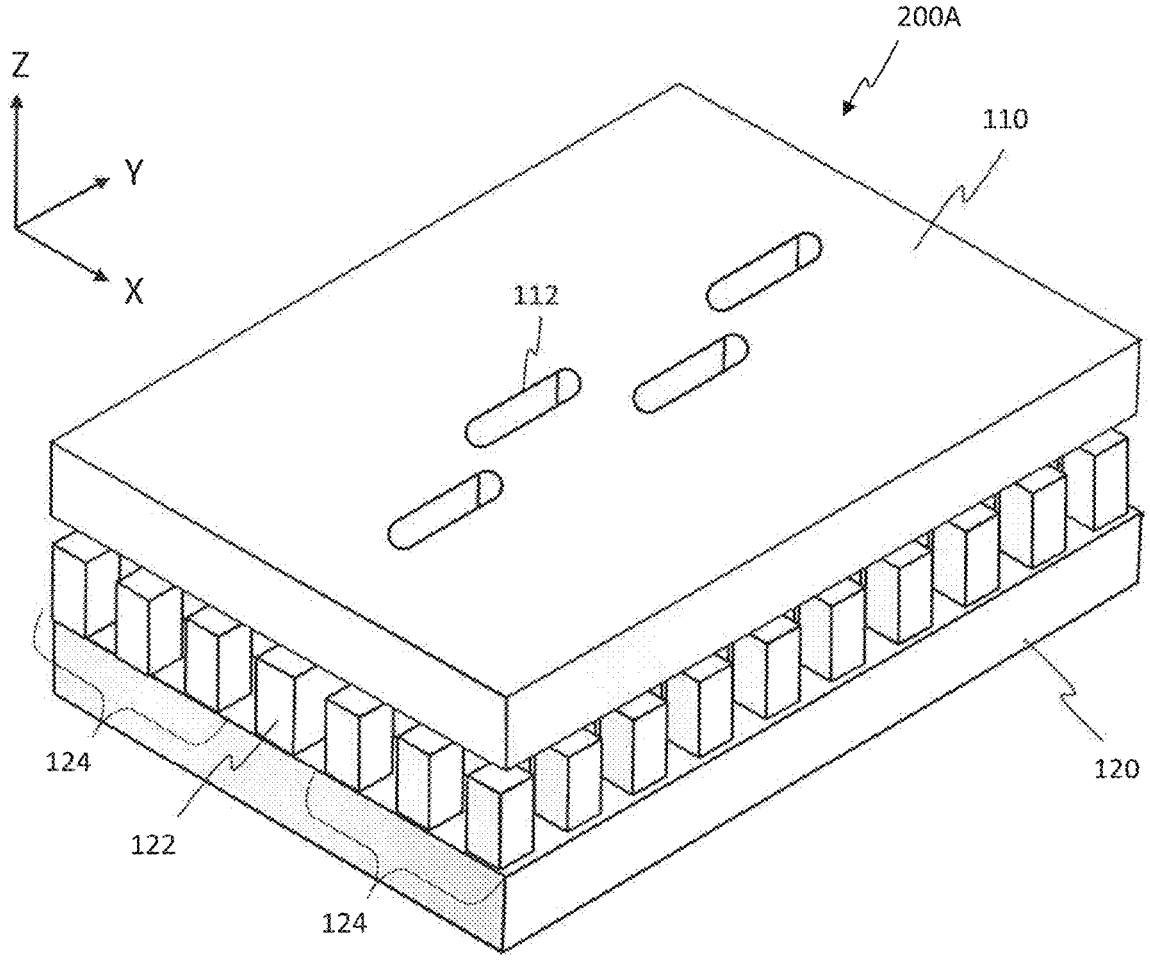
FIG. 12 is a perspective view schematically showing an exemplary construction for a slot array antenna 200A having a plurality of slots 112 which are disposed alongside the waveguide surface 122*a*.
Figure 13:
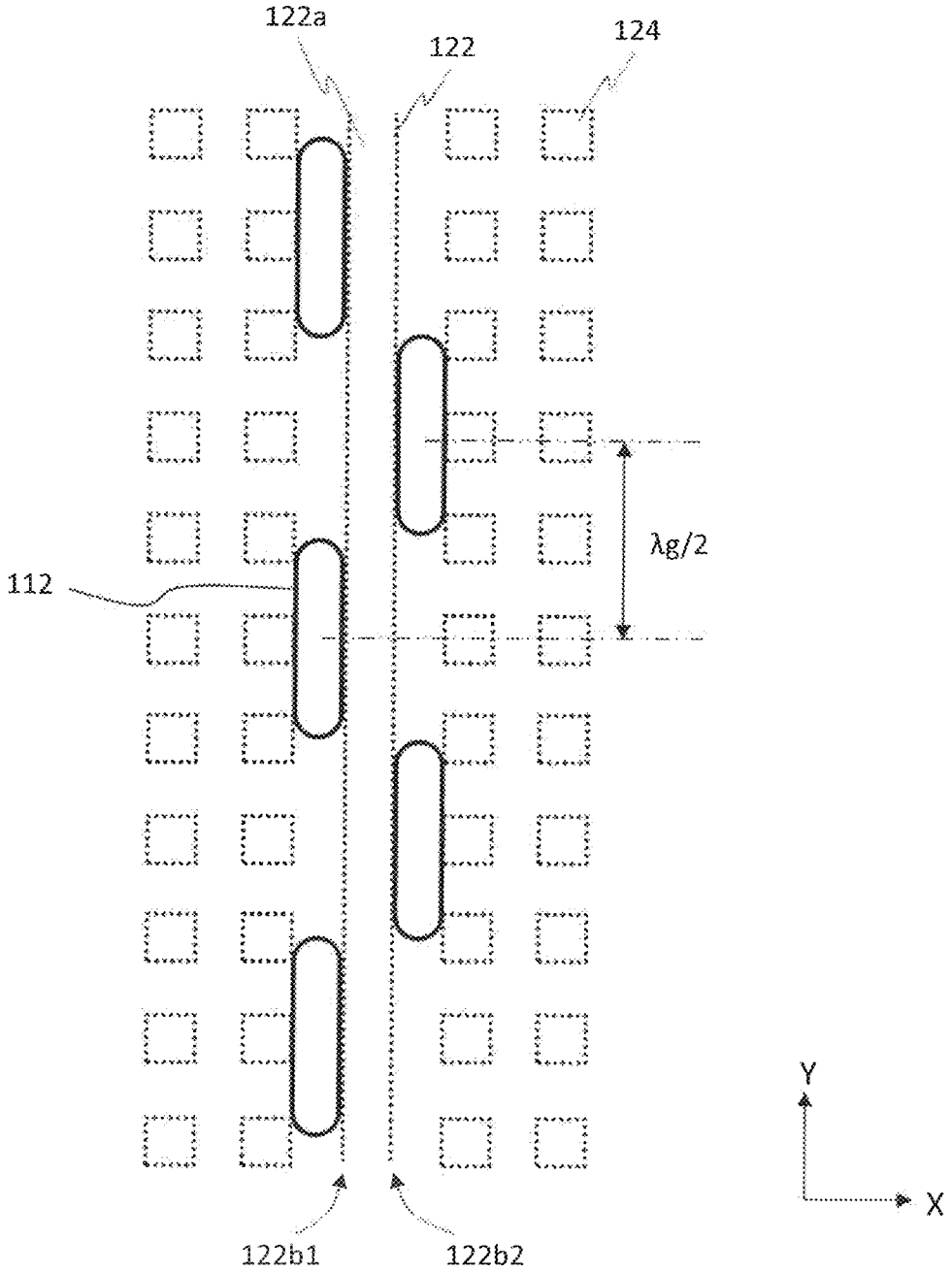
FIG. 13 is an upper plan view showing relative positioning between the plurality of slots 112, the waveguide surface 122*a*, and the plurality of conductive rods 124.

FIG. 12 is a perspective view schematically showing an exemplary construction for a slot array antenna 200A having a plurality of slots 112 which are disposed alongside the waveguide face 122*a*. FIG. 13 is an upper plan view showing relative positioning between the plurality of slots 112, the waveguide face 122*a*, and the plurality of conductive rods 124 in this example. In this example, the first conductive member 110 has a plurality of slots 112 that are located along one 122*b*1 of the two edges of the waveguide face 122*a* and a plurality of slots 112 that are located along the other 122*b*2 of the two edges. In the following description, the former plurality of slots may be referred to as "first type of slots", and as an aggregation they may be referred to as the "first slot group". The latter plurality of slots may be referred to as the second type of slots", and as an aggregation they may be referred to as the "second slot group". Each of the plurality of slots 112 has an I shape. The length direction of each slot 112 coincides with the direction that the waveguide member 122 extends (i.e., the Y direction). The entire opening of each slot 112 is opposed to the second conductive surface 120*a*, but is not opposed to the waveguide face 122*a* and the leading ends of the plurality of conductive rods 124. Stated otherwise, when viewed from the normal direction of the first conductive surface 110*a*, the opening of each slot 112 does not overlap the waveguide member 122 and the artificial magnetic conductor.

In this example, a plurality of first type of slots and a plurality of second type of slots alternate. In other words, regarding a direction following along the waveguide face 122*a* (i.e., the Y direction), any second type of slot is located between two first type of slots adjacent to each other along the Y direction, among the plurality of first type of slots. Similarly, regarding the Y direction, any first type of slots is located between two second type of slots adjacent to each other along the Y direction, among the plurality of second type of slots. Such an arrangement for the slots 112 may be called a "staggered arrangement".

The interval between the centers of two adjacent ones of the plurality of slots 112 along the Y direction is set to $\lambda g/2$. Herein, $\lambda g$ is a wavelength of an electromagnetic wave (having a free space wavelength of $\lambda o$) at the center frequency in the operating frequency band of the slot array antenna 200A when propagating in the waveguide extending between the waveguide face 122*a* and the first conductive surface 110*a*. By ensuring that the interval between the centers of two adjacent slots 112 along the Y direction is $\lambda g/2$, during signal wave transmission, the phase of the signal wave can be shifted by a half wavelength (180 degrees or n) at the positions of the two adjacent slots 112. As a result, electromagnetic waves whose electric field oscillates along the same direction can be radiated from the plurality of slots 112. In other words, electromagnetic waves with an equal phase can be radiated from the plurality of slots 112.

Note that the interval, as taken along the Y direction, between the centers of two adjacent slots 112 along the direction following along the waveguide member 122 (i.e., the Y direction) does not need to be $\lambda g/2$. Similar effects can be obtained so long as: the distance between any two closest first type of slots and the distance between any two closest second type of slots regarding the Y direction are an integer multiple of $\lambda g$; and the distance between any closest ones of the first type of slots and the second type of slots regarding the Y direction is a half-integer multiple of $\lambda g$. Depending on the purpose, the above conditions regarding distance do not need to be strictly satisfied. For example, regarding the Y direction, the distance between any two closest first type of slots and the distance between any two closest second type of slots may be an integer multiple of a given distance a (where a is equal to or greater than $0.5\lambda o$ and smaller than $1.5\lambda o$), and the distance between any closest ones of the first type of slots and the second type of slots along the Y direction may be a half-integer multiple of the distance a.

Based on such construction, an array antenna can be realized such that an electromagnetic wave which has an equal phase and whose electric field oscillates along the width direction of the waveguide face 122*a* is transmitted from each of the plurality of slots 112. Therefore, assuming that the X direction is the horizontal direction and that the Y direction is the vertical direction, for example, a high-gain array antenna can be realized that is capable of transmitting or receiving a polarized wave whose electric field oscillates along the horizontal direction.

The aforementioned shape, arrangement, and number of slots 112 are only examples; various modifications thereof may be possible. Hereinafter, some variants will be illustrated.

Figure 14A:
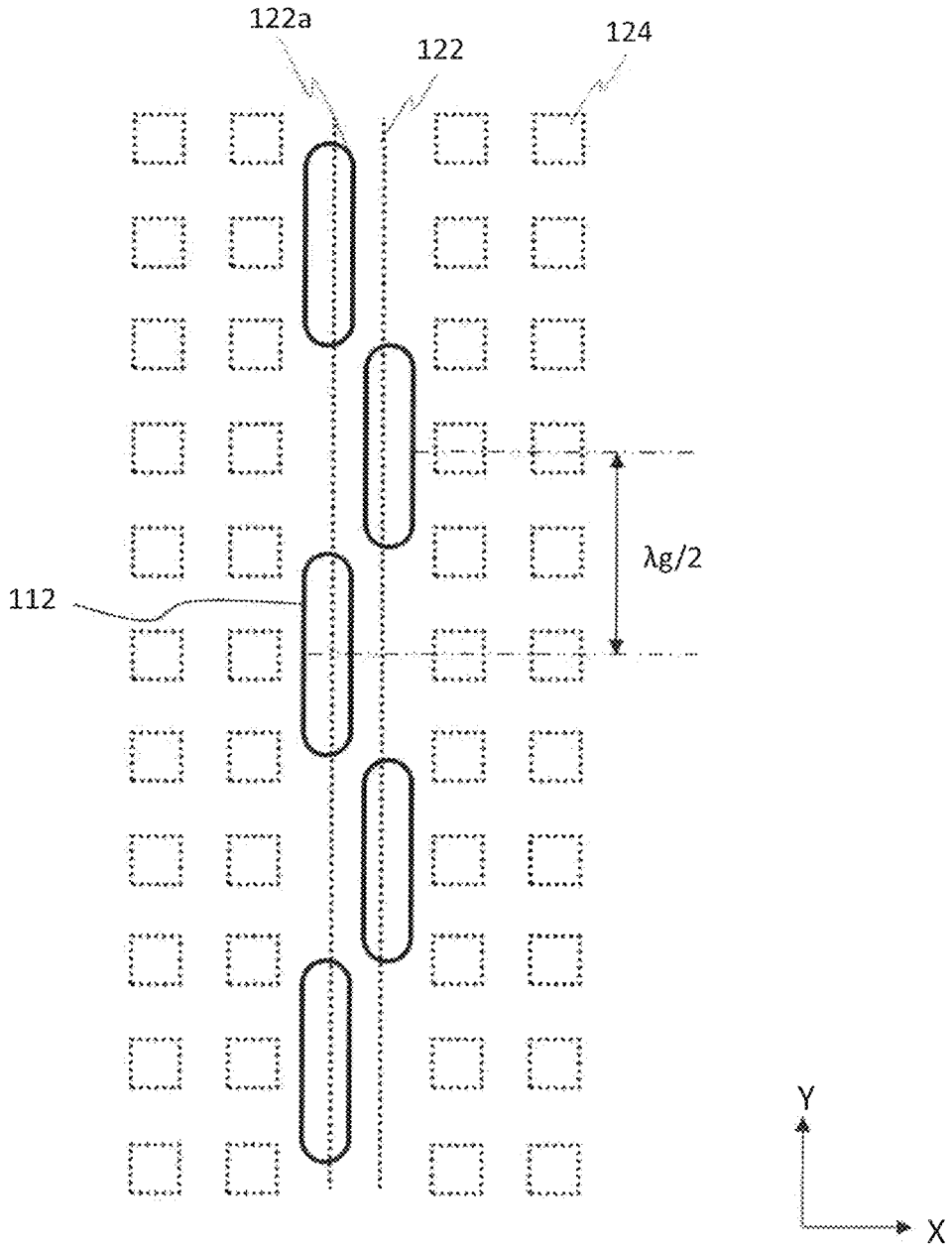
FIG. 14A shows an example where a portion of each slot 112 is opposed to the waveguide surface 122*a*.

FIG. 14A shows an example where a portion of each slot 112 is opposed to the waveguide face 122*a*. With such an arrangement, too, a polarized wave whose electric field oscillates along the X direction can be transmitted or received.

Figure 14B:
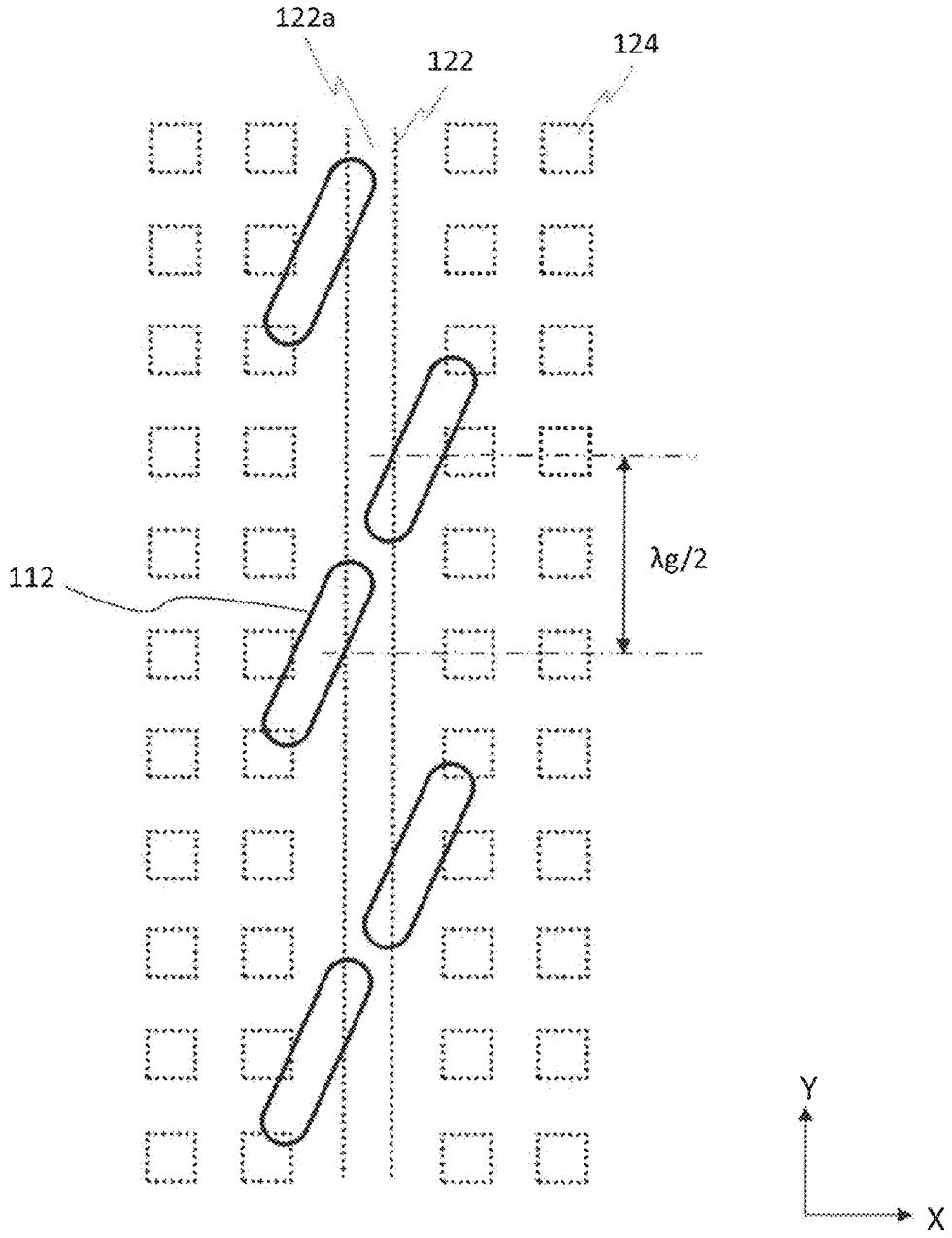
FIG. 14B shows an example where the length direction of each slot 112 is inclined by an angle which is smaller than 45 degrees from the direction that the waveguide surface 122*a* extends.

FIG. 14B shows an example where the length direction of each slot 112 is inclined by an angle which is smaller than 45 degrees from the direction that the waveguide face 122*a* extends (the Y direction). With such an arrangement, a polarized wave whose electric field oscillates along a direction that is inclined from the X direction can be transmitted or received.

Although the above example illustrates that the shape of each slot 112 is an I shape, each slot 112 may alternatively have another shape. Among the plurality of slots 112, the first type of slots being located along one edge 122*b*1 of the waveguide face 122*a* may satisfy the aforementioned requirements (1) to (3). On the other hand, the second type of slots being located along the other edge 122*b*2 of the waveguide face 122*a* may satisfy the following requirements (1') to (3').

(1') When viewed from the normal direction of the first conductive surface 110*a*, at least in the central portion of the length direction of the opening, the opening of the slot 112 includes a portion in which the angle made between the width direction of the opening and the width direction of the waveguide face 122*a* is smaller than 45 degrees (small-angle portion).

(2') When viewed from the normal direction of the first conductive surface 110*a*, at least a portion of the small-angle portion overlaps the second conductive surface 120*a* on the outside of the other (122*b*2) of the two edges of the waveguide face 122*a* (corresponding to the right-hand side of FIG. 14).

(3') When viewed from the normal direction of the first conductive surface 110*a*, the small-angle portion intersects the other 122*b*2 of the two edges of the waveguide face 122*a* but does not intersect the one 122*b*1 of the two edges, or is located, at a shorter distance than the width of the waveguide face 122*a*, from the other 122*b*2 of the two edges.

While being substantially identical to the requirements (1) to (3), the requirements (1') to (3') define a distinct relative positioning between the slots 112 and the two edges of the waveguide face 122*a*.

Hereinafter, some other examples of the shape and arrangement of the slot 112 will be illustrated.

Figure 15A:
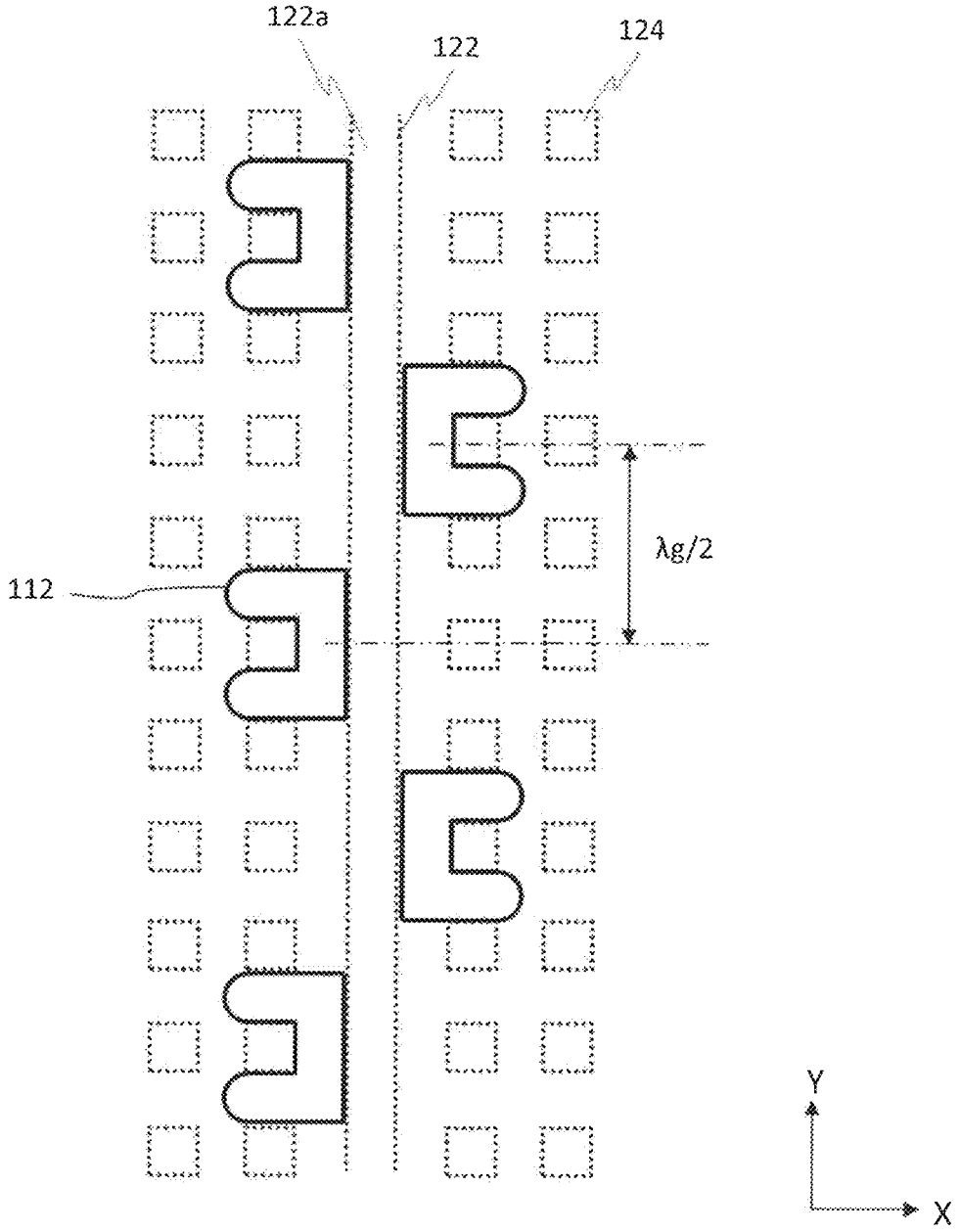
FIG. 15A is a diagram showing an example where each slot 112 is U-shaped.
Figure 15B:
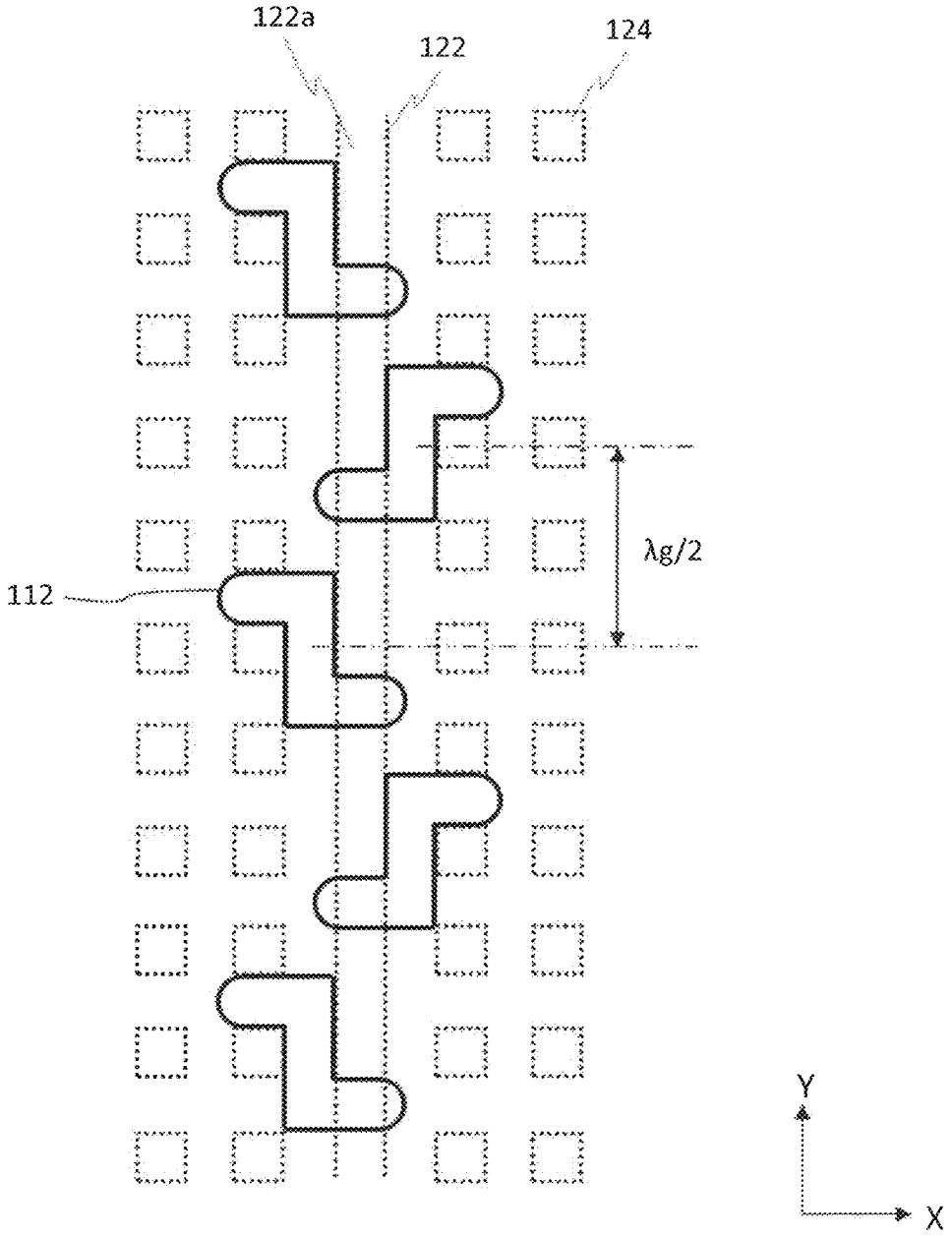
FIG. 15B is a diagram showing an example where each slot 112 is Z-shaped.
Figure 15C:
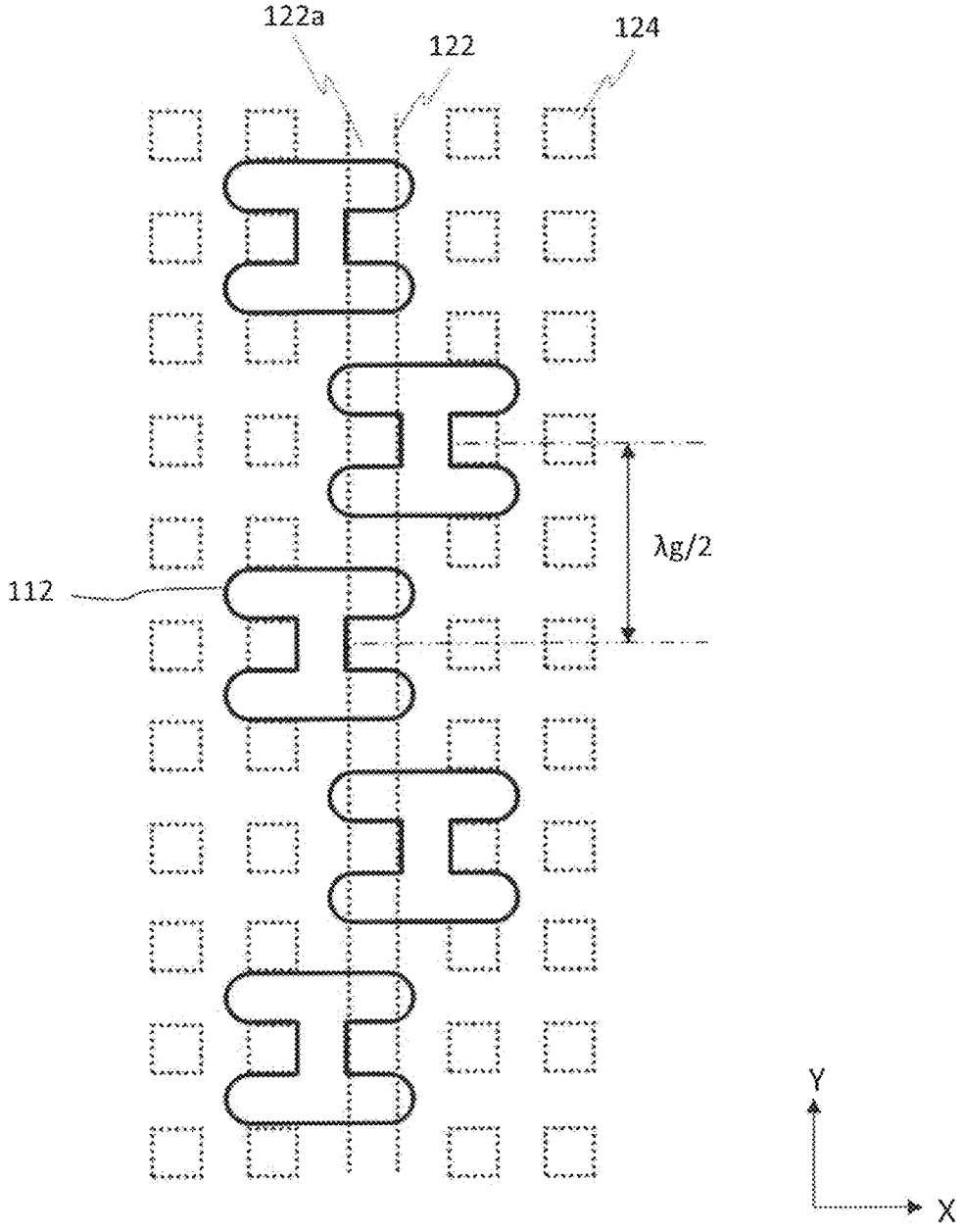
FIG. 15C is a diagram showing an example where each slot 112 is H-shaped.
Figure 15D:
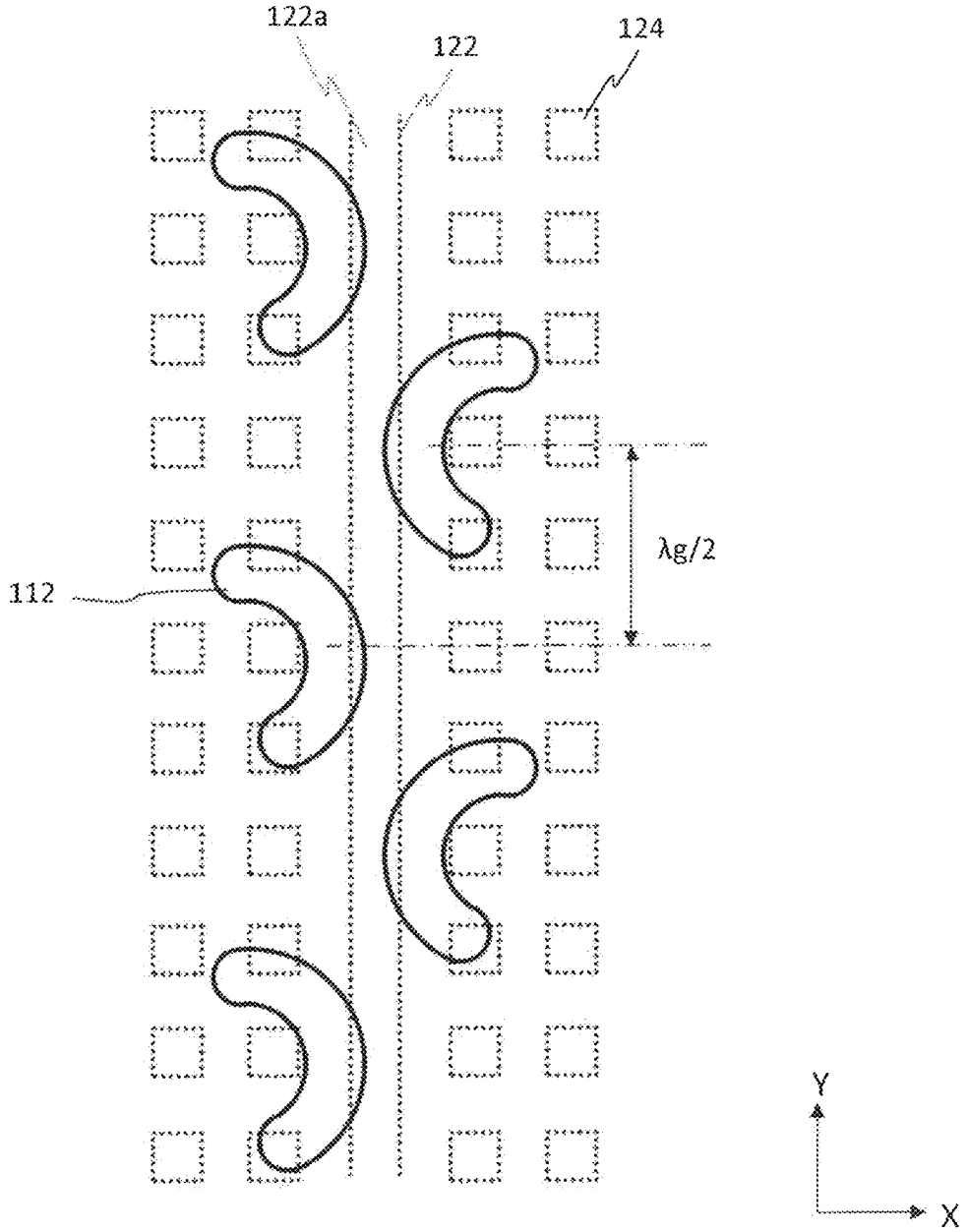
FIG. 15D is a diagram showing an example where each slot 112 is curve-shaped.

FIG. 15A shows an example where each slot 112 is U-shaped. FIG. 15B shows an example where each slot 112 is Z-shaped. FIG. 15C shows an example where each slot 112 is H-shaped. FIG. 15D shows an example where each slot 112 is curve-shaped. In any of the examples of FIGS. 15A through 15D, the distance between the centers of two adjacent slots 112 along the Y direction is set to λg/2. Depending on the purpose, however, it may be set to a value other than λg/2. The width direction of the central portion of each slot 112 substantially coincides with the width direction of the waveguide face 122*a* (the X direction). As a result, an electromagnetic wave having a strong field component along the X direction can be transmitted or received. In each of the examples shown in FIGS. 15A through 15D, the position of each slot 112 along the X direction may be slightly altered so that the small-angle portion near the center is opposed to the waveguide face 122*a*. Alternatively, each slot 112 may be rotated around an axis which is parallel to the Z axis, so that a polarized wave whose electric field oscillates along a direction that is inclined from the X direction is transmitted or received.

Next, an example of a slot array antenna including a plurality of waveguide members will be described.

Figure 16:
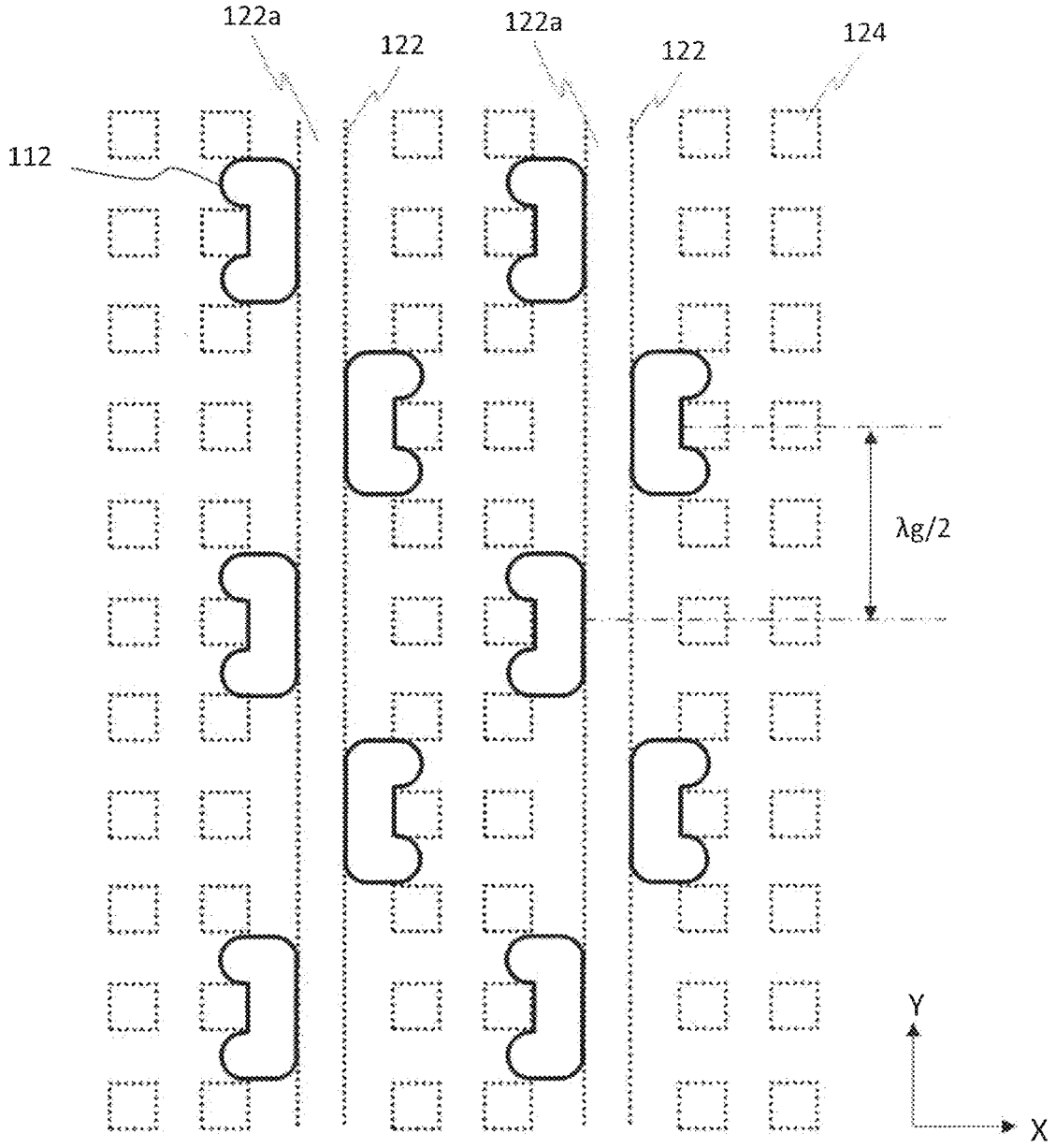
FIG. 16 is an upper plan view schematically showing the construction of a slot array antenna including a plurality of waveguide members 122.

FIG. 16 is an upper plan view schematically showing the construction of a slot array antenna having a plurality of waveguide members 122. FIG. 16 shows relative positioning between a plurality of slots 112 and the plurality of waveguide members 122 and plurality of conductive rods 124. The plurality of waveguide members of the slot array antenna in this example include two adjacent waveguide members 122. The number of waveguide members 122 is not limited to two as illustrated, but may be a further greater number.

In the following description, regarding the two waveguide members 122 shown in FIG. 16, the left waveguide member 122 may be referred to as the "first waveguide member", and the right waveguide member 122 as the "second waveguide member". The first conductive member 110 has a plurality of slots 112 that are arranged along the first waveguide member and a plurality of slots 112 that are arranged along the second waveguide member.

With such construction, a slot array antenna having a plurality of slots 112 arranged in a two-dimensional array can be realized. From each slot 112, an electromagnetic wave having a strong field component along the X direction or a direction that is inclined by an angle which is smaller than 45 degrees from the X direction can be transmitted or received.

Next, example embodiments of slot array antennas having a plurality of waveguide members 122 will be described.

Figure 17A:
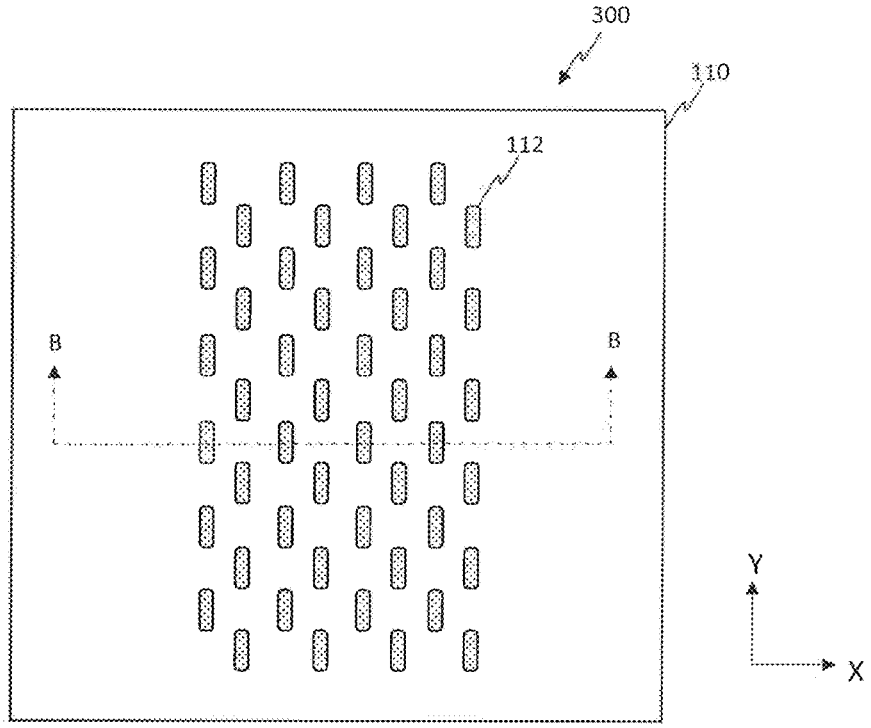
FIG. 17A is an upper plan view showing an exemplary construction of a slot array antenna 300 which is fed through a throughhole that is in a central portion of a waveguide member.
Figure 17B:
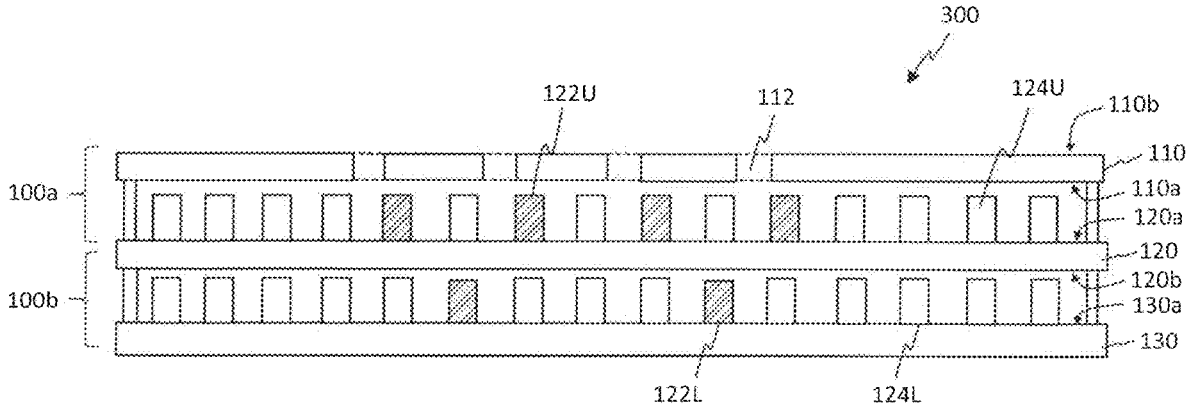
FIG. 17B is cross-sectional view taken along line B-B in FIG. 17A.

FIG. 17A is an upper plan view of a slot array antenna 300 according to an illustrative example embodiment as viewed from the +Z direction. FIG. 17B is cross-sectional view taken along line B-B in FIG. 17A. The slot array antenna 300 includes: a first conductive member 110; a second conductive member 120; a third conductive member 130; a plurality of waveguide members 122U and a plurality of conductive rods 124U on the second conductive member 120; and a waveguide member 122L and a plurality of conductive rods 124L on the third conductive member 130. The first conductive member 110, the second conductive member 120, and the third conductive member 130 are layered in this order, with gaps therebetween. In FIG. 17B, for ease of understanding, the plurality of waveguide members 122U and 122L are shown hatched.

The first conductive member 110 has a first conductive surface 110*b* on the front side and a second conductive surface 110*a* on the rear side. The second conductive member 120 has a third conductive surface 120*a* on the front side, which is opposed to the second conductive surface 110*a*, and a fourth conductive surface 120*b* on the opposite side. The third conductive member 130 has a fifth conductive surface 130*a* on the front side, which is opposed to the fourth conductive surface 120*b*. As used herein, "the front side" means the side at which an electromagnetic wave is radiated or the side at which an electromagnetic wave arrives, whereas "the rear side" means the opposite side to the front side.

In the slot array antenna 300 shown, a first waveguide device 100*a* and a second waveguide device 100*b* are layered upon each other. The first waveguide device 100*a* includes the plurality of waveguide members 122U directly coupling to a plurality of slots 112. The second waveguide device 100*b* includes the waveguide member 122L coupling to the plurality of waveguide members 122U of the first waveguide device 100*a*. The waveguide member 122L and each conductive rod 124L of the second waveguide device 100*b* are disposed on the third conductive member 130. The second waveguide device 100*b* is basically similar in construction to the first waveguide device 100*a*.

As shown in FIG. 17A, the first conductive member 110 has the plurality of slots 112, which are arranged along the first direction (the Y direction) and along a second direction (the X direction) that intersects (e.g., being orthogonal in this example) the first direction. The waveguide face 122*a* of each waveguide member 122U extends along the Y direction. The waveguide face 122*a* of each waveguide member 122U couples to a first slot group (corresponding to the aforementioned first type of slots) including six slots that are arranged along the Y direction and a second slot group (corresponding to the aforementioned second type of slots) including six slots that are arranged along the Y direction, among the plurality of slots 112. Although the conductive member 110 in this example has 48 slots 112, the number of slots 112 is not limited to this example. Moreover, the shape and position of each slot 112 is not limited to this example. The interval between the centers of any two adjacent waveguide faces 122*a* may be set to be shorter than the wavelength λo, and more preferably, shorter than the wavelength λo/2, for example.

Figure 17C:
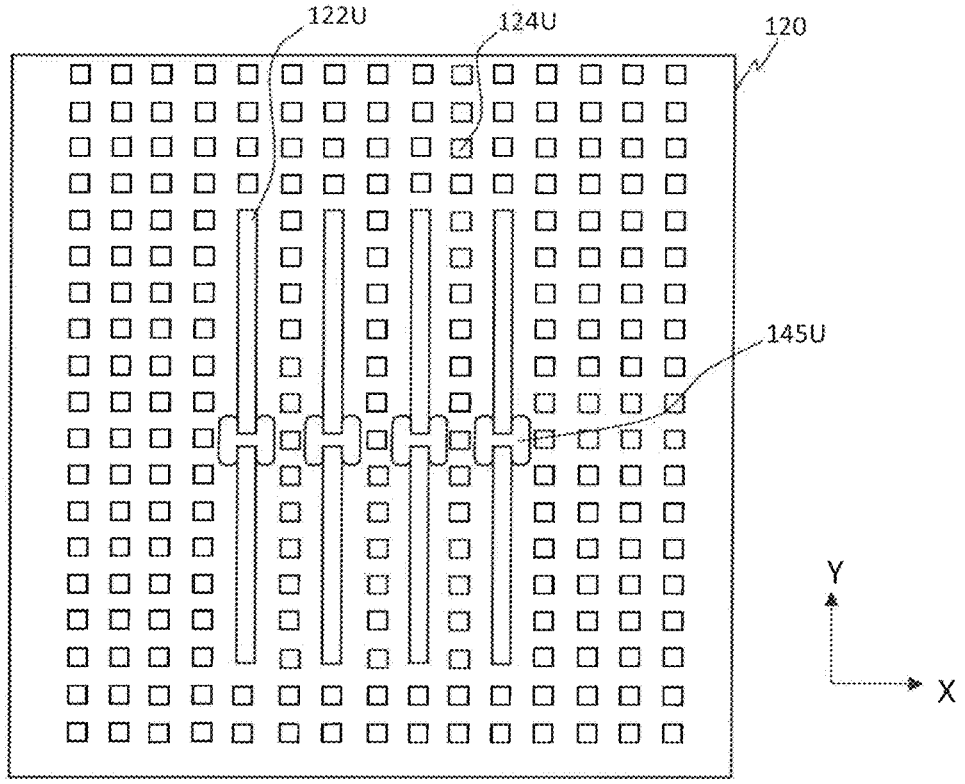
FIG. 17C is a diagram showing a planar layout of waveguide members 122U in a first waveguide device 100*a*.
Figure 17D:
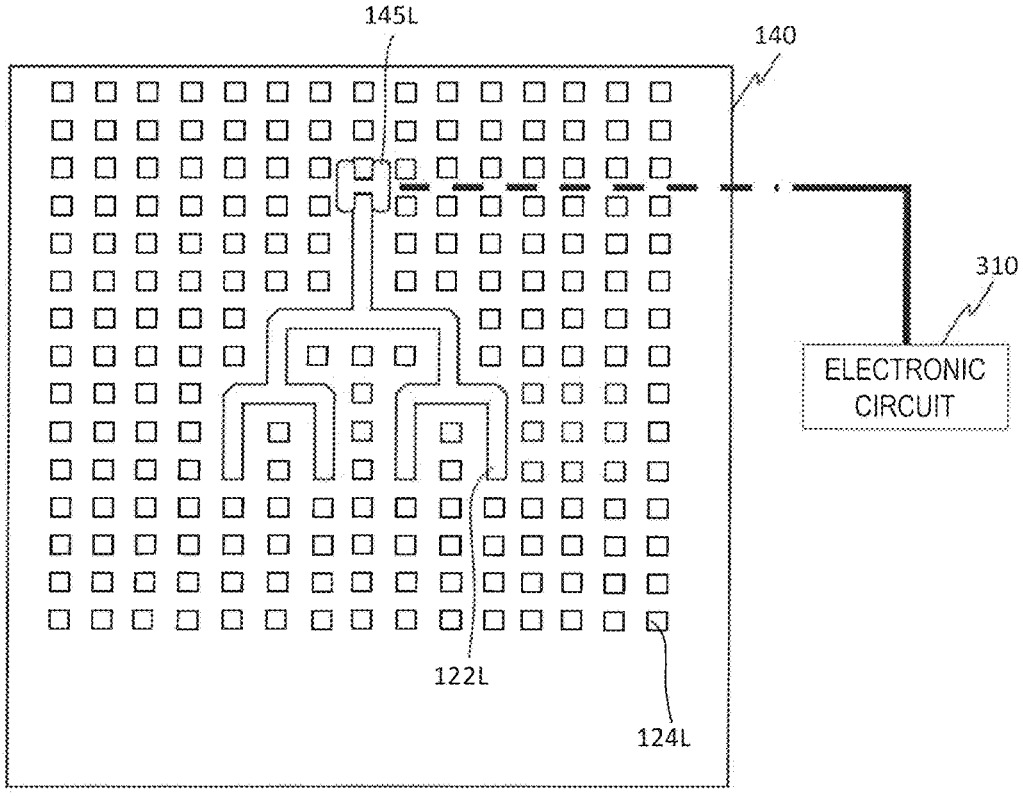
FIG. 17D is a diagram showing a planar layout of a waveguide member 122L in a second waveguide device 100*b*.

FIG. 17C is a diagram showing a planar layout of the plurality of waveguide members 122U in the first waveguide device 100*a*. FIG. 17D is a diagram showing a planar layout of a waveguide member 122L in the second waveguide device 100*b*. As is clear from these figures, the waveguide members 122U of the first waveguide device 100*a* extend linearly, and include no branching portions or bends; on the other hand, the waveguide member 122L of the second waveguide device 100*b* includes both branching portions and bends. The combination of the "second conductive member 120" and the "third conductive member 140" in the second waveguide device 100*b* corresponds to the combination in the first waveguide device 100*a* of the "first conductive member 110" and the "second conductive member 120".

The waveguide members 122U of the first waveguide device 100*a* couple to the waveguide member 122L of the second waveguide device 100*b*, through ports (throughholes) 145U that are provided in the second conductive member 120. Stated otherwise, an electromagnetic wave which has propagated through the waveguide member 122L of the second waveguide device 100*b* passes through a port 145U to reach a waveguide member 122U of the first waveguide device 100*a*, and propagates through the waveguide member 122U of the first waveguide device 100*a*. In this case, each slot 112 functions as a radiating element to allow an electromagnetic wave which has propagated through the waveguide to be radiated into space. Conversely, when an electromagnetic wave which has propagated in space impinges on a slot 112, the electromagnetic wave couples to the waveguide member 122U of the first waveguide device 100*a* that lies directly under that slot 112, and propagates through the waveguide member 122U. An electromagnetic wave which has propagated through a waveguide member 122U may also pass through a port 145U to reach the waveguide member 122L of the second waveguide device 100*b*, and propagates through the waveguide member 122L. Via a port 145L of the third conductive member 130, the waveguide member 122L of the second waveguide device 100*b* may couple to an external waveguide device or an electronic circuit (e.g., a radio frequency circuit). As one example, FIG. 17D illustrates an electronic circuit 310 which is connected to the port 145L. Without being limited to a specific position, the electronic circuit 310 may be provided at any arbitrary position. The electronic circuit 310 may be provided on a circuit board which is on the rear surface side (i.e., the lower side in FIG. 17B) of the third conductive member 130, for example. Such an electronic circuit 310 may include a microwave integrated circuit, e.g. an MMIC (Monolithic Microwave Integrated Circuit) that generates millimeter waves, for example. In addition to the microwave integrated circuit, the electronic circuit 310 may further include another circuit, e.g., a signal processing circuit. Such a signal processing circuit may be configured to execute various processes that are necessary for the operation of a radar system that includes a slot antenna array, for example. The electronic circuit 310 may include a communication circuit. The communication circuit may be configured to execute various processes that are necessary for the operation of a communication system that includes a slot antenna array.

The first conductive member 110 shown in FIG. 17A may be called a "radiation layer". The entirety of the second conductive member 120, the plurality of waveguide members 122U, and the plurality of conductive rods 124U shown in FIG. 17D may be called an "excitation layer". The entirety of the third conductive member 130, the waveguide member 122L, and the plurality of conductive rods 124L shown in FIG. 17D may be called a "distribution layer". Moreover, the "excitation layer" and the "distribution layer" may be collectively called a "feeding layer". Each of the "radiation layer", the "excitation layer", and the "distribution layer" can be mass-produced by processing a single metal plate. The radiation layer, the excitation layer, the distribution layer, and any electronic circuitry to be provided on the rear face side of the distribution layer may be produced as a single-module product.

In the array antenna of this example, as can be seen from FIG. 17B, a radiation layer, an excitation layer, and a distribution layer are layered, which are in plate form. Therefore, a flat and low-profile flat panel antenna is realized as a whole. For example, the height (thickness) of a multilayer structure having a cross-sectional construction as shown in FIG. 17B can be 10 mm or less.

With the waveguide member 122L shown in FIG. 17D, the distances from the port 145L of the third conductive member 130 to the respective ports 145U (see FIG. 17C) of the second conductive member 120 as measured along the waveguide are all set to an identical value. Therefore, a signal wave which is input to the waveguide member 122L reaches the four ports 145U of the second conductive member 120 all in the same phase, from the port 145L of the third conductive member 130. As a result, the four waveguide members 122U on the second conductive member 120 can be excited in the same phase.

Depending on the purpose, it is not necessary for all slots 112 functioning as antenna elements to radiate electromagnetic waves in the same phase. In FIG. 17D, the distances from the port 145L of the third conductive member 130 to the respective ports 145U of the second conductive member 120 shown in FIG. 17C, as measured along the waveguide, may differ from one another. The network patterns of the waveguide members 122U and 122L in the excitation layer and the distribution layer may be arbitrary, without being limited to what is shown.

The electronic circuit 310 is connected to a waveguide extending above each waveguide member 122U in the excitation layer, via the ports 145U and 145L shown in FIG. 17C and FIG. 17D. A signal wave which is output from the electronic circuit 310 is subject to branching in the distribution layer, and then propagates on the plurality of waveguide members 122U in the excitation layer, until reaching the plurality of slots 112. In order to ensure that the signal waves have an equal phase at the positions of two adjacent slots 112 along the X direction, the total waveguide lengths from the electronic circuit 310 to the two adjacent slots 112 along the X direction may be designed to be substantially equal, for example.

Although the present example embodiment illustrates that four waveguide members 122U are provided on the second conductive member 120, the number of waveguide members 122U may be any arbitrary number which is one or greater. The number of rows of slots 112 in the first conductive member 110 is to be determined based on the number of waveguide members 122U. When there is one waveguide member 122U, the first conductive member 110 may only include two rows of slots in a staggered arrangement (a first slot group and a second slot group) coupling to that waveguide member 122U. This similarly applies to the following example embodiments.

Next, other example embodiments of the present disclosure will be described.

Figure 18A:
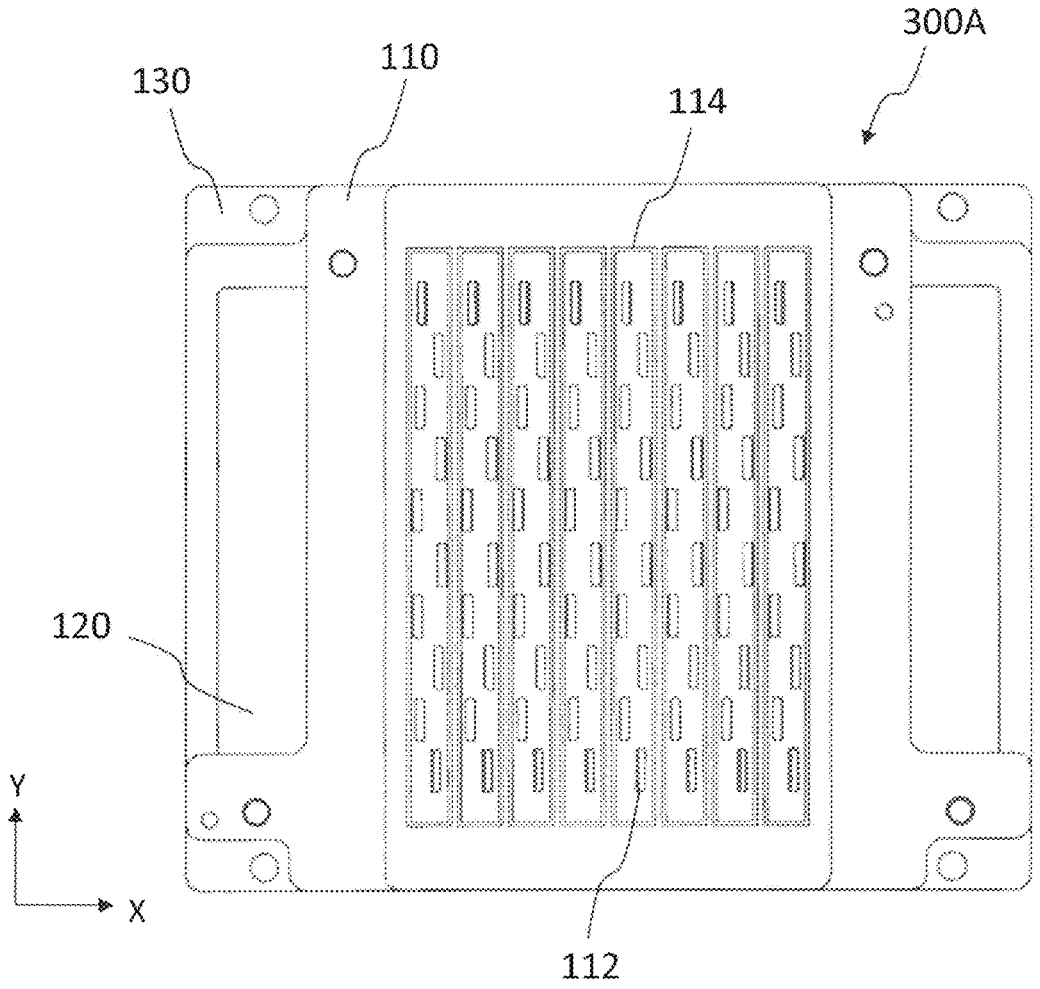
FIG. 18A is a plan view showing a slot array antenna 300A according to another example embodiment of the present disclosure.
Figure 18B:
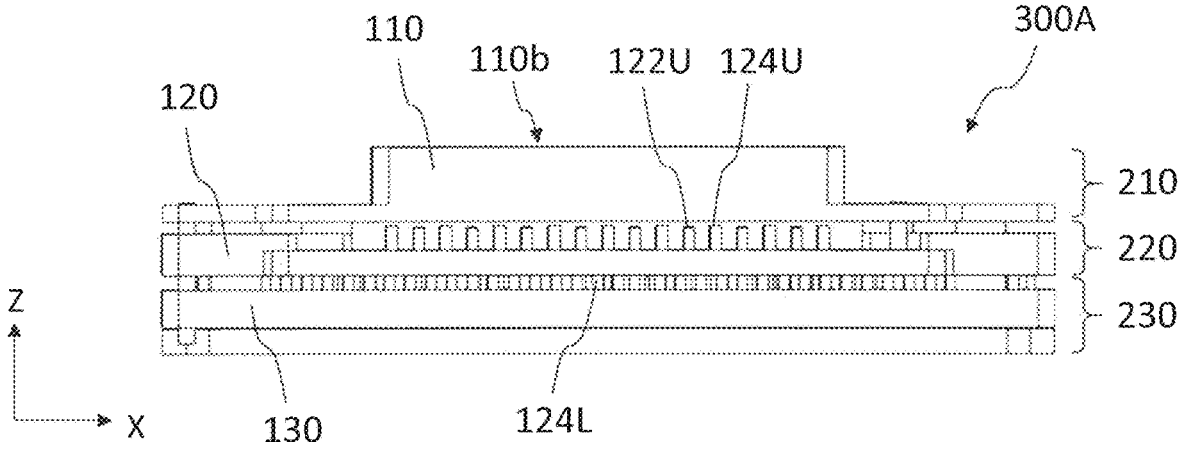
FIG. 18B is a side view showing the slot array antenna 300A as viewed from the −Y direction.

FIG. 18A is a plan view showing a slot array antenna 300A according to another example embodiment of the present disclosure. FIG. 18B is a side view showing the slot array antenna 300A as viewed from the −Y direction. The slot array antenna 300A includes a first conductive member 110, a second conductive member 120, and a third conductive member 130, which are layered with gaps therebetween. On the second conductive member 120, a plurality of waveguide members 122U and a plurality of conductive rods 124U are disposed. On the third conductive member 120, too, a plurality of waveguide members 122L and a plurality of conductive rods 124L are disposed. The first conductive member 110 constitutes a radiation layer 210. The second conductive member 120 and the plurality of waveguide members 122U and plurality of conductive rods 124U thereon constitute an excitation layer 220. The third conductive member 130 and the plurality of waveguide members 122L and the plurality of conductive rods 124L thereon constitute a distribution layer 230. Each conductive member 110, 120 or 130 may be shaped by processing a metal plate, for example. Alternatively, each conductive member 110, 120 or 130 may be produced by plating a shaped piece of resin (plastic).

Figure 19A:
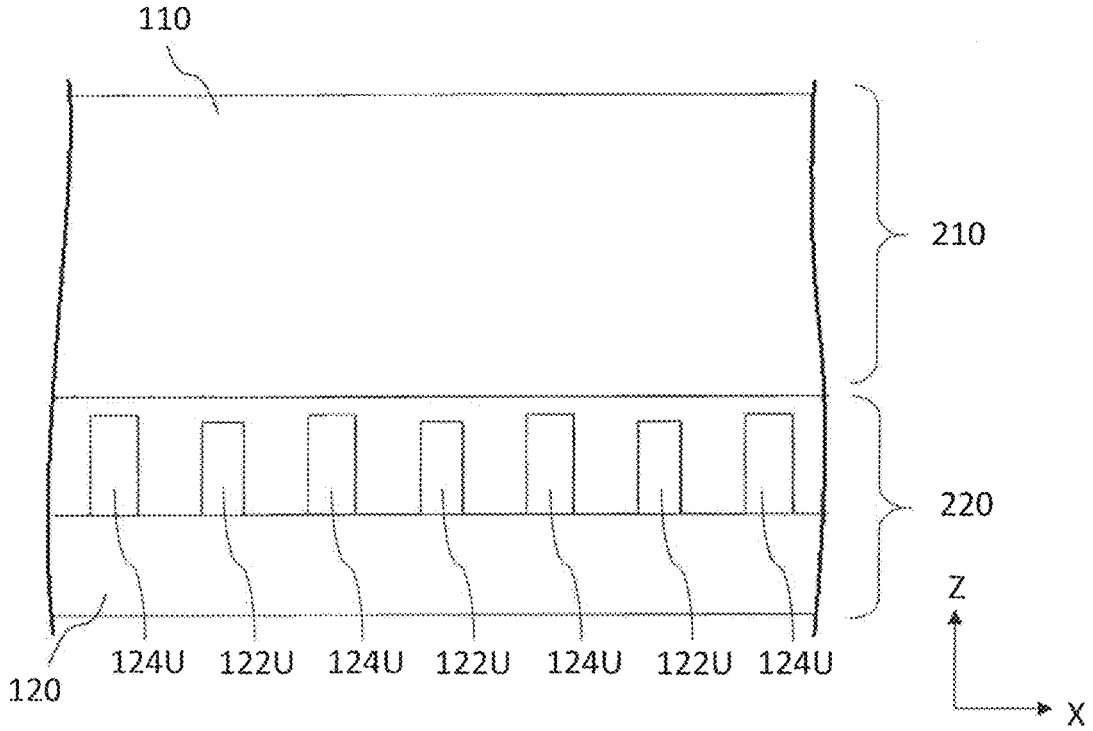
FIG. 19A is a cross-sectional enlarged view of a portion of the construction of a radiation layer 210 and an excitation layer 220.

FIG. 19A is a cross-sectional view showing enlarged a part of the construction of the radiation layer 210 and the excitation layer 220. As shown in FIG. 19A, the rows of waveguide members 122U and the rows of conductive rods 124U upon the second conductive member 120 alternate along the X direction. In this example, the height of each waveguide member 122U (i.e., the dimension along the Z direction) is smaller than the height of each conductive rod. With such structure, isolation between signal waves propagating along the respective waveguide members 122U can be enhanced.

Figure 19B:
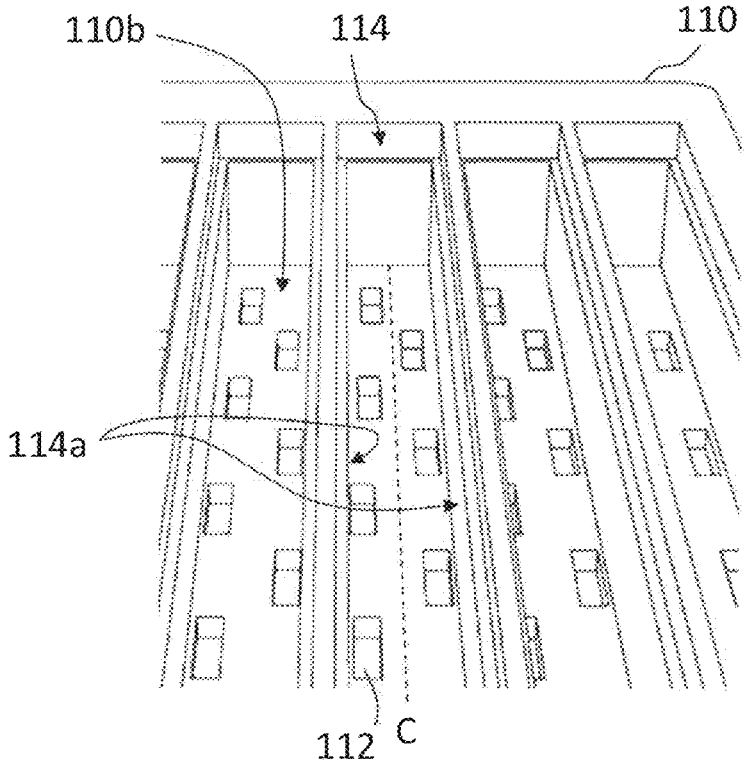
FIG. 19B is a diagram showing an enlarged view of a portion of the radiation layer 210.

FIG. 19B is a diagram showing enlarged a part of the radiation layer 210. The first conductive member 110 constituting the radiation layer 210 has a plurality of slots 112. The plurality of slots 112 constitute a plurality of slot sequences.

Each slot sequence includes a first slot group and a second slot group each of which extends along the first direction (the Y direction). A first slot group includes a plurality of slots 112 arranged along the Y direction. A second slot group also includes a plurality of slots 112 arranged along the Y direction. Each second slot group lies next to a first slot group. The position of each slot in a first slot group regarding the Y direction is different from the position of each slot in a second slot group regarding the Y direction. Along the Y direction, the center of (each of) one or more slots in a first slot group is located between two adjacent slots in a second slot group. Similarly, along the Y direction, the center of (each of) one or more slots in a second slot group is located between two adjacent slots in a first slot group. In the example of FIG. 18A, the position of any first slot group along the Y direction is offset from the position of any second slot group along the Y direction by a length corresponding to a half of the wavelength of an electromagnetic wave within the waveguide. The first slot group and the second slot group are arrayed in a "staggered arrangement" as aforementioned.

FIG. 19B shows, with a broken line, a center line C of a waveguide face of a waveguide member that is the closest to a given first slot group and a given second slot group. As in the example of FIG. 19B, the distance from the center line C to each slot may differ from slot to slot. In the example of FIG. 19B, the closer to the end of the slot sequence, the closer to the center line C of the waveguide face the slot becomes. Moreover, the slots do not need to be identical in shape and width, either; they may vary in shape and width depending on the position within the slot sequence. By additionally introducing such characteristics to the first slot group and the second slot group, the radiation pattern from the slot antenna can be adjusted. In the case where the distance of each slot from the center line C varies depending on the position within the slot group, the direction along which the slots flank one another to constitute that slot group does not strictly coincide with the direction that the waveguide face extends. However, so long as the shifts in the slot sequence position remains less than twice the width of the waveguide face, it is said in the present specification that the slots are arranged along the direction that the waveguide face extends.

The first conductive surface 110*b* of the first conductive member 110 on the front side has a shape defining a plurality of horns 114 flanking one another along the X direction. Each horn 114 is structured so as to extend along the first direction (the Y direction). Each horn 114 has a pair of electrically-conductive wall faces 114*a* (hereinafter also referred to as electrically conductive walls 114*a*) rising from the first conductive surface 110*b* and extending along the first direction. When viewed from a direction which is perpendicular to the first conductive surface 110*b*, a first slot group and a second slot group are located between the pair of wall faces 114*a*. In this example, the plurality of horns 114 each accommodate a plurality of slot sequences; in other words, each horn 114 accommodates a first slot group and a second slot group. As used herein, that "a horn 114 accommodates a slot sequence" means that the slot sequence is surrounded by the electrically conductive walls of the horn 114.

The plurality of horns 114 are arranged so as to flank one another along the second direction (the X direction). In the example of FIG. 18A, eight rows of horns 114 are provided. With such structure, electromagnetic waves of different phases can be radiated from the slots 112 within the plurality of horns 114.

As shown in FIG. 19B, each horn 114 includes the pair of electrically conductive walls 114*a* extending along the longitudinal direction. Each electrically conductive wall 114*a* has a shape resembling a staircase (convex form). Without being limited to a staircase, the shape of the electrically conductive wall 114*a* may be an inclined plane, for example.

At the bottom of each horn 114, a plurality of slots 112 (a first slot group and a second slot group) are provided. The shape of the opening of each slot 112 according to the present example embodiment is rectangular, and its longitudinal direction coincides with the Y direction. However, without being limited to such a shape and arrangement, adjustments are possible in accordance with the required antenna characteristics.

Figure 20A:
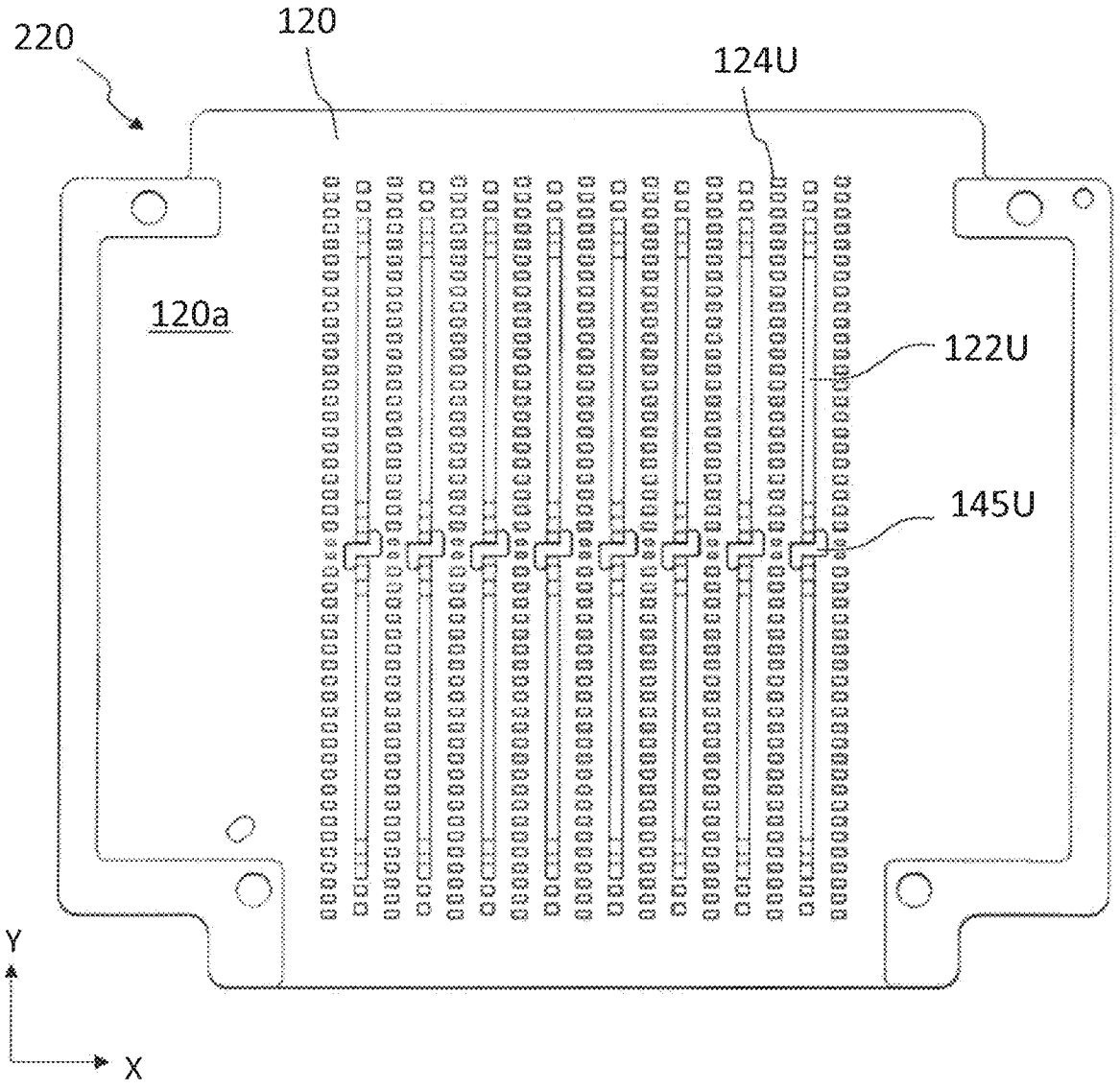
FIG. 20A is a plan view showing a construction for the excitation layer 220.
Figure 20B:
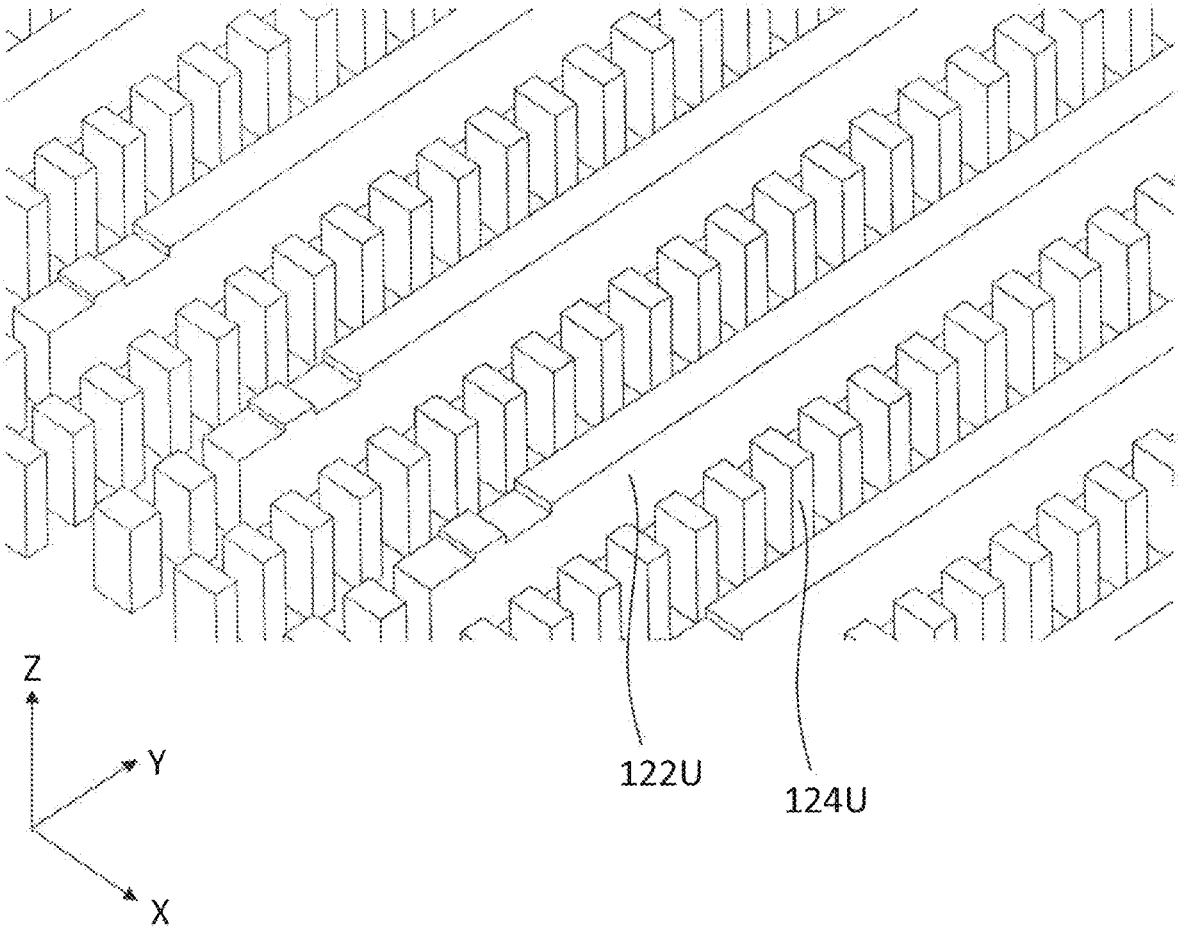
FIG. 20B is a perspective view showing an enlarged view of a portion of the excitation layer 220.
Figure 20C:
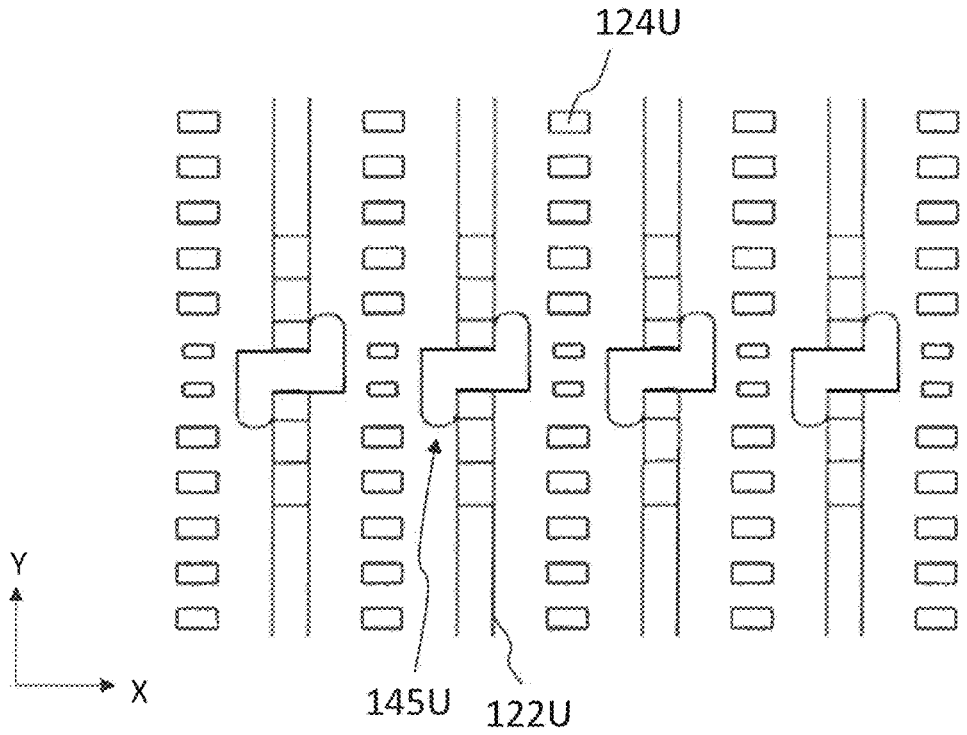
FIG. 20C is a plan view showing an enlarged view of a portion of the excitation layer 220.

FIG. 20A is a plan view showing the excitation layer 220. FIG. 20B is a perspective view showing enlarged a part of the excitation layer 220. FIG. 20C is a plan view showing enlarged a part of the excitation layer 220. The excitation layer 220 includes the second conductive member 120 as well as the plurality of waveguide members 122U and the plurality of conductive rods 124U thereon. In the central portion of each waveguide member 122U, the second conductive member 120 has a port 145U (throughhole) to serve as a feeding point. Hereinafter, the port 145U may be referred to as a "feeding slot". The opening of the port 145U is shaped so as to include a lateral portion extending along the X direction and a pair of vertical portions extending along the Y direction from both ends of the lateral portion. In this example, the pair of vertical portions extend in mutually opposite directions from both ends of the lateral portion. The plurality of waveguide members 122U are arranged along the X direction. The waveguide face of each waveguide member 122U has a plurality of dents (recesses) near the port 145U and near both ends of the waveguide face. The position and depth of each dent are appropriately designed so as to achieve desired radiation characteristics or reception characteristics. The plurality of conductive rods 124U constitute a plurality of rod rows extending alongside the plurality of waveguide members 122U. In this example, one rod row is provided between two adjacent waveguide members 122U.

As shown in FIG. 20B, the shape of each conductive rod 124U as viewed from the +Z direction is rectangular. As compared to the case where the shape is a square, each rod 124U has a smaller dimension along the Y direction. Moreover, the width of any interspace between two adjacent rods 124U along the Y direction may be set to a range of λm/10 or less, for example. As a result, the period of arrangement of the rods 124U along the Y direction (i.e., the distance between the centers of adjacent rods) can be set to a value which is equal to or greater than λm/9 and smaller than λm/5. With such an interval of arrangement, leakage of a radio frequency signal propagating along the waveguide members 122U can be prevented.

Figure 20D:
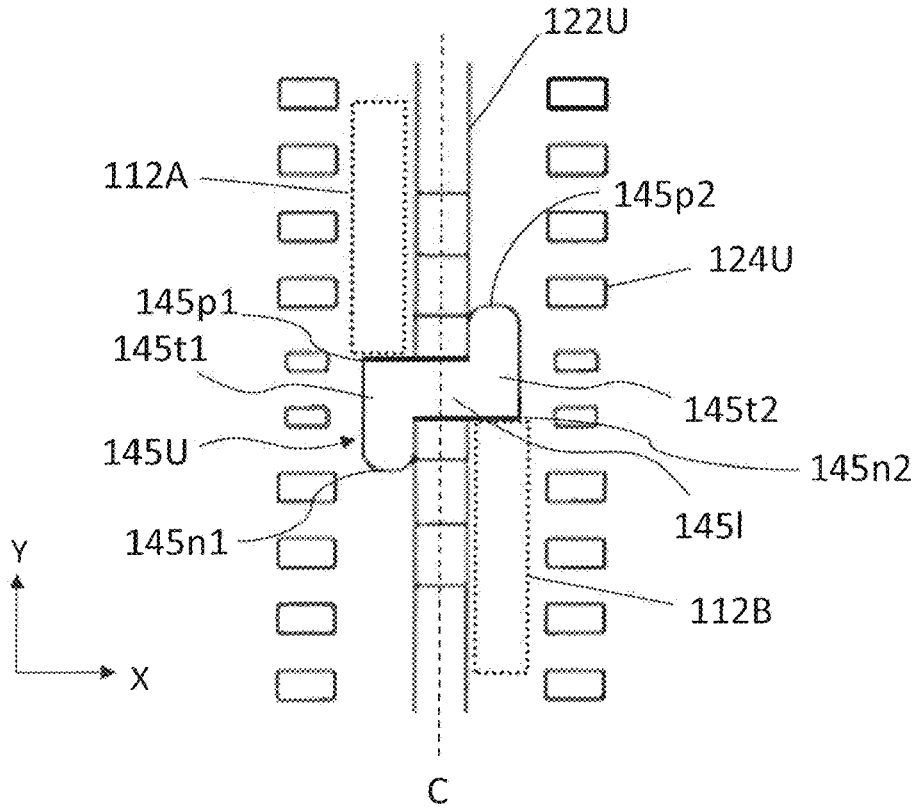
FIG. 20D is a diagram for describing relative positioning between a port 145U and slots 112A and 112B.

FIG. 20D is a diagram for describing relative positioning between a port 145U in the second conductive member 120 and a slot 112A included in a first slot group and a slot 112B included in a second slot group on the first conductive member 110. As illustrated, when viewed from a direction which is perpendicular to the waveguide face of the waveguide member 122U (the +Z direction), the center of each slot 112A in the first slot group is located on one side (i.e., the left side in this figure) of a line C extending through the center of the waveguide face (referred to as the "center line"), whereas the center of each slot in the second slot group is located on another side of the center line C of the waveguide face (i.e., the right side in this figure). Another way of expressing this relative positioning may be that the center line C passes between a row constituted by the centers of the slots in the first slot group and a row constituted by the centers of the slots in the second slot group. When viewed from the +Z direction, the distance from the center of each slot in the first slot group or the second slot group to the center line C of the waveguide face is shorter than the distance between the center line C of the waveguide face and the center of the conductive rod 124U that is the closest to the center line C. Similarly, when viewed from the +Z direction, the center of the port 145U is located between the slot 112A included in the first slot group and the slot 112B included in the second slot group. More specifically, when viewed from a direction perpendicular to the waveguide face, the center of the port 145U is located between a central portion of a region in which the first slot group is distributed and a central portion of a region in which the second slot group is distributed. Although the present example embodiment illustrates that the port 145U overlaps neither slot, the port 145U may overlap at least one of them.

As shown in FIG. 20D, in this example, the opening of each port 145U is shaped so as to include: a lateral portion 1451 extending along the second direction (the X direction) that intersects the first direction (the Y direction); a first vertical portion **145*t*1 extending along the Y direction and being connected to one end of the lateral portion 1451; and a second vertical portion 145*t*2 extending along the Y direction and being connected to another end of the lateral portion 1451. Note that the direction that the vertical portions 145*t*1 and 145*t*2 extend may not be orthogonal to the direction that the lateral portion 1451 extends. When the first direction (the +Y direction) is regarded as a positive direction and an opposite direction (the −Y direction) of the first direction is regarded as a negative direction, a positive end 145*p*1 of the first vertical portion 145*t*1 is closer to the lateral portion 1451 than is a negative end 145*n*1 of the first vertical portion 145*t*1. Moreover, a negative end 145*n*2 of the second vertical portion 145*t*2 is closer to the lateral portion 1451 than is a positive end 145*p*2 of the second vertical portion 145*t*2. The positive end 145*p*1 of the first vertical portion 145*t*1 has a smaller distance to the center of the slot 112A in the first slot group that is the closest to the lateral portion 1451 than does the negative end 145*n*1 of the first vertical portion 145*t*1. Moreover, the negative end 145*n*2 of the second vertical portion 145*t*2 has a smaller distance to the center of the slot 112B in the second slot group that is the closest to the lateral portion 1451 than does the positive end 145*p*2 of the second vertical portion 145*t*2**.

In the example of FIG. 20D, along the first direction (the Y direction), the first vertical portion **145*t*1 has a partial overlap with the closest slot 112B in the second slot group. Moreover, along the Y direction, the second vertical portion 145*t*2 has a partial overlap with the closest slot 112A in the first slot group. Without being such structure, the slots and throughholes (ports) may be arranged in any manner so that, along the Y direction, at least one of the first vertical portion 145*t*1 and the second vertical portion 145*t*2** has at least a partial overlap with at least one slot included in the first slot group and the second slot group.

Although the present example embodiment illustrates that the opening of each slot 112 as viewed from the +Z direction has a rectangular shape (I shape) extending along the Y direction, it may have other shapes as illustrated in FIGS. 10A through 10E. The arrangement of the slots 112 is also not limited to the illustrated example; various arrangements are possible, as has been described with reference to e.g. FIGS. 11A through 11E. In example embodiments of the present disclosure, the opening of each slot in the first slot groups and the second slot groups has, in at least a central portion thereof, a shape extending along the Y direction or along a direction that is inclined by an angle which is smaller than 45 degrees from the Y direction. With such construction, an electromagnetic wave having a greater field component along the X direction than along the Y direction can be radiated. It is not necessary that the plurality of slots 112 are all in the same orientation, either. Depending on the desired radiation characteristics or reception characteristics, implementations in which the plurality of slots 112 have respectively different orientations may also be possible. Moreover, the plurality of slots included in each first slot group or each second slot group may not be at equal interval along the Y direction.

When viewed from a direction perpendicular to the waveguide face, each port 145U is located in a central portion of the corresponding waveguide member 122U, and located between the central portion of the first slot group and the central portion of the second slot group. The position of each port 145U may be shifted from the central portion of the waveguide member 122U.

Figure 21A:
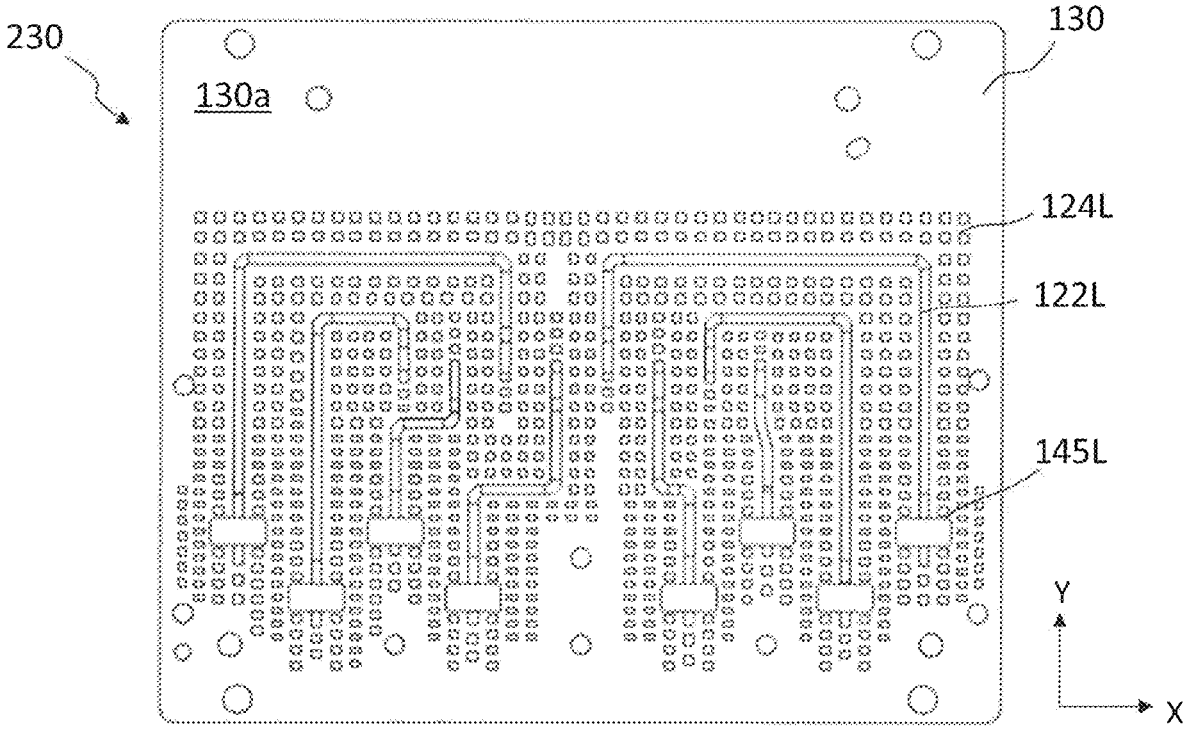
FIG. 21A is a plan view showing a construction for a distribution layer 230.
Figure 21B:
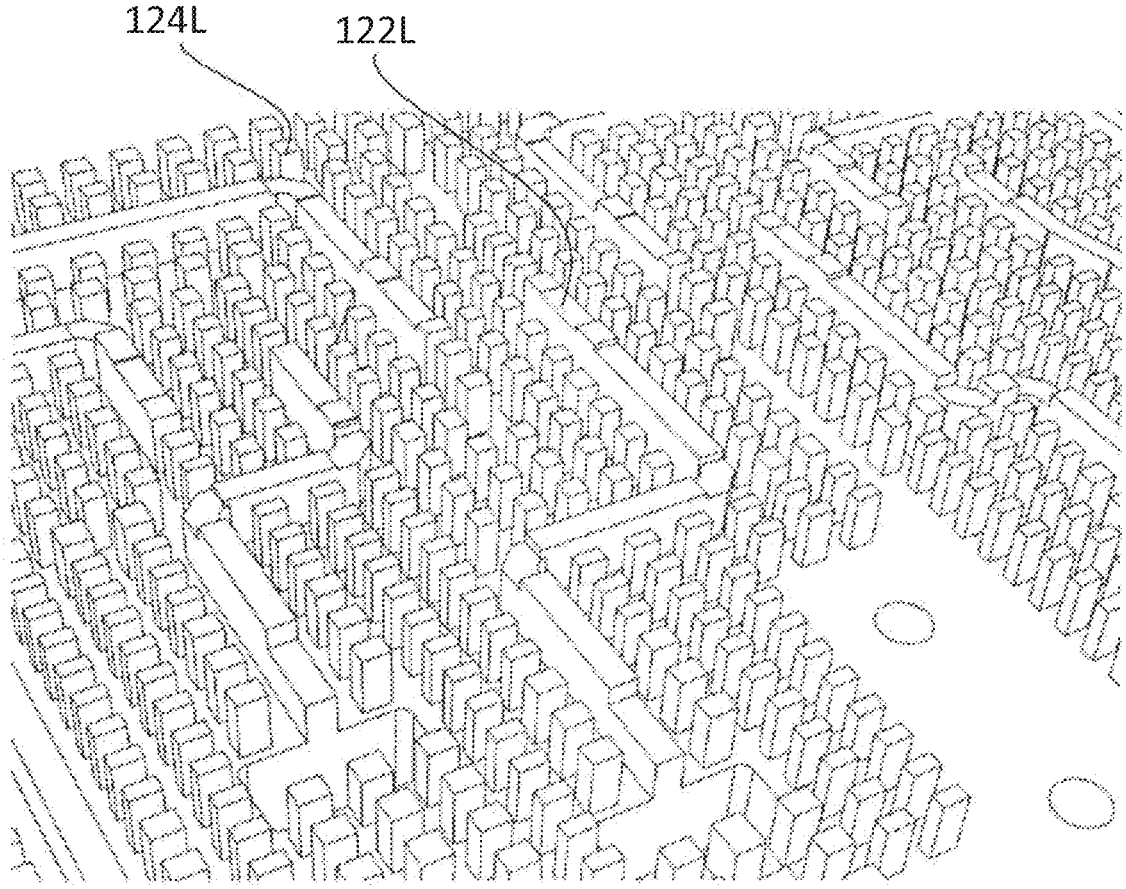
FIG. 21B is a diagram showing an enlarged view of a portion of the distribution layer 230.

FIG. 21A is a plan view showing a construction for the distribution layer 230. FIG. 21B is a diagram showing enlarged a part of the distribution layer 230. The third conductive member 130 in the distribution layer 230 has plurality of ports 145L (throughholes). In this example, there are eight ports 145L. The ports 145L are arranged along the X direction, while being shifted in position along the Y direction.

On the conductive surface **130*a* of the third conductive member 130, the plurality of waveguide members 122L and the plurality of conductive rods 124L are disposed. The plurality of waveguide members 122L are respectively connected to the plurality of ports 145L at one end. Each of the plurality of waveguide members 122L is independent, and has one or more bends. Each waveguide member 122L extends from the port 145L to a position opposed to the corresponding port 145U in the second conductive member 120, along a path having a respectively different length. With such construction, electromagnetic waves of different phases can be supplied to the plurality of ports 145U in the second conductive member 120**.

The plurality of conductive rods 124L are arranged in a two-dimensional array along the X direction and along the Y direction. The conductive rods 124L surround each port 145L and each waveguide member 122L. Via a waveguide not shown, each port 145L is to be connected to a terminal of an electronic circuit including a microwave integrated circuit such as an MMIC. In other words, via the plurality of ports 145L, the electronic circuit is connected to the waveguides extending between the waveguide members 122L and the second conductive member 120. Note that a structure for connecting an electronic circuit and a waveguide is disclosed in US Patent Application Publication Nos. 2018-0351261, 2019-0006743, 2019-0139914, 2019-0067780, and 2019-0140344, and International Patent Application Publication No. 2018/105513, for example. The entire disclosure of these publications is incorporated herein by reference.

As shown in FIG. 21B, each waveguide member 122L has a dent(s) at a bend(s). Moreover, a recess is made in one end of each waveguide member 122L that is connected to a port 145L. Each waveguide member 122L also has one or more bumps. Such a dent(s) and a bump(s) are provided so that an impedance of the waveguide extending between each waveguide member 122L and the second conductive member 120 and an impedance of the port 145U in the second conductive member 120 will match each other. Such a dent(s) and a bump(s) suppress reflection of signal waves.

Figure 22A:
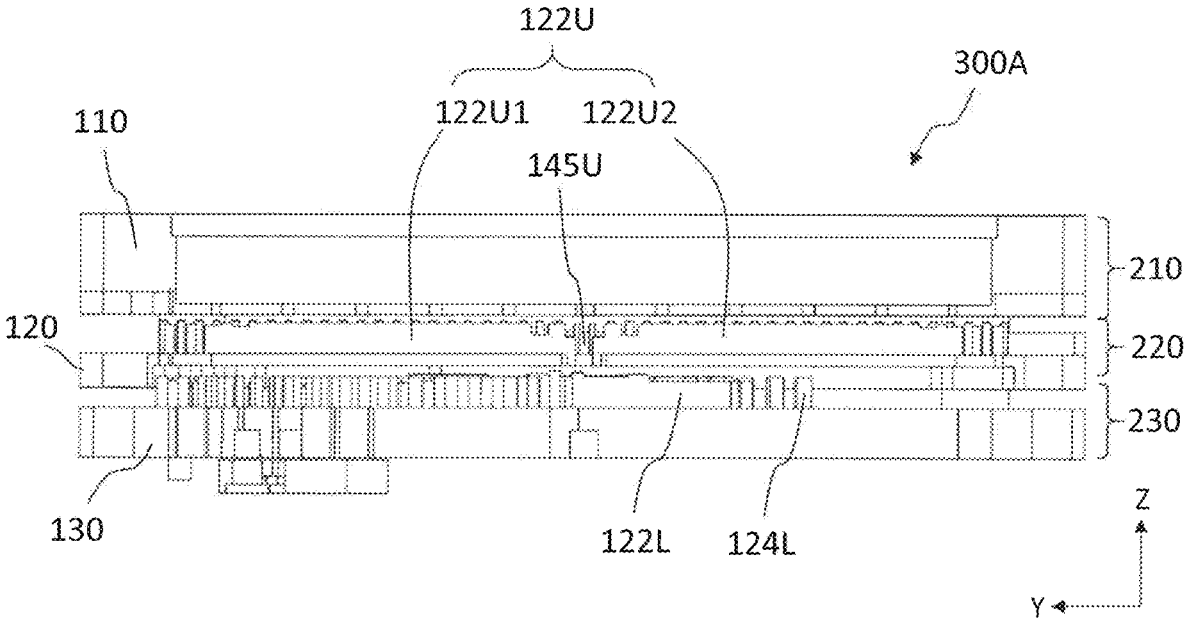
FIG. 22A is a cross-sectional view of the slot array antenna 300A taken along a plane which passes through the center of one waveguide member 122U on the second conductive member 120 and which is parallel to the YZ plane.
Figure 22B:
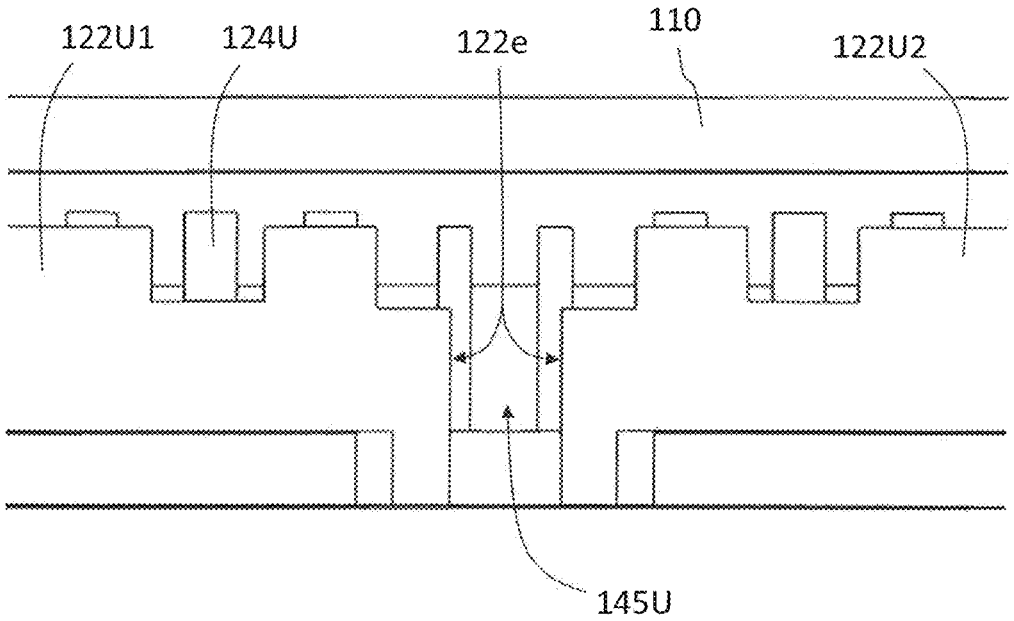
FIG. 22B is a diagram showing an enlarged view of a portion of the structure shown in FIG. 22A.

FIG. 22A is a cross-sectional view of the slot array antenna 300A taken along a plane which passes through the center of one waveguide member 122U on the second conductive member 120 and which is parallel to the YZ plane. FIG. 22B is a diagram showing enlarged a part of the structure shown in FIG. 22A. The waveguide member 122U is split in two portions by the port 145U. The two portions will be referred to as a first ridge 122U1 and a second ridge 122U2. The first ridge 122U1 and the second ridge 122U2 each have a pair of electrically-conductive end faces 122*e*, which are opposed to each other via the port 145U. The pair of end faces 122*e* of the first ridge 122U1 and the second ridge 122U2 and the port 145U define a hollow waveguide. Among the slots in the first slot group and the second slot group, a number of slots that are arranged along the first ridge 122U1 are connected to the waveguide within the port 145U and the waveguide in the underlying layer, via the first waveguide extending between the waveguide face of the first ridge 122U1 and the second conductive surface on the rear side of the first conductive member 110. Similarly, among the slots in the first slot group and the second slot group, the remaining slots that are arranged along the second ridge 122U2 are connected to the waveguide in the port 145U and the waveguide in the underlying layer, via the second waveguide extending between the waveguide face of the second ridge 122U2 and the second conductive surface on the rear side of the first conductive member 110. The waveguide in the underlying layer as referred to in this example is a ridge waveguide that is created between the waveguide face of the waveguide member 122L and the fourth conductive surface on the rear side of the second conductive member 120. Without being limited to a ridge waveguide, the waveguide in the underlying layer of the port 145U may be any other waveguide, e.g., a hollow waveguide.

According to the present example embodiment, a single feeding point in each slot sequence exists, only at one place along the way (e.g., in the center) of the slot sequence. Through the port 145U, feeding occurs from one place at a midpoint between the first and second slot groups, to each slot in the first and second slot groups. An electromagnetic wave which is supplied from the port 145U serving as a feeding slot can be radiated from each slot as a laterally polarized wave or an obliquely polarized wave. As compared to a construction where feeding occurs from both ends of a slot sequence, the device construction can be simplified. More-over, the device can be downsized as compared to a slot array antenna in which a hollow waveguide is used. Therefore, even in the case where high-frequency electromagnetic waves such as millimeter waves are used, good radiation characteristics or reception characteristics can be achieved.

Next, a variant of the present example embodiment will be described.

Figure 23:
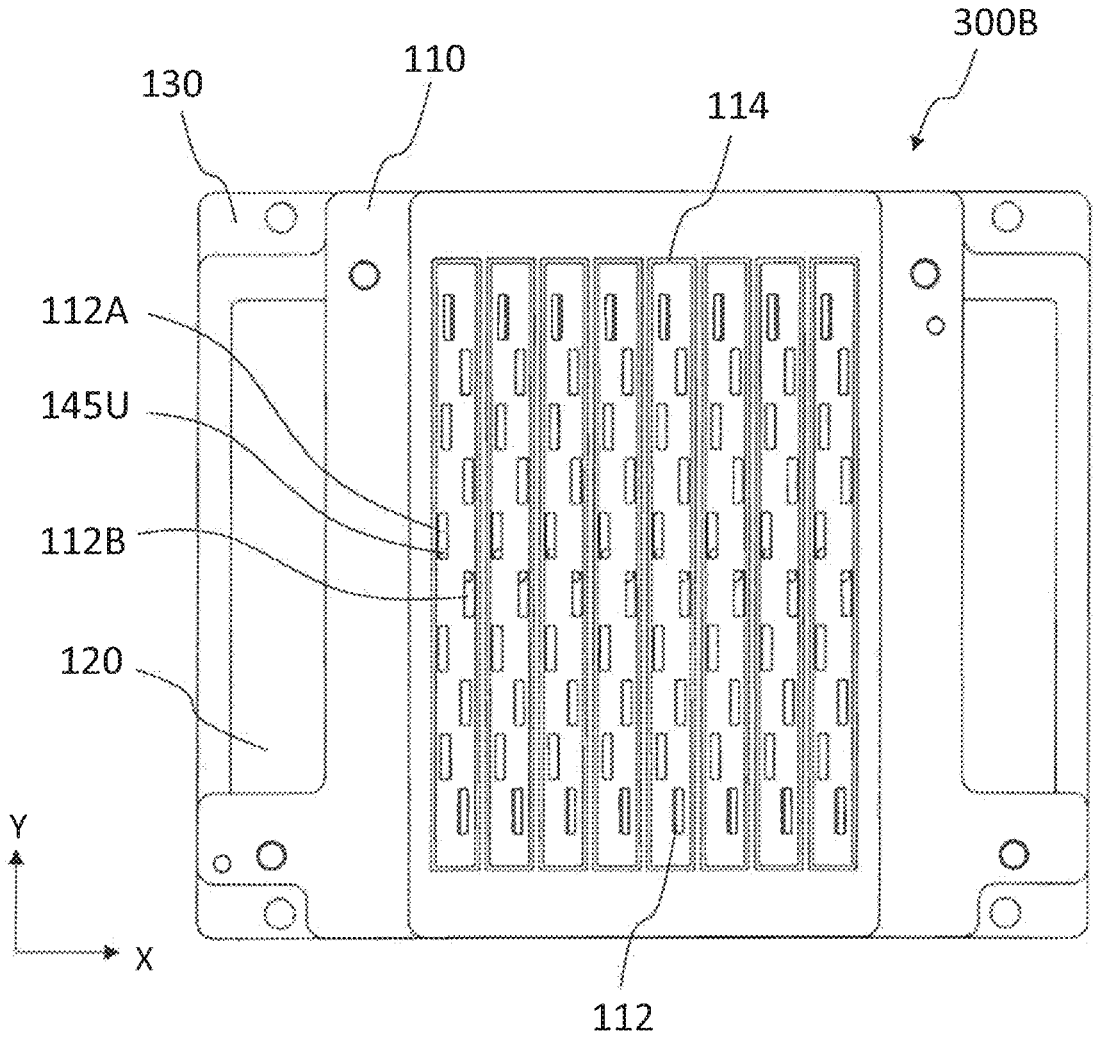
FIG. 23 is a diagram showing a slot array antenna 300B according to a variant of an example embodiment.
Figure 24A:
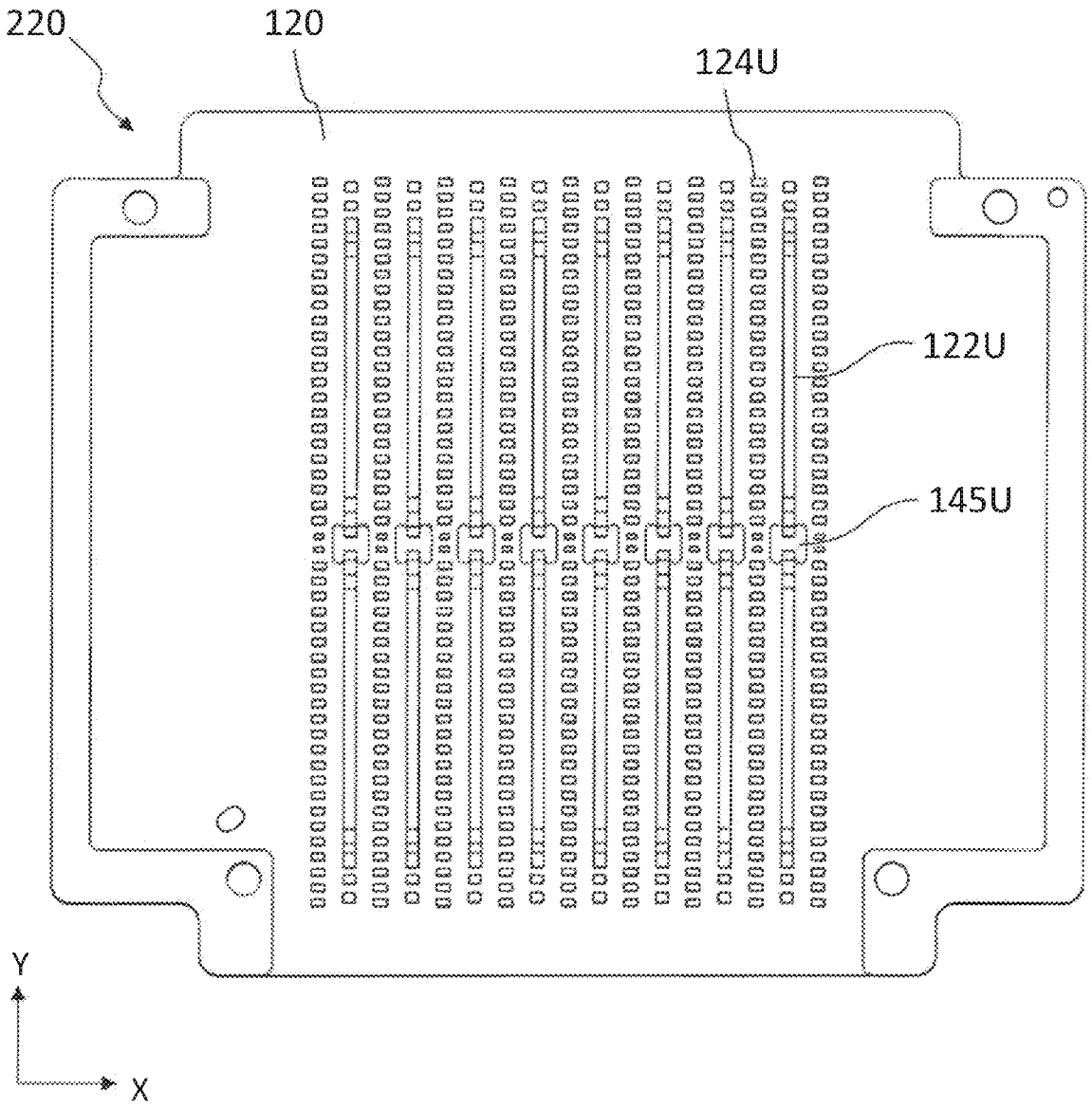
FIG. 24A is a plan view showing an excitation layer 220 according to the variant.
Figure 24B:
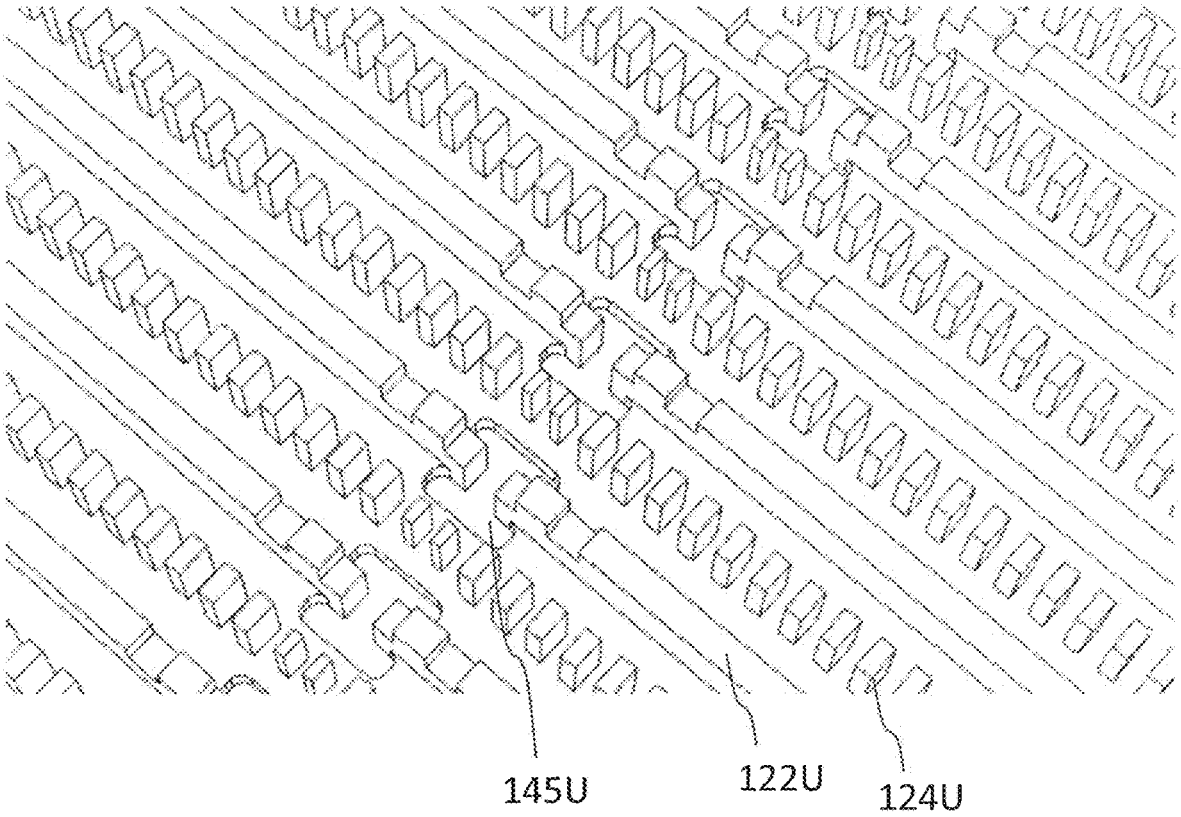
FIG. 24B is a diagram showing an enlarged view of a portion of the excitation layer 220 according to the variant.

FIG. 23 is diagram showing a slot array antenna 300B according to this variant. FIG. 24A is a plan view showing an excitation layer 220 according to this variant. FIG. 24B is a diagram showing enlarged a part of the excitation layer 220 in this variant. This variant differs from the above-described example embodiment in that the opening of each of the plurality of ports 145U in the second conductive member 120 is H-shaped; otherwise, it is similar to the above-described example embodiment.

Figure 24C:
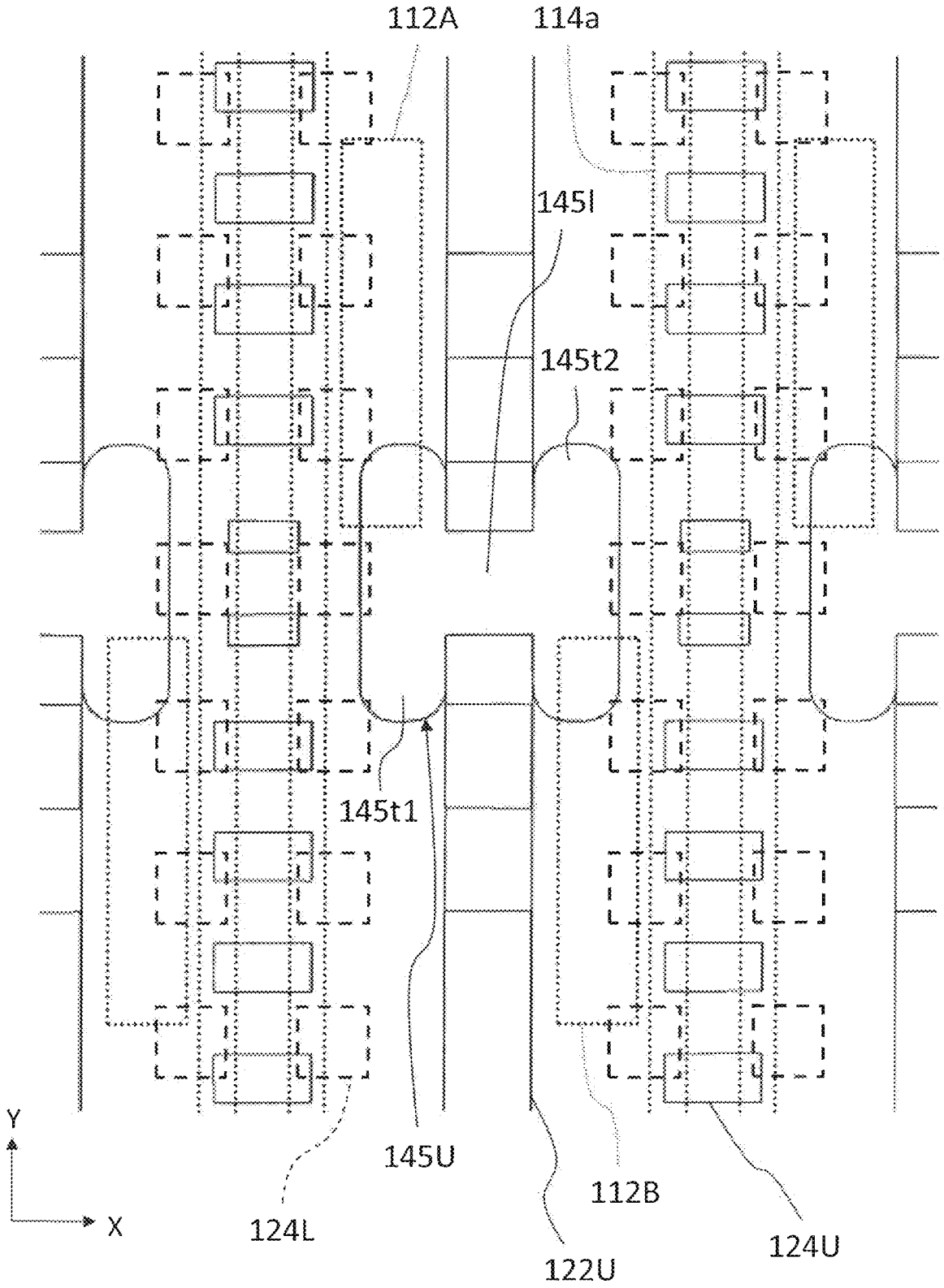
FIG. 24C is a diagram for describing relative positioning between respective elements in the variant.

FIG. 24C is a diagram for describing relative positioning between respective elements in this variant. In FIG. 24C, the waveguide members 122U, the conductive rods 124U, and the ports 145U in the excitation layer 220 are shown with solid lines. The slots 122A and 122B in the radiation layer 210 and electrically conductive walls 114*a* of the horns 114 are shown with dotted lines. The conductive rods 124L in the distribution layer 230 are shown with broken lines. Note that the waveguide members 122L in the distribution layer 230 are not shown in FIG. 24C.

The opening of each port 145U in this example has an H shape that includes a lateral portion 1451, a first vertical portion 145*t*1, and a second vertical portion 145*t*2. One end of the lateral portion 1451 is located between both ends of the first vertical portion 145*t*1, whereas another end of the lateral portion 1451 is located between both ends of the second vertical portion 145*t*2.

In this example, the slots 112A in the first slot group and the slots 112B in the second slot group, which are in a staggered arrangement, slightly overlap the ports 145U which are located below. The ports 145U feed an electromagnetic wave. Moreover, the conductive rods 124L in the distribution layer 230 and the ports 145U slightly overlap. As a result, in see-through view to the central slots 112A and 112B from the +Z direction, ends of the ports 145U are visible, as illustrated in FIG. 23. When an electromagnetic wave passes through a port 145U, a strong electric field will occur in the central portion thereof, whereas only a minute electric field will occur in the periphery. Therefore, even if overlaps exist between ends of the ports 145U and ends of the slots 112A and 112B, the antenna functionality is not necessary undermined. Such structure will allow the interval of arrangement between the slots 112A and 112B to be selected more freely, thus making it easy to improve the directivity of the slot array antenna 300B. As in this example, when viewed from a direction perpendicular to the waveguide face of the waveguide member 122U, at least a portion of each port 145U (throughhole) may over-lap at least one of: one slot included in the first slot group; and one slot included in the second slot group.

Figure 24D:
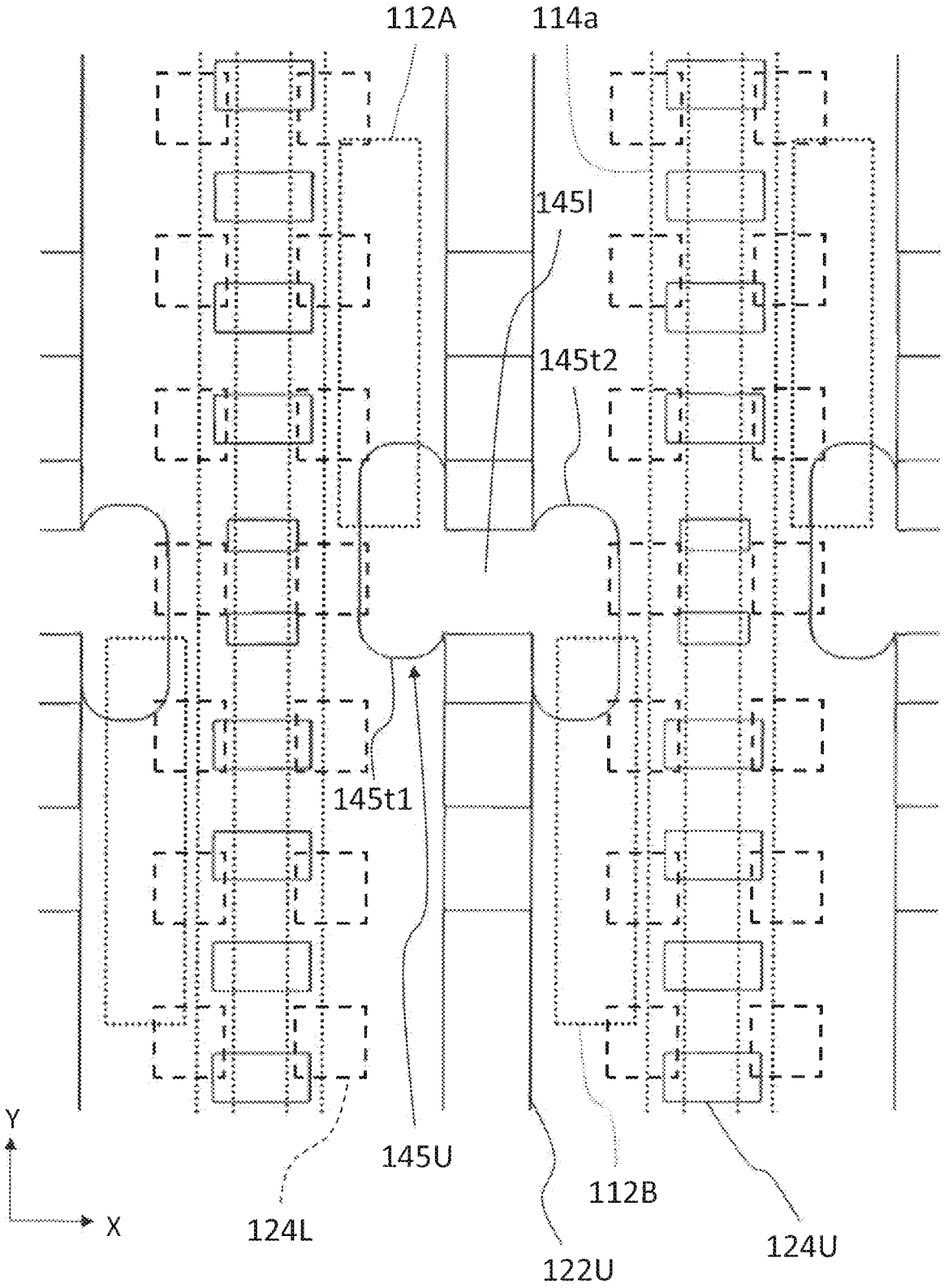
FIG. 24D is a diagram showing another variant.

FIG. 24D is a diagram showing another variant. In this example, the shape of each port 145U differs from that in the example shown in FIG. 24C; otherwise, it is similar to the example of FIG. 24C. In the example shown in FIG. 24D, too, the opening of each port 145U is shaped so as to include: a lateral portion 1451 extending along the X direction; a first vertical portion 145*t*1 extending along the Y direction and being connected to one end of the lateral portion 1451; and a second vertical portion 145*t*2 extending along the Y direction and being connected to another end of the lateral portion 1451. The directions that the vertical portions 145*t*1 and 145*t*2 extend may not be orthogonal to the direction that the lateral portion 1451 extends. When the first direction (the +Y direction) is regarded as a positive direction and an opposite direction (the −Y direction) of the first direction is regarded as a negative direction, a negative end of the first vertical portion 145*t*1 is closer to the lateral portion 1451 than is the positive end of the first vertical portion 145*t*1. Moreover, a positive end of the second vertical portion 145*t*2 is closer to the lateral portion 1451 than is a negative end of the second vertical portion 145*t*2. When viewed from a direction perpendicular to the waveguide face of the waveguide member 122U, the positive end of the first vertical portion 145*t*1 at least partially overlaps the slot 112A in the first slot group that is the closest to the lateral portion 1451, and the negative end of the second vertical portion 145*t*2 at least partially overlaps the slot 112B in the second slot group that is the closest to the lateral portion. With such construction, too, characteristics similar to those of the aforementioned construction are obtained.

The slot array antenna in each of the example embodiments that have been described with reference to FIGS. 17A through 24D has a plurality of sets each including a combination of a first slot group, a second slot group, a waveguide member 122U, and a throughhole (port 145U). The plurality of sets of combinations are arranged along the X direction, which intersects the first direction (the Y direction). The plurality of conductive rods 124U are located around each waveguide member 122U. Example embodiments of the present disclosure are not limited to such an implementation. For example, the slot array antenna may only include a single combination of a first slot group, a second slot group, a waveguide member 122U, and a throughhole (port 145U). Moreover, when constructing an excitation layer and a distribution layer, various circuit elements in waveguides can be utilized. Examples thereof are disclosed in U.S. Pat. Nos. 10,042,045, 10,090,600, 1,015,8158, International Patent Application Publication No. 2018/207796, International Patent Application Publication No. 2018/207838, and US Patent Application Publication No. 2019-0074569, for example. The entire disclosure of these publications is incorporated herein by reference.

A slot array antenna according to an example embodiment of the present disclosure can be suitably used in a radar device or a radar system to be incorporated in moving entities such as vehicles, marine vessels, aircraft, robots, or the like, for example. A radar device would include a slot array antenna according to an example embodiment of the present disclosure and a microwave integrated circuit, e.g., MMIC, that is connected to the slot array antenna. A radar system would include the radar device and a signal processing circuit that is connected to the microwave integrated circuit of the radar device. The signal processing circuit may be configured to estimate an azimuth of each arriving wave by executing an algorithm such as the MUSIC method, the ESPRIT method, or the SAGE method, and output a signal indicating the estimation result. The signal processing circuit may further be configured to estimate the distance to each target as a wave source of an arriving wave, the relative velocity of the target, and the azimuth of the target by using a known algorithm, and output a signal indicating the estimation result.

In the present disclosure, the term "signal processing circuit" is not limited to a single circuit, but encompasses any implementation in which a combination of plural circuits is conceptually regarded as a single functional part. The signal processing circuit may be realized by one or more System-on-Chips (SoCs). For example, a part or a whole of the signal processing circuit may be an FPGA (Field-Programmable Gate Array), which is a programmable logic device (PLD). In that case, the signal processing circuit includes a plurality of computation elements (e.g., general-purpose logics and multipliers) and a plurality of memory elements (e.g., look-up tables or memory blocks). Alternatively, the signal processing circuit may be a set of a general-purpose processor(s) and a main memory device(s). The signal processing circuit may be a circuit which includes a processor core(s) and a memory device(s). These may function as the signal processing circuit.

A slot antenna array according to an example embodiment of the present disclosure includes a waffle iron structure which permits downsizing, and thus allows the area of the face on which antenna elements are arrayed to be significantly reduced, as com-pared to conventional constructions. Therefore, a radar system incorporating the slot array antenna can be easily mounted in a narrow place such as a face of a rearview mirror in a vehicle that is opposite to its specular surface, or a small-sized moving entity such as a UAV (an Unmanned Aerial Vehicle, a so-called drone). Note that, without being limited to the implementation where it is mounted in a vehicle, a radar system may be used while being fixed on the road or a building, for example.

A slot array antenna according to an example embodiment of the present disclosure can also be used in a wireless communication system. Such a wireless communication system would include a slot array antenna according to any of the above example embodiments and a communication circuit (a transmission circuit or a reception circuit) that is connected to the slot array antenna. The transmission circuit may be, for example, configured to supply a signal wave representing a signal for transmission to a waveguide within the slot array antenna. The reception circuit may be configured to demodulate a signal wave which has been received via the slot array antenna, and output it as an analog or digital signal.

A slot array antenna according to an example embodiment of the present disclosure can further be used as an antenna in an indoor positioning system (IPS). An indoor positioning system is able to identify the position of a moving entity, such as a person or an automated guided vehicle (AGV), that is in a building. A slot array antenna can also be used as a radio wave transmitter (beacon) for use in a system which provides information to an information terminal device (e.g., a smartphone) that is carried by a person who has visited a store or any other facility. In such a system, once every several seconds, a beacon may radiate an electromagnetic wave carrying an ID or other information super-posed thereon, for example. When the information terminal device receives this electromagnetic wave, the information terminal de-vice transmits the received information to a remote server computer via telecommunication lines. Based on the information that has been received from the information terminal device, the server computer identifies the position of that information terminal de-vice, and provides information which is associated with that position (e.g., product information or a coupon) to the information terminal device.

Application examples of a radar system, a communication system, and various monitoring systems including a slot array antenna having a WRG structure are disclosed in the specification of U.S. Pat. No. 9,786,995 and the specification of U.S. Pat. No. 10,027,032, for example. The entire disclosure of these publications is incorporated herein by reference. A slot array antenna according to the present disclosure is applicable to each application example that is disclosed in these publications.

A slot array antenna according to the present disclosure is usable in any technological field that utilizes electromagnetic waves. For example, it is available to various applications where transmission/reception of electromagnetic waves of the gigahertz band or the terahertz band is performed. In particular, they may be suitably used in onboard radar systems, various types of monitoring systems, indoor positioning systems, wireless communication systems, etc., where downsizing is desired.

This application is based on Japanese Patent Applications No. 2018-113890 filed on Jun. 14, 2018, the entire contents of which are hereby incorporated by reference.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A slot array antenna comprising:

a first electrically conductive member including a first electrically conductive surface on a front side and a second electrically conductive surface on a rear side;

a second electrically conductive member including a third electrically conductive surface which is opposed to the second electrically conductive surface;

a ridge-shaped waveguide member on the third electrically conductive surface, the waveguide member including an electrically-conductive waveguide surface opposed to the second electrically conductive surface and extending along a first direction; and a plurality of electrically conductive rods disposed on both sides of the waveguide member, each including a root connected to the third electrically conductive surface and a leading end opposed to the second electrically conductive surface; wherein the first electrically conductive member includes a plurality of slots each including:

a first slot group arranged along the first direction; and a second slot group being adjacent to the first slot group and arranged along the first direction;

when viewed from a direction perpendicular to the waveguide surface:

a center of each slot in the first slot group is located on one side of a center line of the waveguide surface;

a center of each slot in the second slot group is located on another side of the center line of the waveguide surface; and a distance between the center of each slot in the first slot group and the second slot group and the center line of the waveguide surface is shorter than a distance between the center line of the waveguide surface and a center of an electrically conductive rod that is the closest to the center line;

along the first direction, a center of at least one slot in the first slot group is located between two adjacent slots in the second slot group;

along the first direction, the center of at least one slot in the second slot group is located between two adjacent slots in the first slot group;

at least a central portion of an opening of each slot included in the first slot group and each slot included in the second slot group extends along the first direction, or along a direction that is inclined by an angle which is smaller than about 45 degrees from the first direction;

the second electrically conductive member has a throughhole;

the waveguide member is split by the throughhole into a first ridge and a second ridge;

when viewed from a direction perpendicular to the waveguide surface, a center of the throughhole is located between one slot included in the first slot group and one slot included in the second slot group;

an opening defined by the throughhole includes:

a lateral portion extending along a second direction that intersects the first direction;

a first vertical portion being connected to one end of the lateral portion and extending along the first direction; and a second vertical portion being connected to another end of the lateral portion and extending along the first direction;

along the first direction, at least one of the first vertical portion and the second vertical portion has at least a partial overlap with at least one slot included in the first slot group or the second slot group;

a number of slots in the first slot group and the second slot group is or are connected to a waveguide within the throughhole via a first waveguide extending between the waveguide surface of the first ridge and the second electrically conductive surface; and a remaining slot or slots in the first slot group and the second slot group is or are connected to the waveguide in the throughhole via a second waveguide extending between the waveguide surface of the second ridge and the second electrically conductive surface.

2. The slot array antenna of claim 1, wherein one end of the lateral portion is located between both ends of the first vertical portion; and another end of the lateral portion is located between both ends the second vertical portion.

3. The slot array antenna of claim 1, wherein the first direction is regarded as a positive direction, and an opposite direction of the first direction is regarded as a negative direction;

a positive end of the first vertical portion is closer to the lateral portion than is a negative end of the first vertical portion;

a negative end of the second vertical portion is closer to the lateral portion than is a positive end of the second vertical portion;

the positive end of the first vertical portion has a smaller distance to a slot in the first slot group that is the closest to the lateral portion, than does the negative end of the first vertical portion; and the negative end of the second vertical portion has a smaller distance to a slot in the second slot group that is the closest to the lateral portion, than does the positive end of the second vertical portion.

4. The slot array antenna of claim 3, further comprising a plurality of sets each including a combination of the first slot group, the second slot group, the waveguide member, and the throughhole; wherein the plurality of sets of combinations are arranged along a direction that intersects the first direction; and the plurality of electrically conductive rods are located around each waveguide member.

5. The slot array antenna of claim 1, wherein the first direction is regarded as a positive direction, and an opposite direction of the first direction is regarded as a negative direction;

a negative end of the first vertical portion is closer to the lateral portion than is a positive end of the first vertical portion; and a positive end of the second vertical portion is closer to the lateral portion than is a negative end of the second vertical portion; and when viewed from a direction perpendicular to the waveguide surface:

the positive end of the first vertical portion at least partially overlaps a slot in the first slot group that is the closest to the lateral portion; and the negative end of the second vertical portion at least partially overlaps a slot in the second slot group that is the closest to the lateral portion.

6. The slot array antenna of claim 5, further comprising a plurality of sets each including a combination of the first slot group, the second slot group, the waveguide member, and the throughhole; wherein the plurality of sets of combinations are arranged along a direction that intersects the first direction; and the plurality of electrically conductive rods are located around each waveguide member.

7. The slot array antenna of claim 1, wherein, one end of the lateral portion is located between both ends of the first vertical portion;

another end of the lateral portion is located between both ends the second vertical portion; and when viewed from a direction perpendicular to the waveguide surface, at least a portion of the throughhole overlaps at least one of one slot included in the first slot group, and one slot included in the second slot group.

8. A radar device comprising:

the slot array antenna of claim 4; and a microwave integrated circuit connected to the slot array antenna.

9. The slot array antenna of claim 1, wherein, when viewed from a direction perpendicular to the waveguide surface, the center of the throughhole is located between a central portion of a region in which the first slot group is distributed and a central portion of a region in which the second slot group is distributed.

10. The slot array antenna of claim 1, wherein one end of the lateral portion is located between both ends of the first vertical portion;

another end of the lateral portion is located between both ends the second vertical portion;

when viewed from a direction perpendicular to the waveguide surface:

at least a portion of the throughhole overlaps at least one of one slot included in the first slot group, and one slot included in the second slot group; and the center of the throughhole is located between a central portion of a region in which the first slot group is distributed and a central portion of a region in which the second slot group is distributed.

11. The slot array antenna of claim 1, wherein the throughhole is located in a central portion of the waveguide member regarding the first direction;

through the throughhole, feeding occurs from one place at a midpoint between the first and second slot groups to each slot in the first and second slot groups.

12. The slot array antenna of claim 1, wherein the throughhole is located in a central portion of the waveguide member regarding the first direction;

through the throughhole, feeding occurs from one place at a midpoint between the first and second slot groups to each slot in the first and second slot groups; and when viewed from a direction perpendicular to the waveguide surface, at least a portion of the throughhole overlaps at least one of one slot included in the first slot group, and one slot included in the second slot group.

13. The slot array antenna of claim 1, wherein the first electrically conductive surface of the first electrically conductive member has a shape defining an electrically-conductive horn;

the horn includes a pair of wall surfaces rising from the first electrically conductive surface and extending along the first direction; and when viewed from a direction perpendicular to the first electrically conductive surface, the first slot group and the second slot group are located between the pair of wall surfaces.

14. The slot array antenna of claim 1, wherein one end of the lateral portion is located between both ends of the first vertical portion;

another end of the lateral portion is located between both ends the second vertical portion;

when viewed from a direction perpendicular to the waveguide surface, at least a portion of the throughhole overlaps at least one of one slot included in the first slot group, and one slot included in the second slot group;

the first electrically conductive surface of the first electrically conductive member has a shape defining an electrically-conductive horn;

the horn includes a pair of wall surfaces rising from the first electrically conductive surface and extending along the first direction; and when viewed from a direction perpendicular to the first electrically conductive surface, the first slot group and the second slot group are located between the pair of wall surfaces.

15. The slot array antenna of claim 14, further comprising a plurality of sets each including a combination of the first slot group, the second slot group, the waveguide member, and the throughhole; wherein the plurality of sets of combinations are arranged along a direction that intersects the first direction; and the plurality of electrically conductive rods are located around each waveguide member.

16. The slot array antenna of claim 15, wherein the second electrically conductive member includes a fourth electrically conductive surface which is opposite to the third electrically conductive surface;

the slot array antenna further comprises a third electrically conductive member including a fifth electrically conductive surface which is opposed to the fourth electrically conductive surface; and a waveguide that is connected to the throughhole extends between the fourth electrically conductive surface and the fifth electrically conductive surface.

17. A radar device comprising:

the slot array antenna of claim 16; and a microwave integrated circuit connected to the slot array antenna.

18. The slot array antenna of claim 1, further comprising a plurality of sets each including a combination of the first slot group, the second slot group, the waveguide member, and the throughhole; wherein the plurality of sets of combinations are arranged along a direction that intersects the first direction; and the plurality of electrically conductive rods are located around each waveguide member.

19. The slot array antenna of claim 1, wherein, the second electrically conductive member includes a fourth electrically conductive surface which is opposite to the third electrically conductive surface;

the slot array antenna further comprises a third electrically conductive member including a fifth electrically conductive surface which is opposed to the fourth electrically conductive surface; and a waveguide that is connected to the throughhole extends between the fourth electrically conductive surface and the fifth electrically conductive surface.

20. A radar device comprising:

the slot array antenna of claim 1; and a microwave integrated circuit connected to the slot array antenna.

* * * * *